US010386102B2

(12) United States Patent
Lee et al.

(10) Patent No.: US 10,386,102 B2
(45) Date of Patent: Aug. 20, 2019

(54) DEFROSTING DEVICE AND REFRIGERATOR HAVING THE SAME

(71) Applicant: LG ELECTRONICS INC., Seoul (KR)

(72) Inventors: Geunhyung Lee, Seoul (KR); Jongryul Kim, Seoul (KR); Kwangsoo Jung, Seoul (KR); Woocheol Kang, Seoul (KR); Jongmin Lee, Seoul (KR); Hyunwoo Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 50 days.

(21) Appl. No.: 15/312,772

(22) PCT Filed: Oct. 21, 2015

(86) PCT No.: PCT/KR2015/011164

§ 371 (c)(1),
(2) Date: Nov. 21, 2016

(87) PCT Pub. No.: WO2016/064200

PCT Pub. Date: Apr. 28, 2016

(65) Prior Publication Data

US 2017/0336114 A1 Nov. 23, 2017

(30) Foreign Application Priority Data

Oct. 21, 2014 (KR) ..... 10-2014-0142753
Aug. 17, 2015 (KR) ..... 10-2015-0115650
(Continued)

(51) Int. Cl.
*F25B 47/02* (2006.01)
*F25D 21/08* (2006.01)
(Continued)

(52) U.S. Cl.
CPC ..... *F25B 47/022* (2013.01); *F25D 21/08* (2013.01); *F28D 15/0266* (2013.01);
(Continued)

(58) Field of Classification Search
CPC .... F25B 47/022; F25B 47/02; F25B 2400/01; F25D 21/08; F25D 21/12; F25D 21/06;
(Continued)

(56) References Cited

U.S. PATENT DOCUMENTS 2,081,479 A 5/1937 Fink
2,652,697 A 9/1953 Pellegrini
(Continued)

FOREIGN PATENT DOCUMENTS

CN 202630542 U 12/2012
JP 50152103 A 12/1975
(Continued)

OTHER PUBLICATIONS

International Search Report and Written Opinion in International Application No. PCT/KR2015/011164, dated Apr. 14, 2016, 13 pages.
(Continued)

*Primary Examiner* — Joseph F Trpisovsky
(74) *Attorney, Agent, or Firm* — Fish & Richardson P.C.

(57) ABSTRACT

A defrosting device includes a heating unit filled with a working fluid and including an active heating part heated to a first temperature that can evaporate the working fluid, and a passive heating part positioned at a rear side of the active heating part and heated to a lower temperature than the first temperature. The defrosting device also includes a heat pipe disposed adjacent to an evaporator to transfer heat to the evaporator while circulating working fluid heated by the active heating part, the heat pipe including an entrance portion configured to receive working fluid evaporated by
(Continued)

the active heating part, and a return portion connected adjacent to the passive heating part and configured to receive working fluid that has condensed after circulating through the heat pipe. Condensed working fluid received at the heating unit first passes through the passive heating part before being reheated at the active heating part.

19 Claims, 28 Drawing Sheets

(30) Foreign Application Priority Data

Sep. 15, 2015 (KR) ..... 10-2015-0130506
Sep. 15, 2015 (KR) ..... 10-2015-0130510

(51) Int. Cl.
*F28D 15/02* (2006.01)
*F25D 21/12* (2006.01)

(52) U.S. Cl.
CPC ..... *F25B 2400/01* (2013.01); *F25D 21/12* (2013.01); *F28F 2215/04* (2013.01)

(58) Field of Classification Search
CPC ..... F25D 21/04; F25D 21/00; F28D 15/0266; F28D 15/02; F28D 15/025; F28F 2215/04
USPC ..... 62/82
See application file for complete search history.

(56) References Cited

U.S. PATENT DOCUMENTS

| | | | | |
|---|---|---|---|---|
| 4,369,350 | A * | 1/1983 | Kobayashi | F25D 21/08 219/201 |
| 6,456,785 | B1 | 9/2002 | Evans | |
| 7,496,284 | B2 | 2/2009 | Pleschinger et al. | |
| 2005/0172644 | A1* | 8/2005 | Zhang | F25B 25/005 62/6 |
| 2011/0073586 | A1 | 3/2011 | Lim et al. | |

FOREIGN PATENT DOCUMENTS

| | | | |
|---|---|---|---|
| JP | 52063246 | | 10/1977 |
| JP | 59077282 | A | 5/1984 |
| JP | 60089653 | A | 5/1985 |
| JP | 62261882 | A | 11/1987 |
| JP | 7159018 | A | 6/1995 |
| JP | 08-313144 | | 11/1996 |
| JP | 8303932 | A | 11/1996 |
| JP | 8313144 | A | 11/1996 |
| JP | H0313144 | | 11/1996 |
| JP | 9264657 | A | 10/1997 |
| JP | 2007198661 | A | 8/2007 |
| KR | 169322 | A | 2/1999 |
| KR | 10-2003-0006262 | | 1/2003 |
| KR | 1020030006262 | | 1/2003 |
| KR | 10-0388708 | | 6/2003 |
| KR | 10-2003-0068931 | | 8/2003 |
| KR | 10-2010-0108978 | | 10/2010 |
| KR | 101036685 | | 10/2010 |
| KR | 1036685 | A | 5/2011 |
| KR | 1125827 | A | 3/2012 |
| KR | 10-2013-0070309 | | 6/2013 |
| KR | 1020130070309 | | 6/2013 |

OTHER PUBLICATIONS

European Extended Search Report in European Application No. 15853031.1, dated Jun. 1, 2018, 10 pages.
Office Action in Chinese Application No. 201580040976.4, dated Sep. 27, 2018, 10 pages (with English Translation).

* cited by examiner

[Fig. 1]
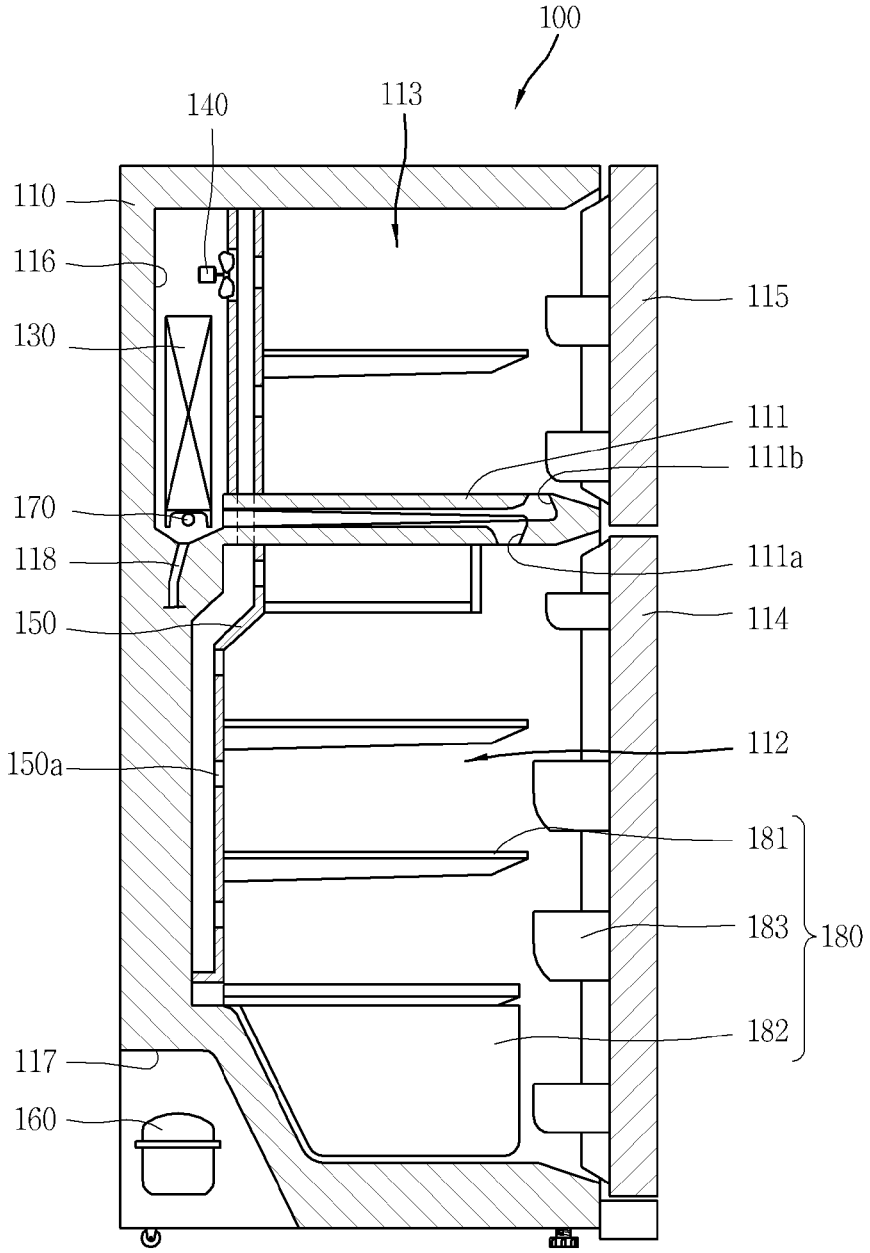

[Fig. 2]
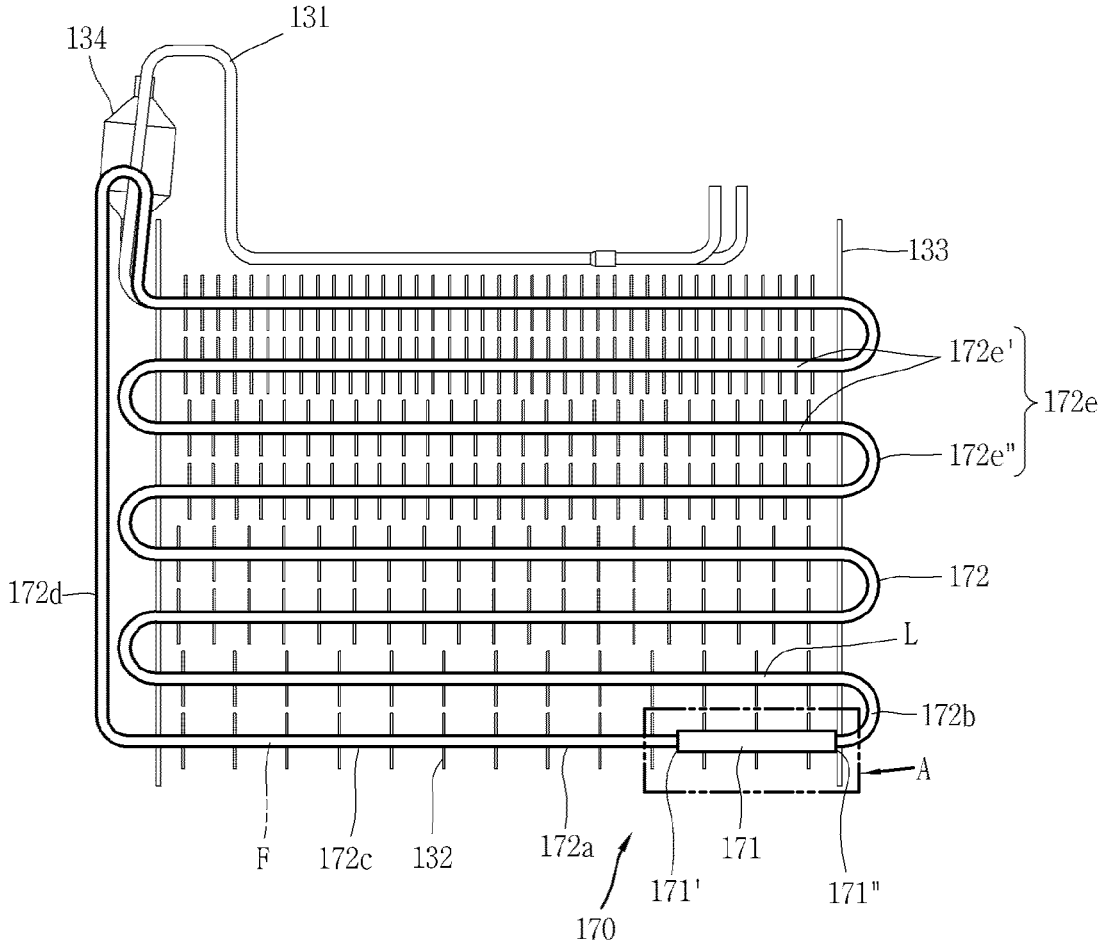
[Fig. 3]
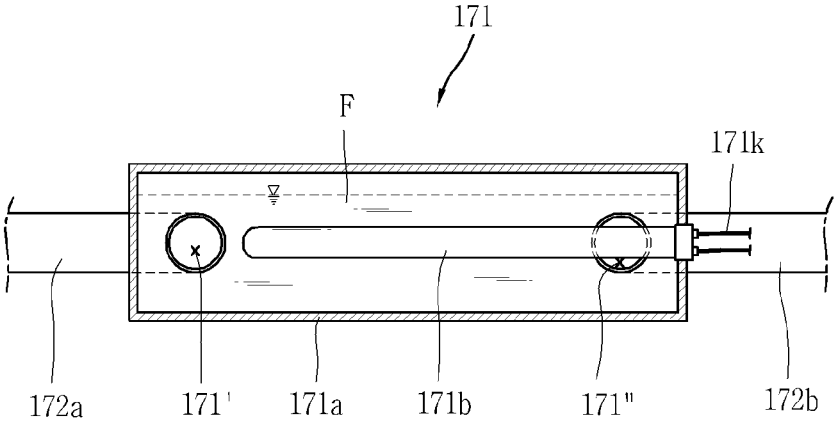

[Fig. 4]
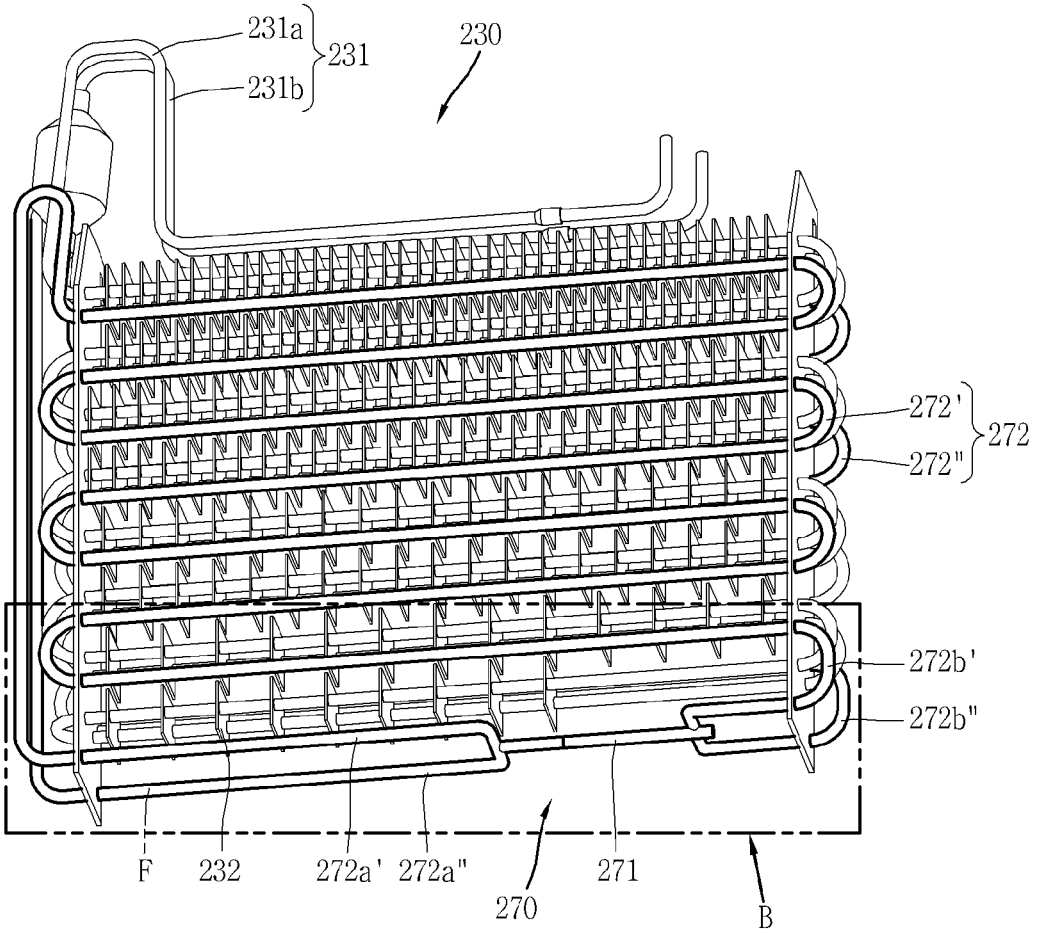

[Fig. 5]
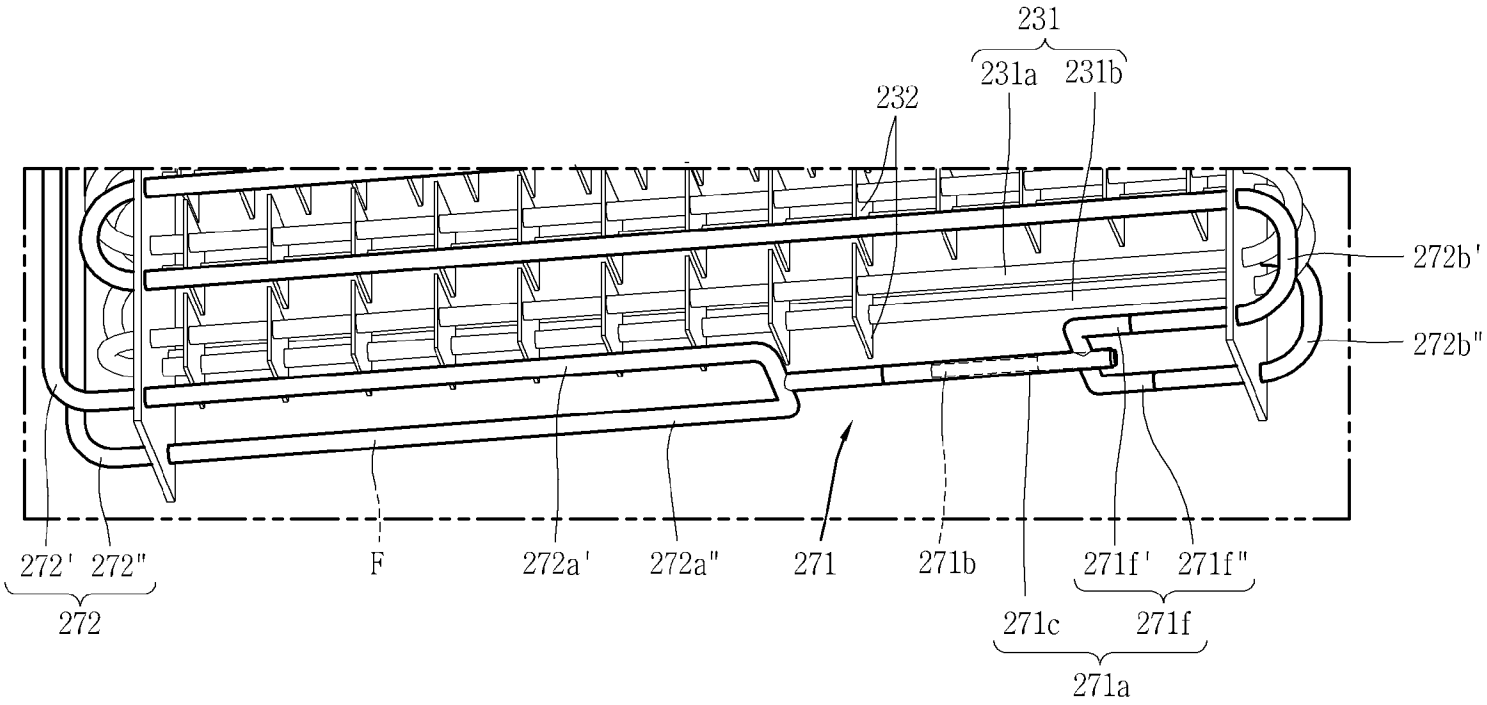

[Fig. 6]
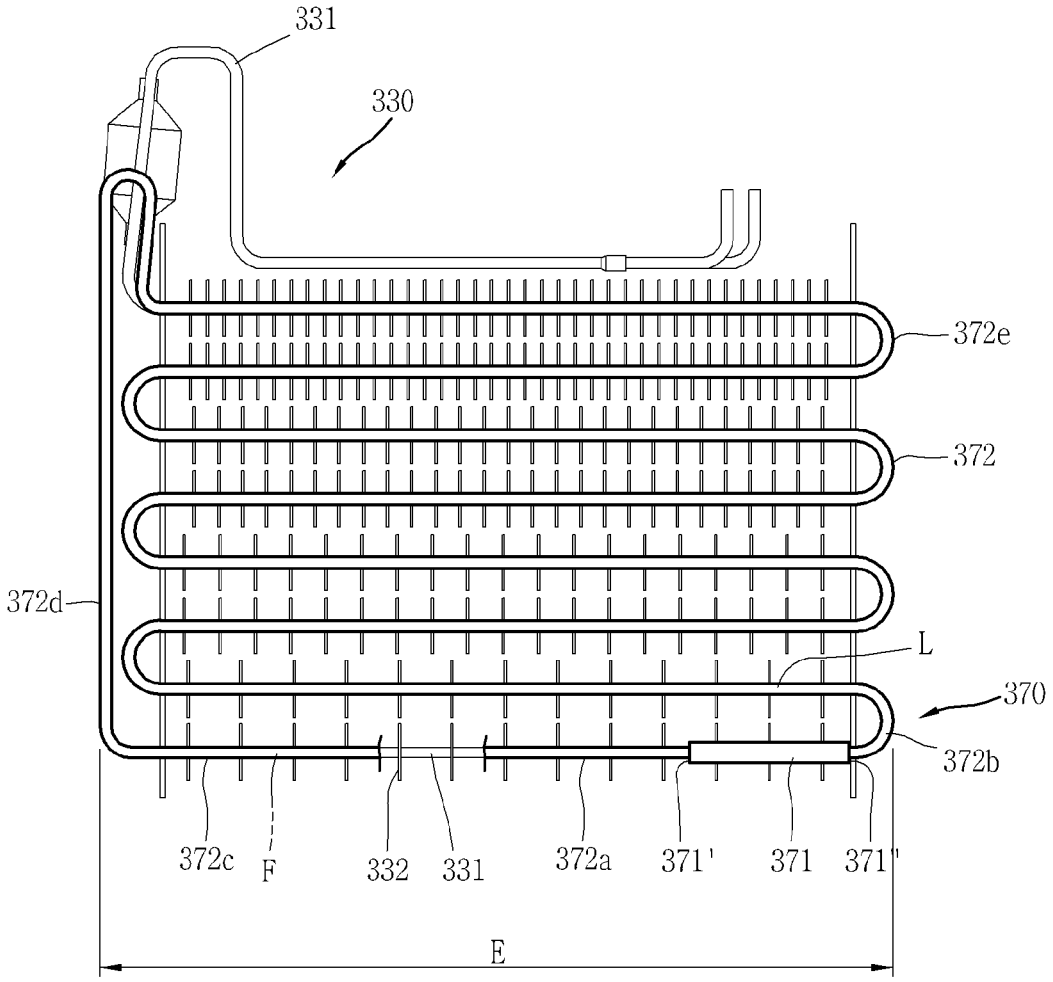

[Fig. 7]
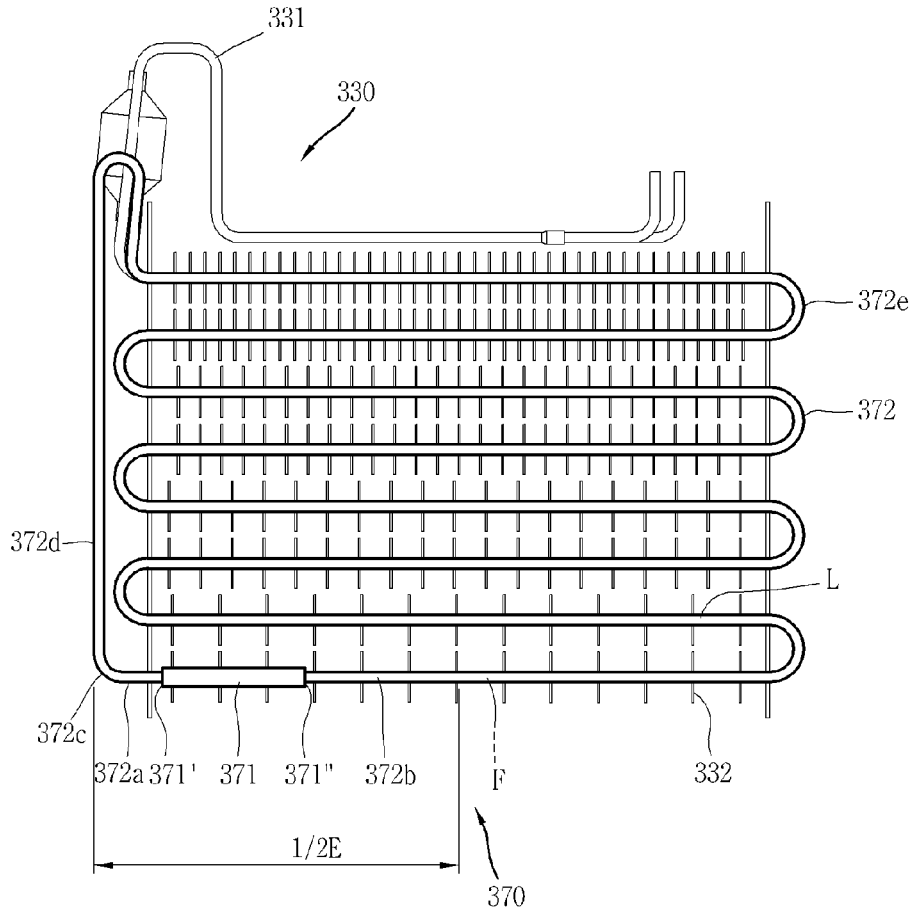

[Fig. 8]
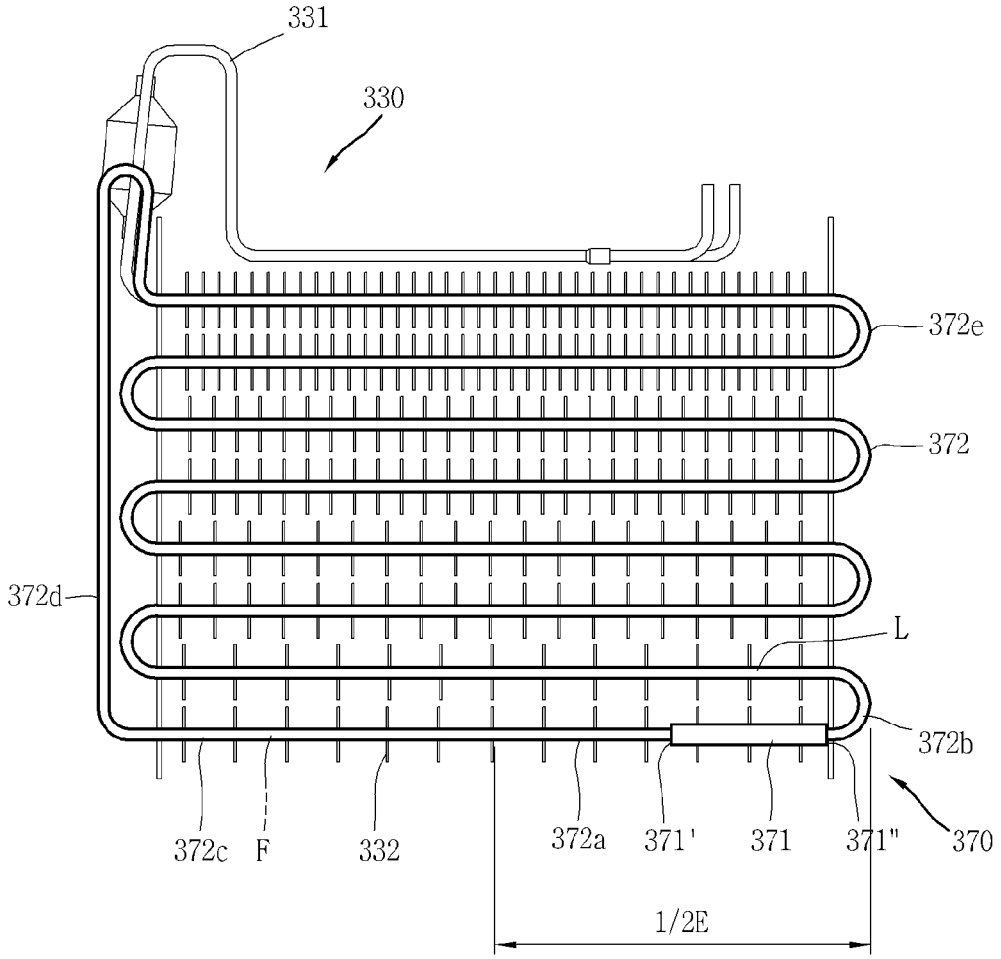
[Fig. 9]
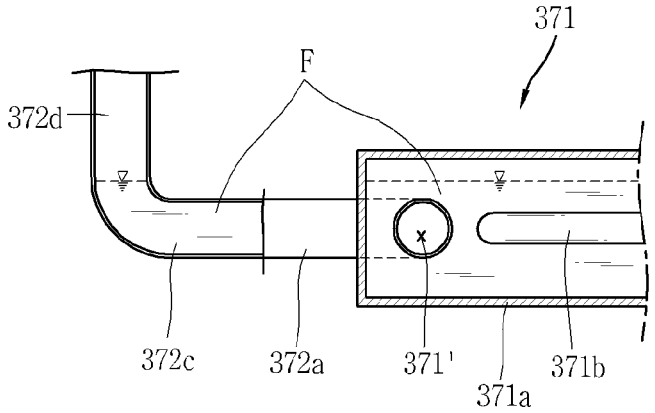

[Fig. 10]
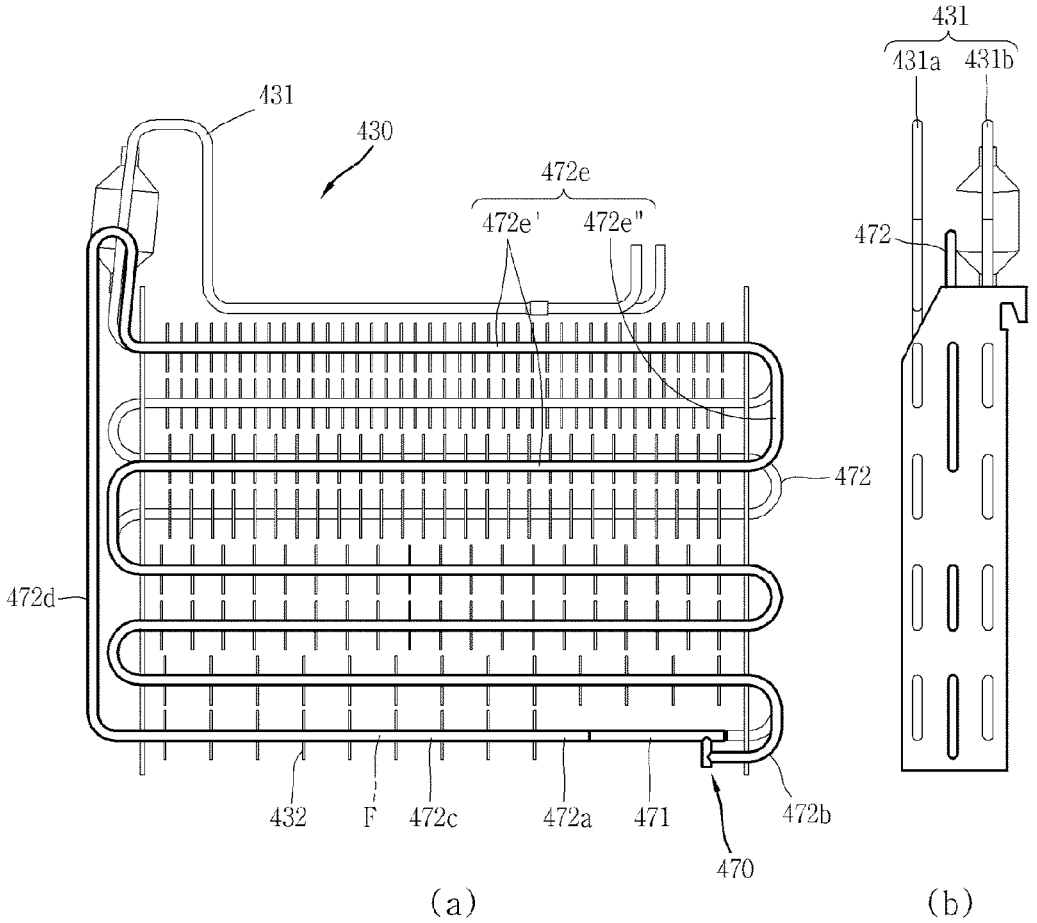

[Fig. 11]
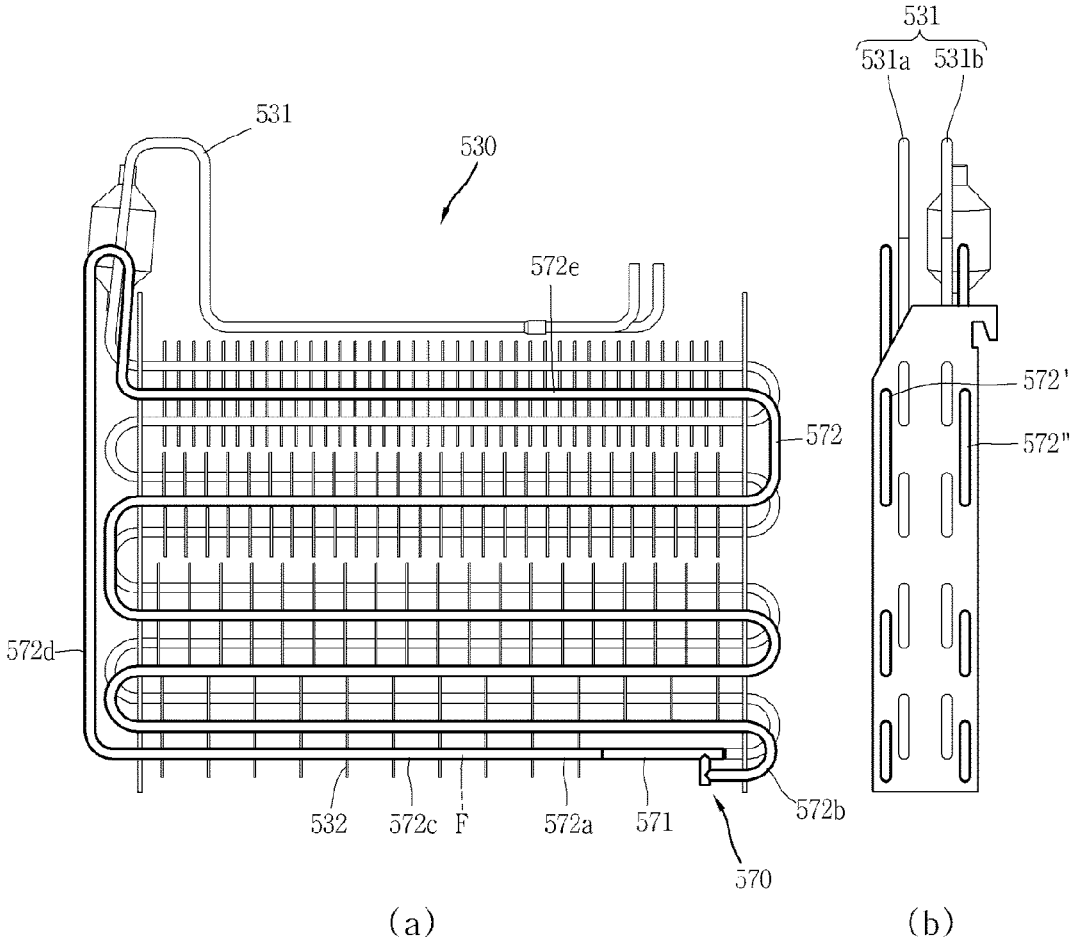

[Fig. 12]
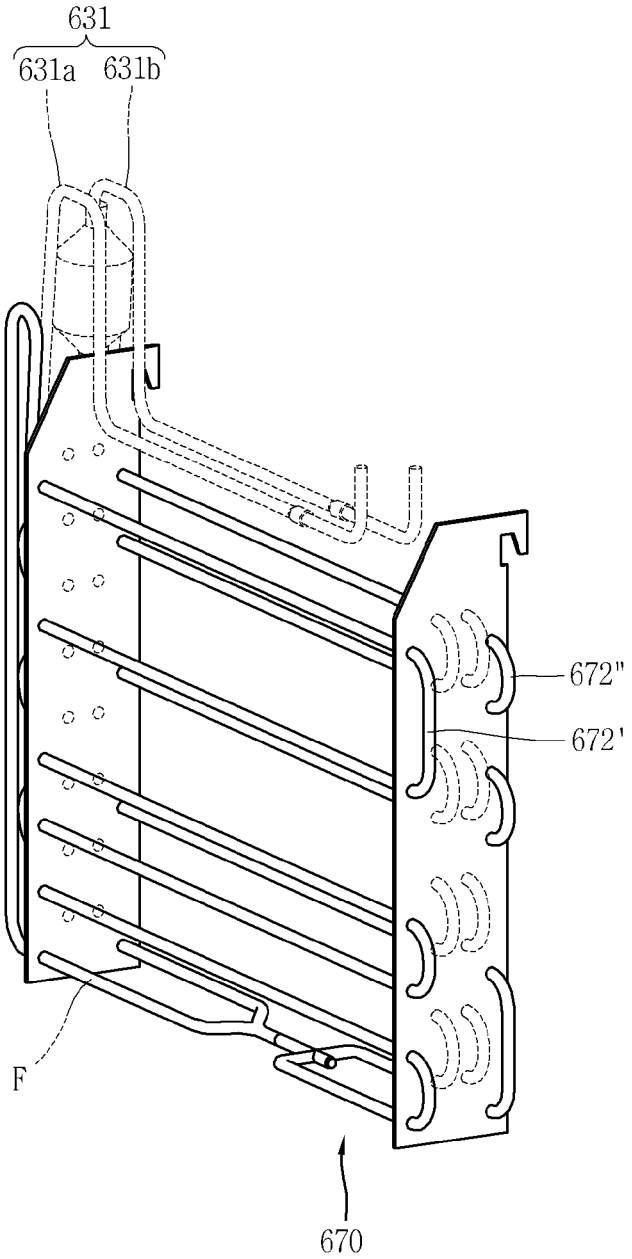

[Fig. 13]
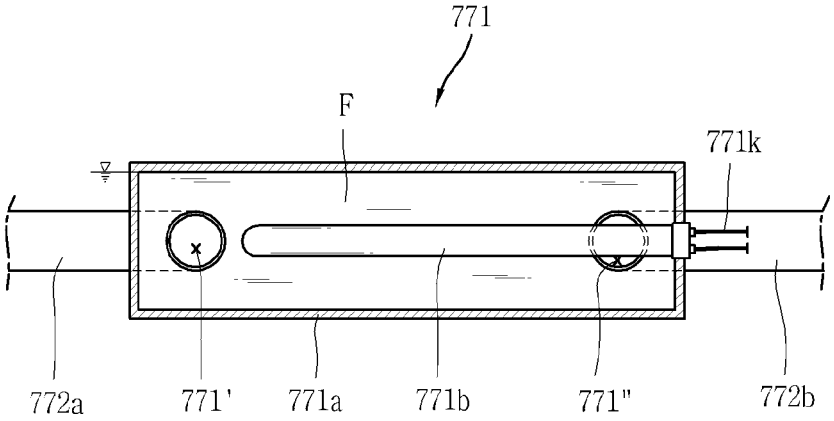
[Fig. 14]
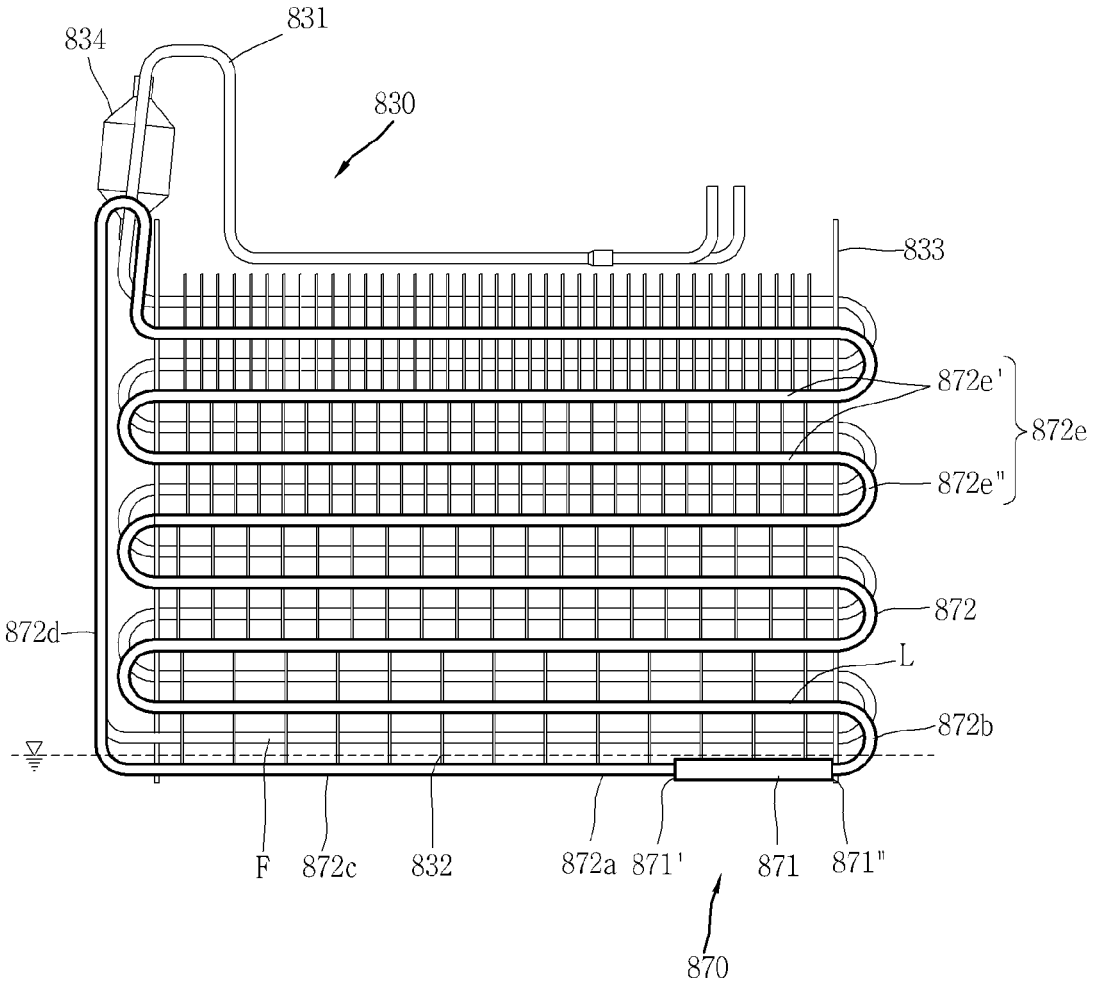

[Fig. 15]
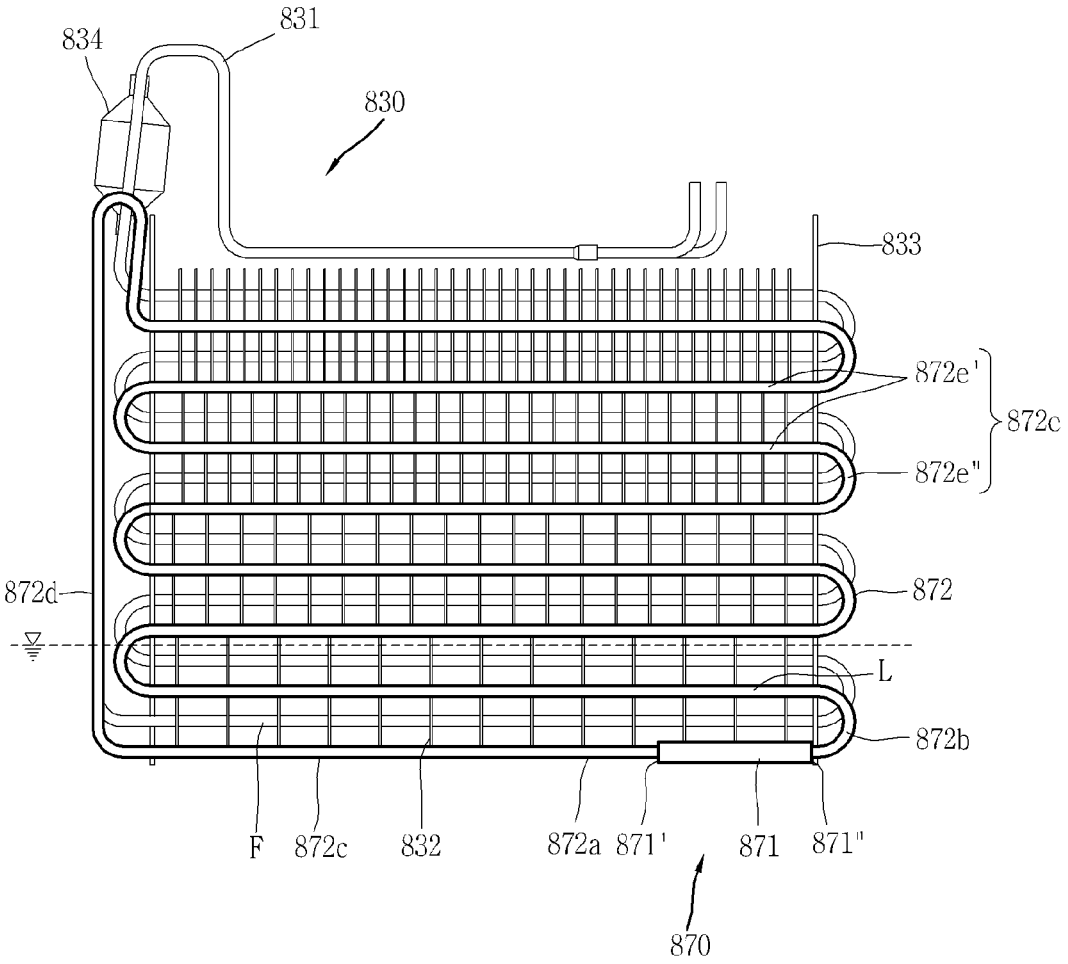

[Fig. 16]
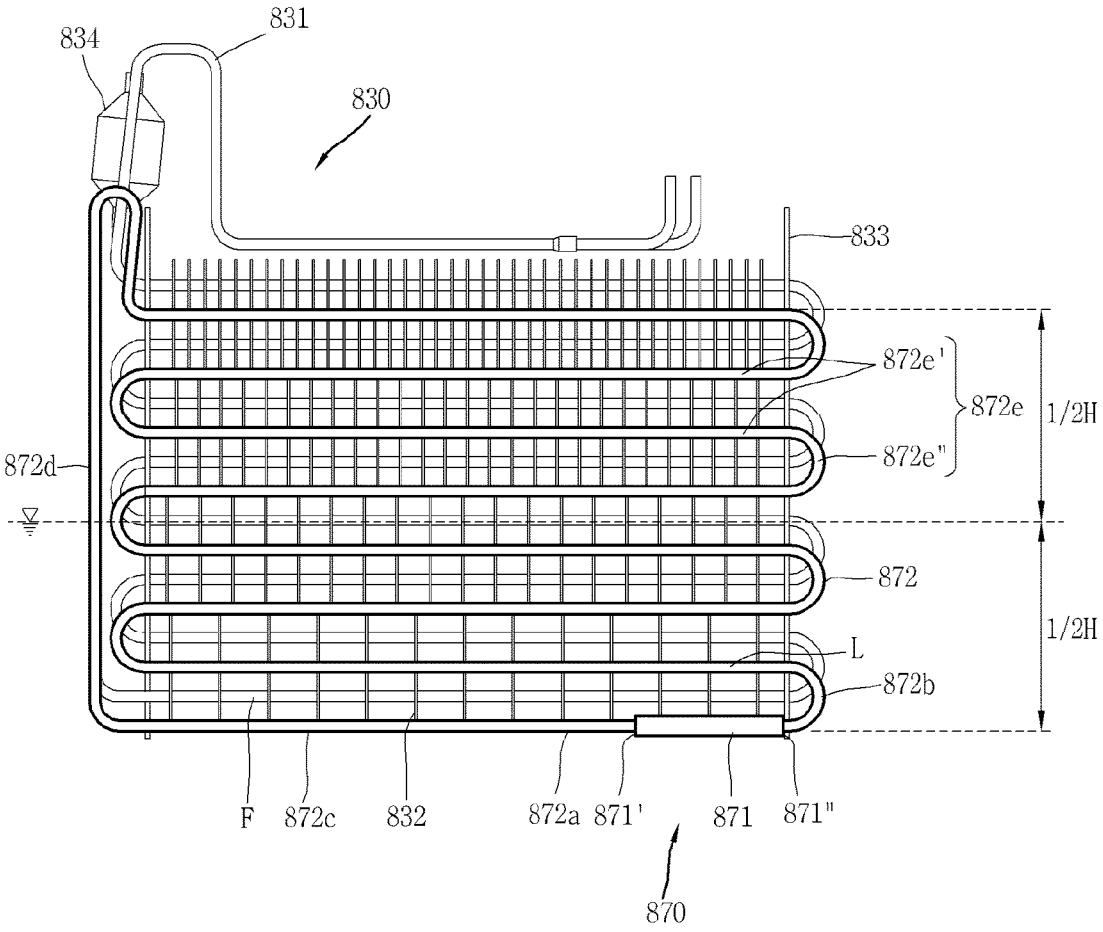

[Fig. 17]
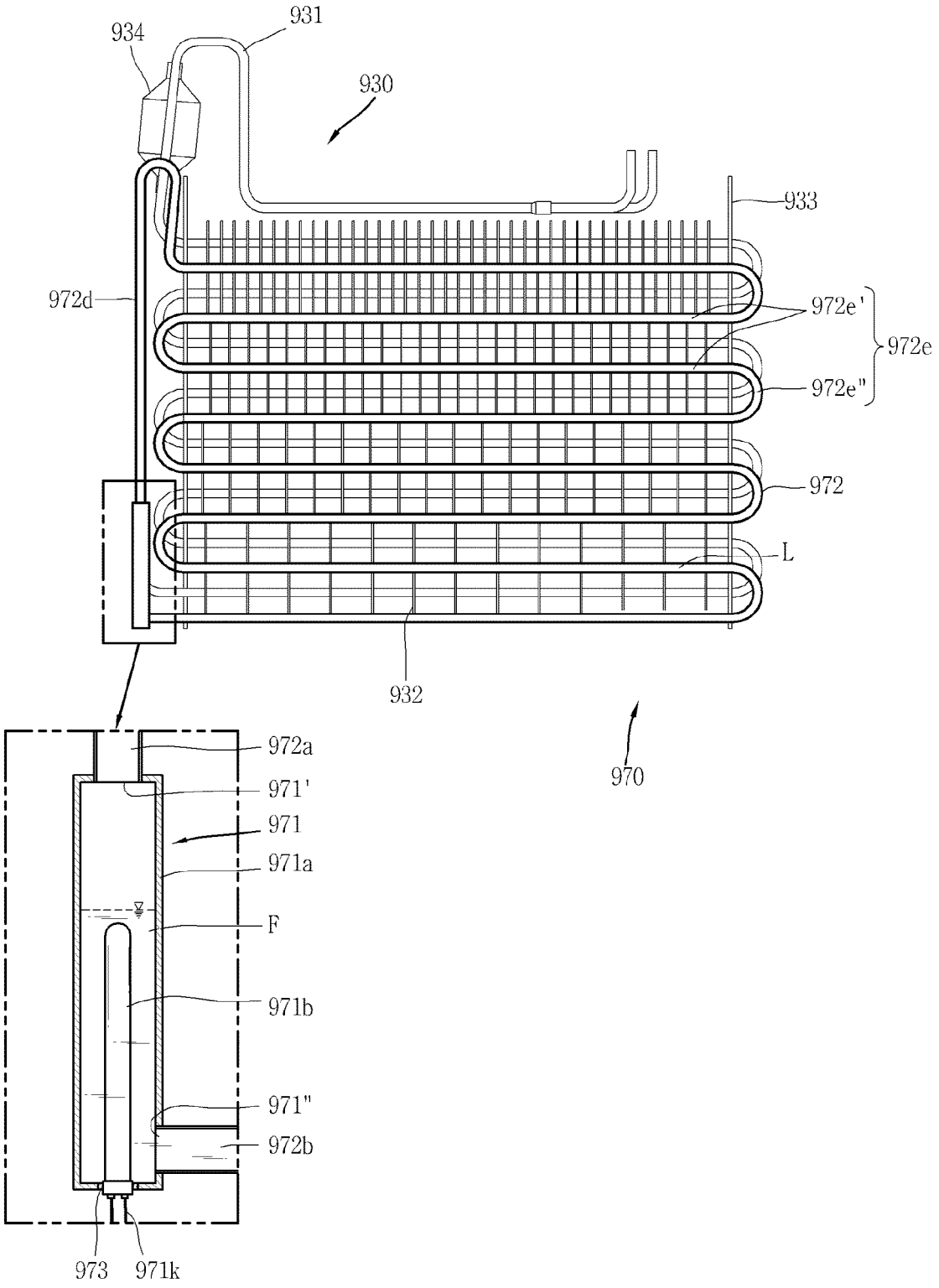

[Fig. 18]
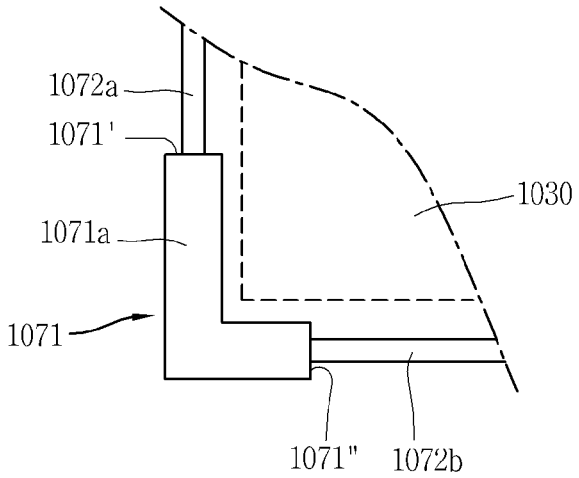
[Fig. 19]
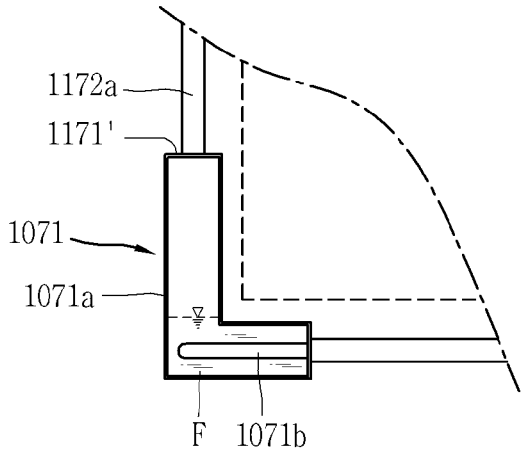

[Fig. 20]
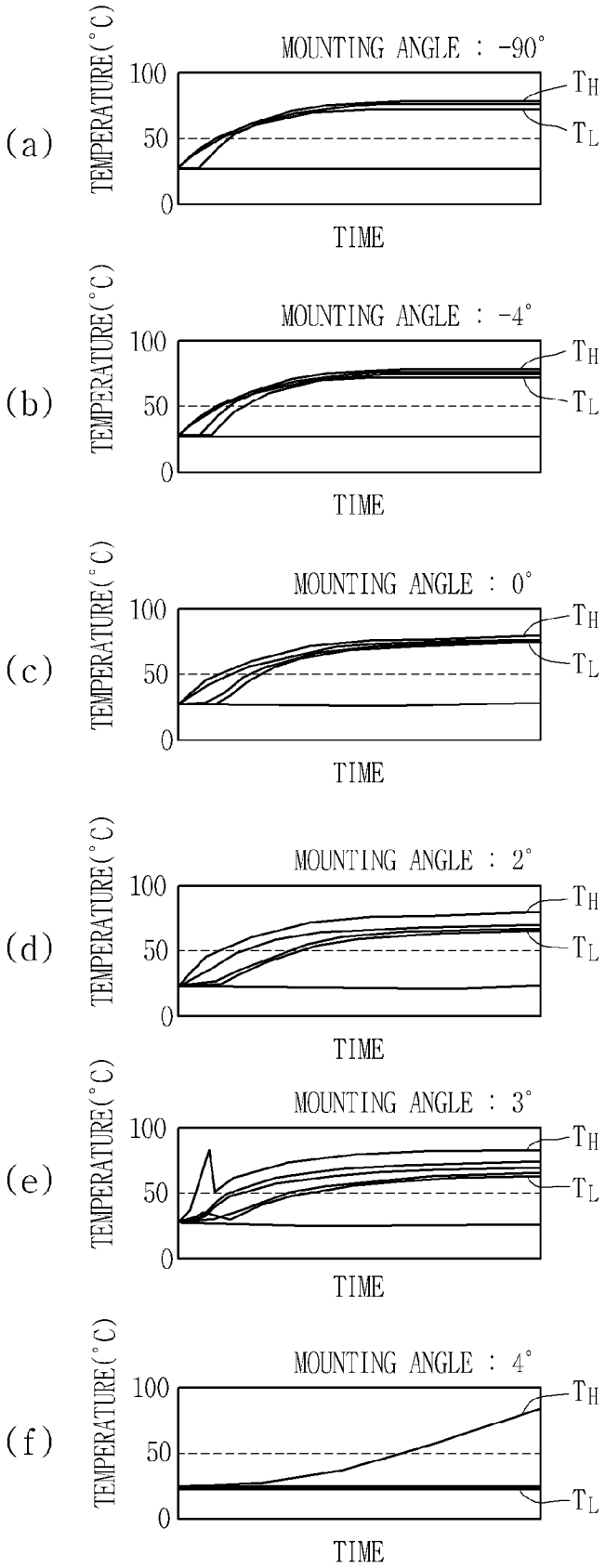

[Fig. 21]
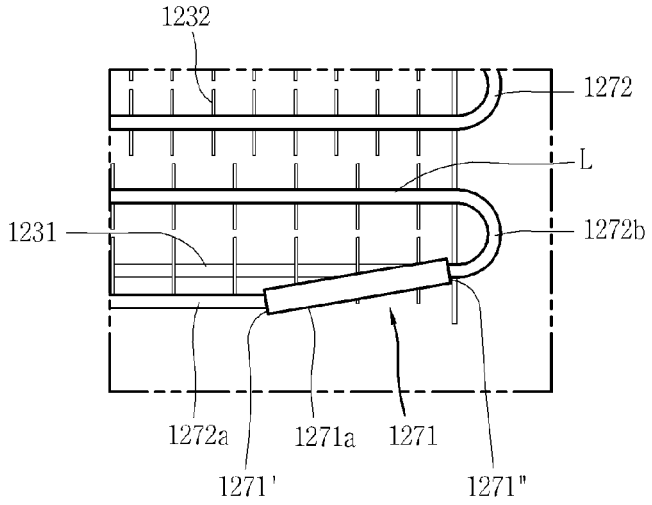
[Fig. 22]
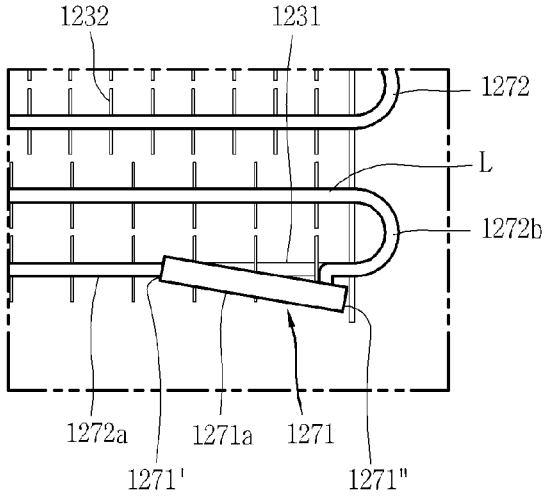
[Fig. 23]
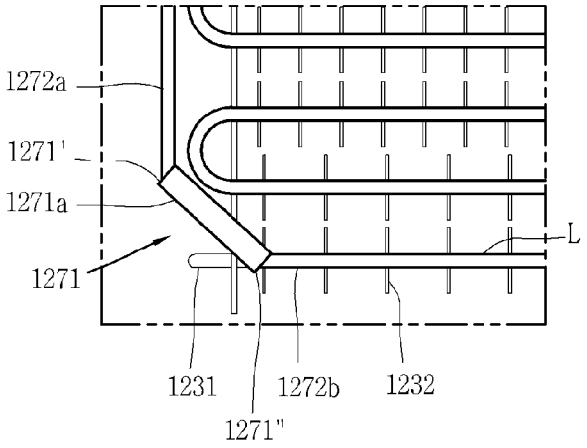

[Fig. 24]
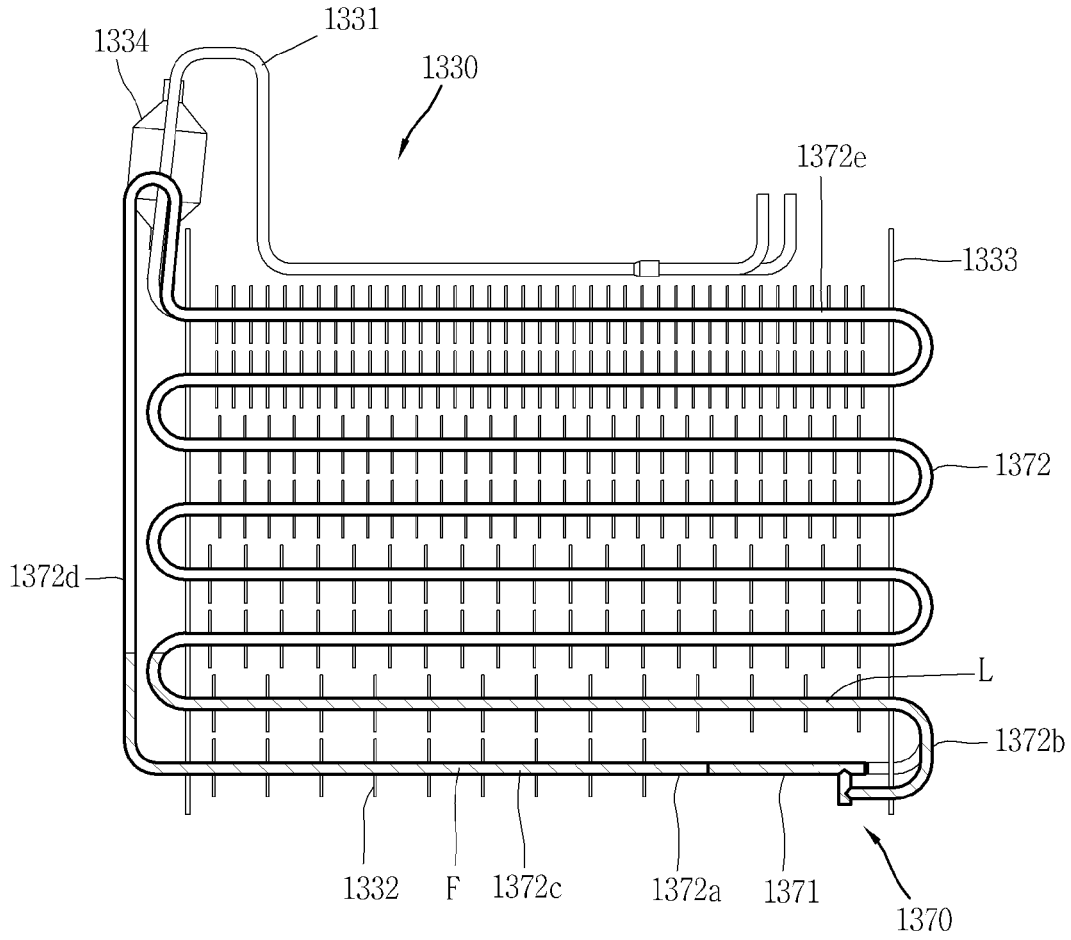

[Fig. 25]
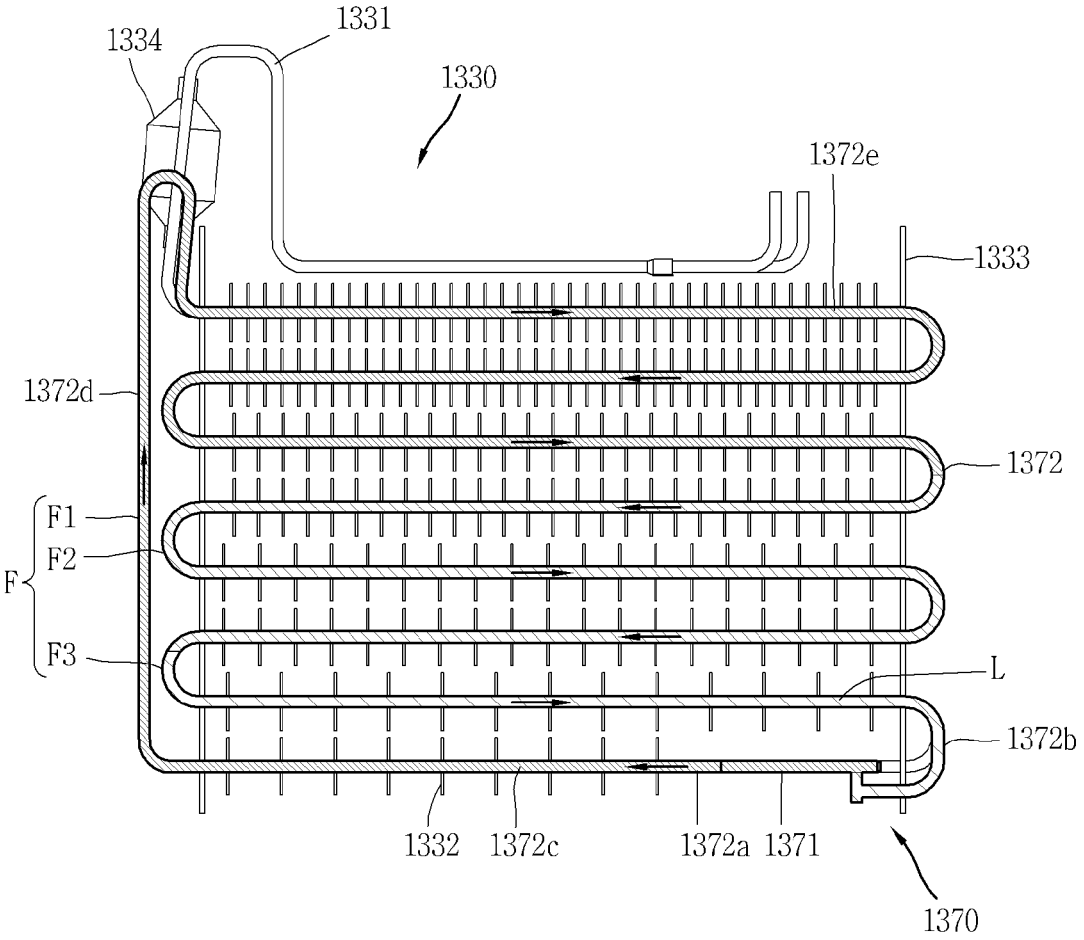

[Fig. 26]
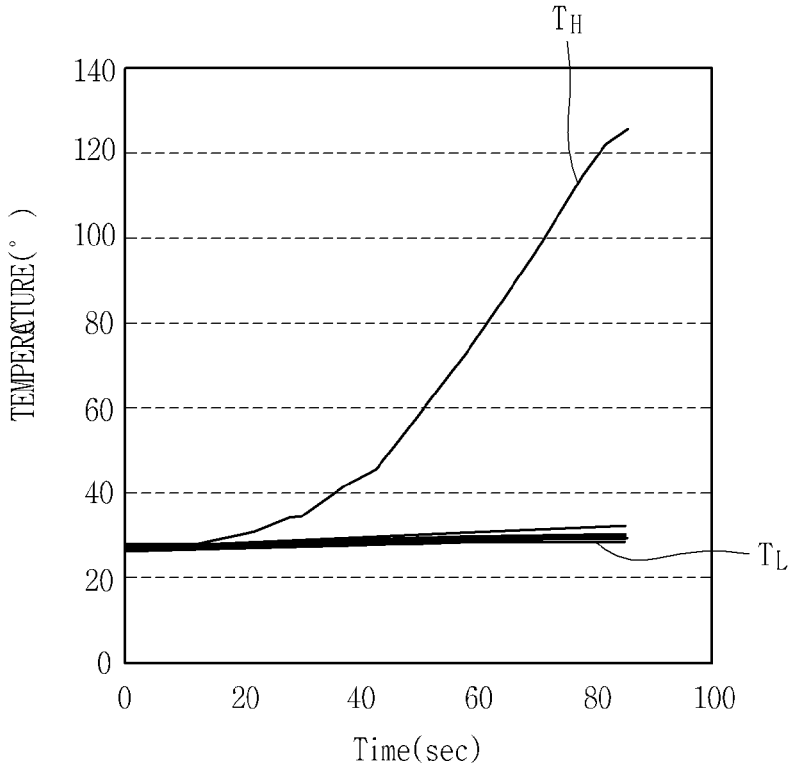
| Power | 120W |
|---|---|
| AMOUNT OF REFRIGERANT | 20% |

[Fig. 27]
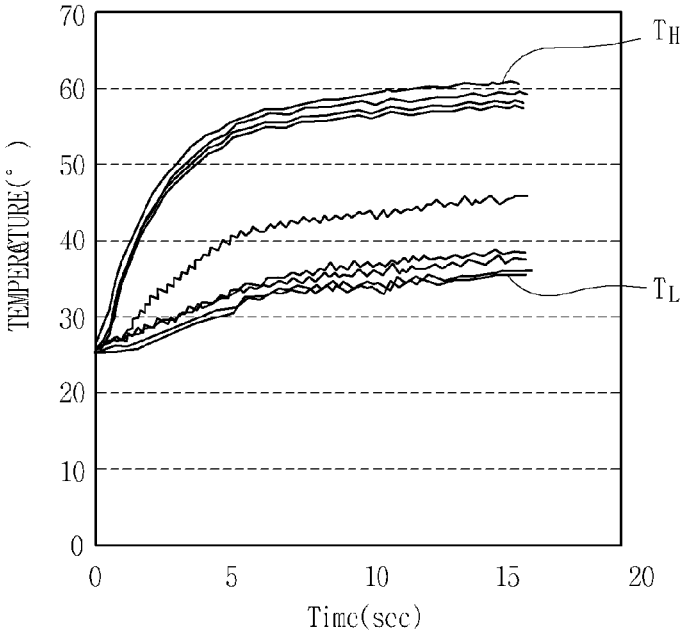
| Power | 120W |
|---|---|
| AMOUNT OF REFRIGERANT | 70% |
[Fig. 28]
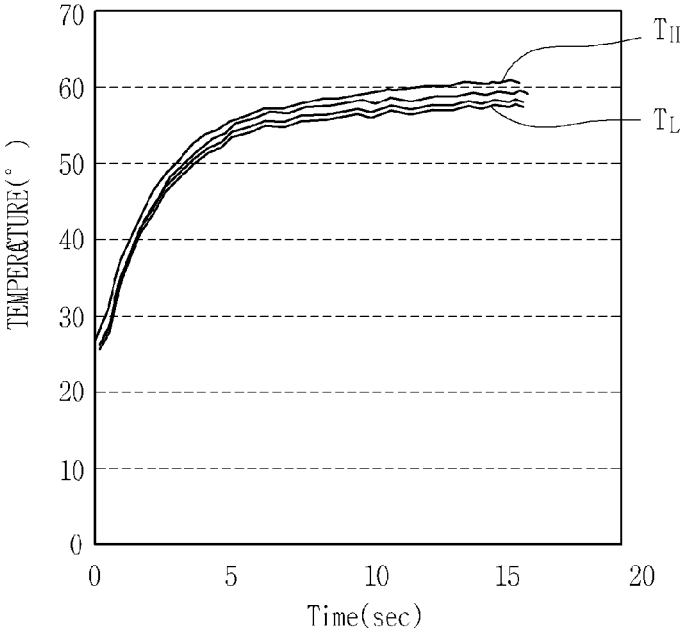
| Power | 120W |
|---|---|
| AMOUNT OF REFRIGERANT | 35% |

[Fig. 29]
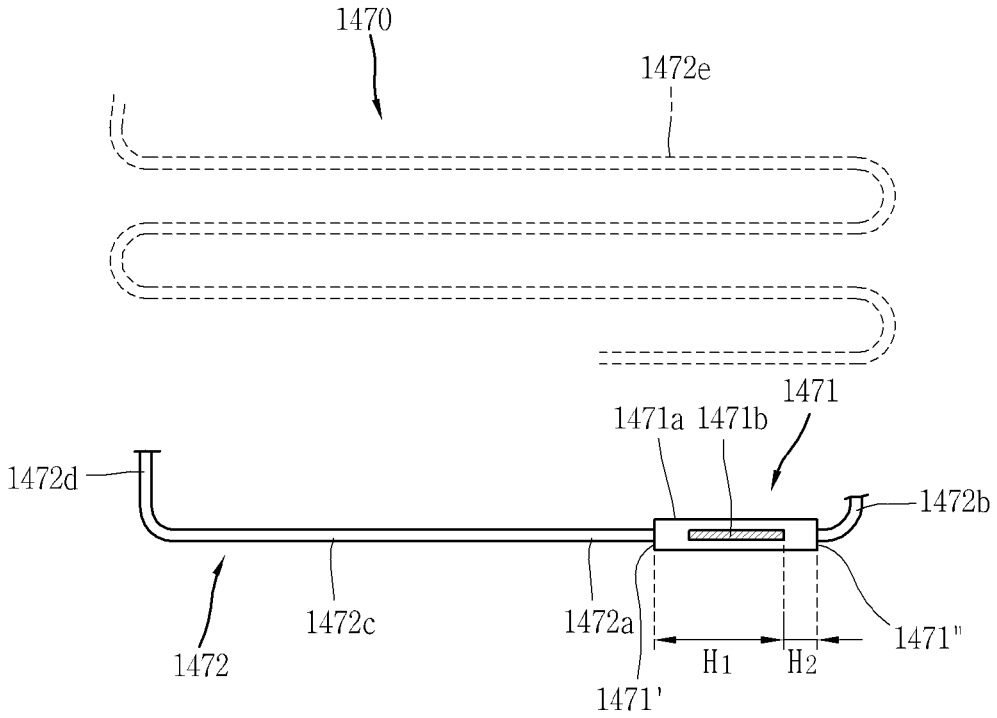
[Fig. 30]
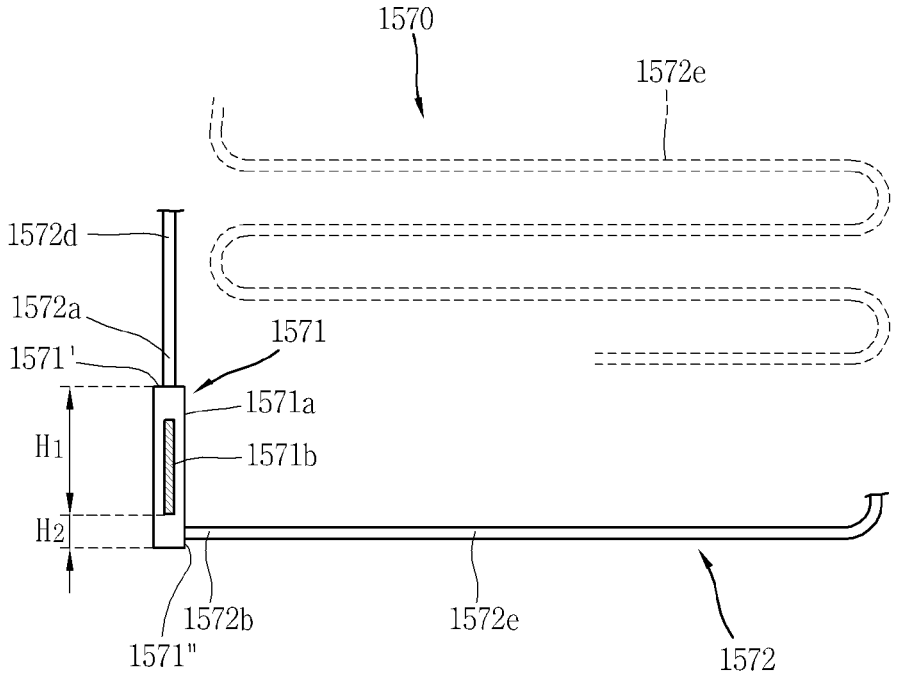

[Fig. 31]
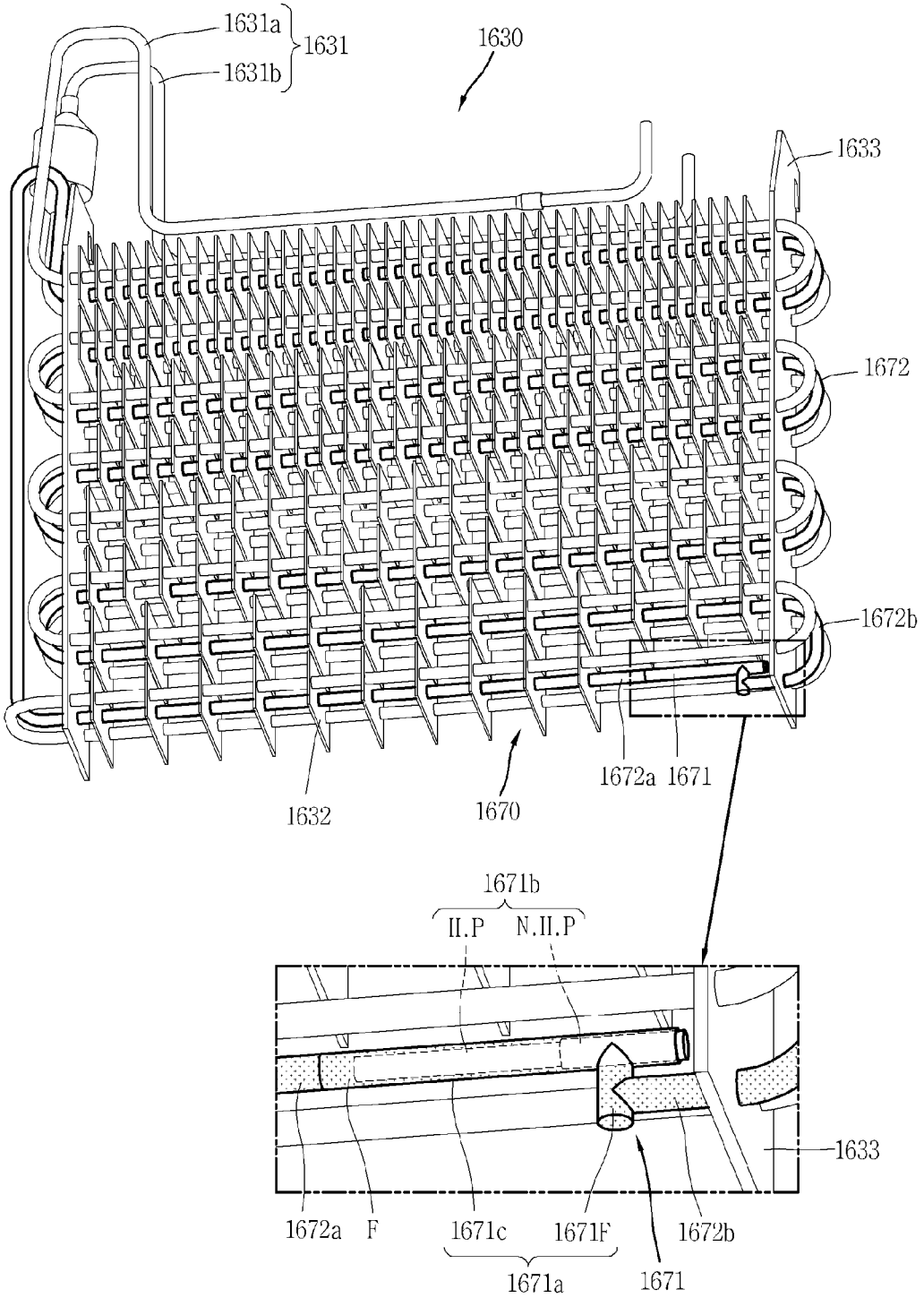

[Fig. 32]
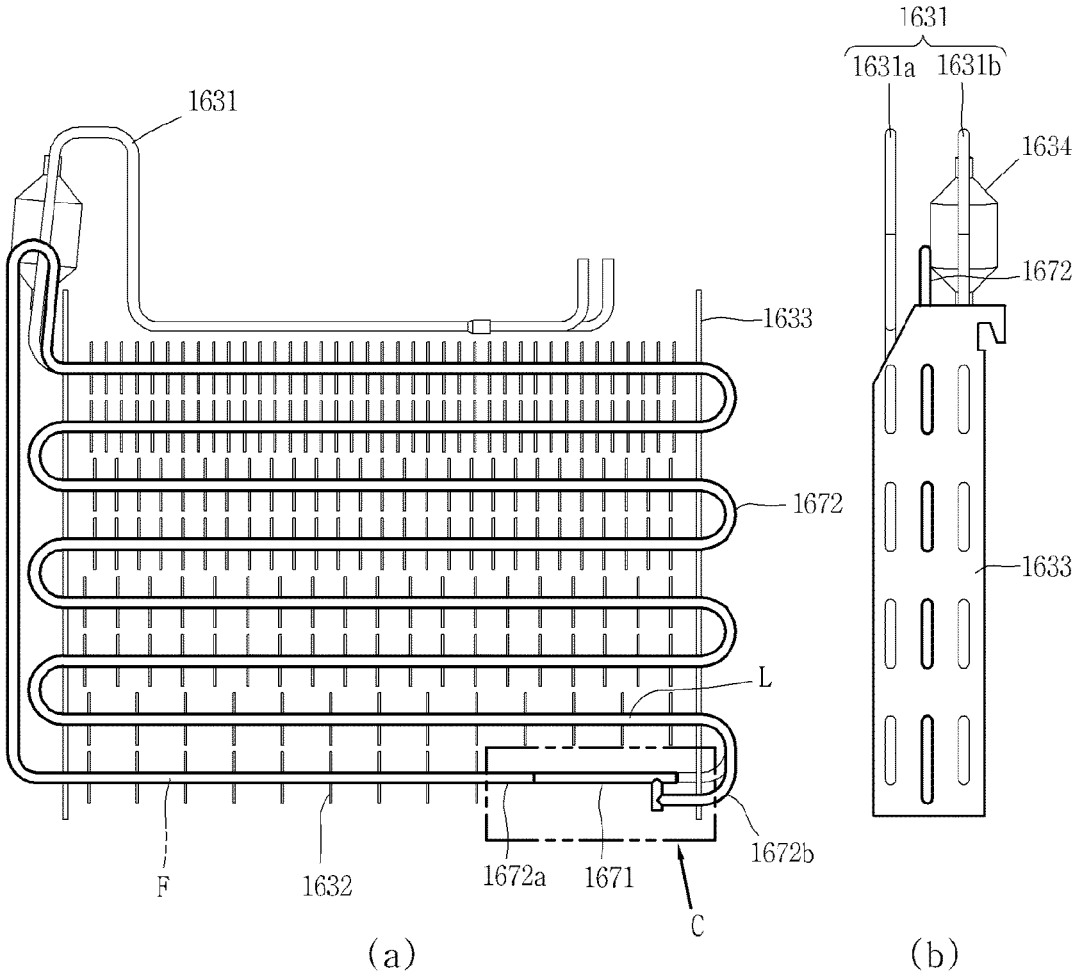
[Fig. 33]
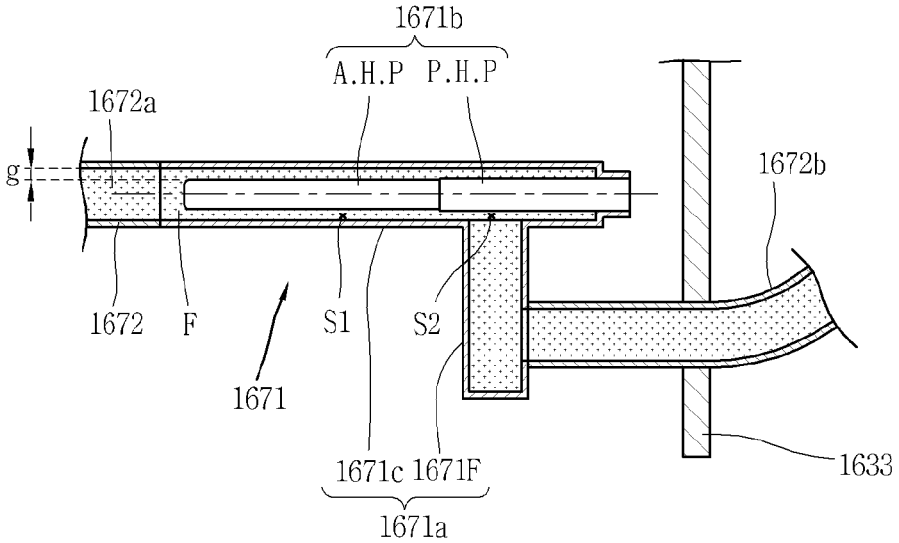

[Fig. 34]
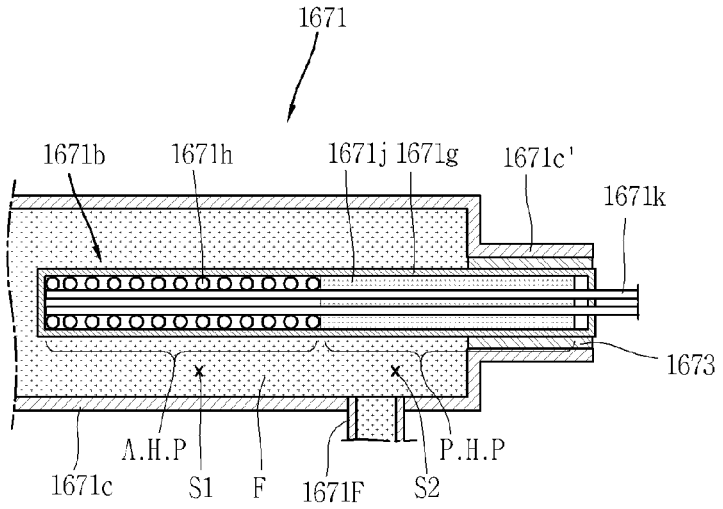
[Fig. 35]
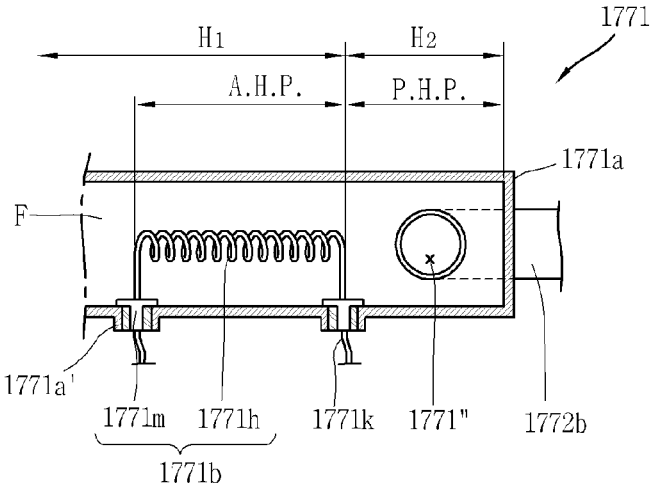
[Fig. 36]
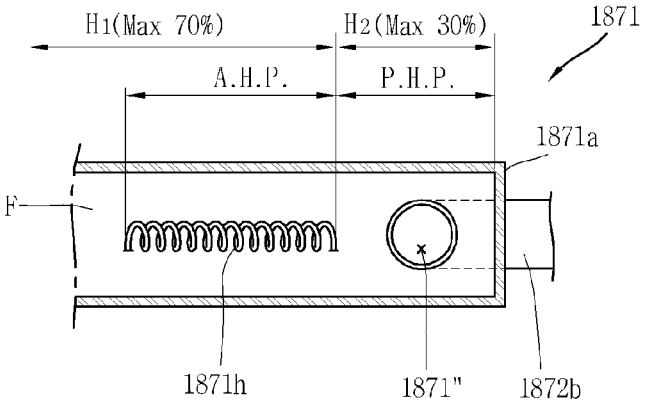

[Fig. 37]
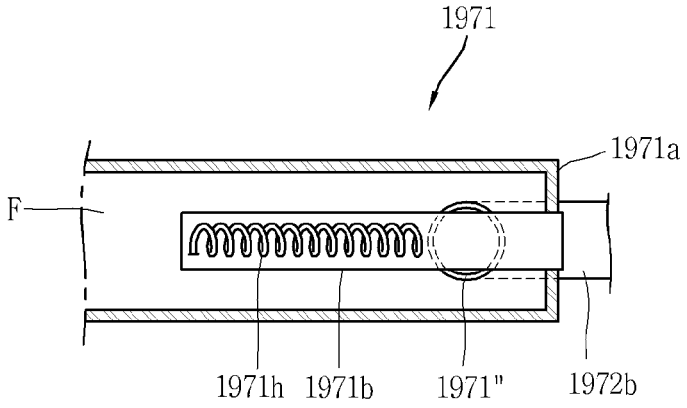
[Fig. 38]
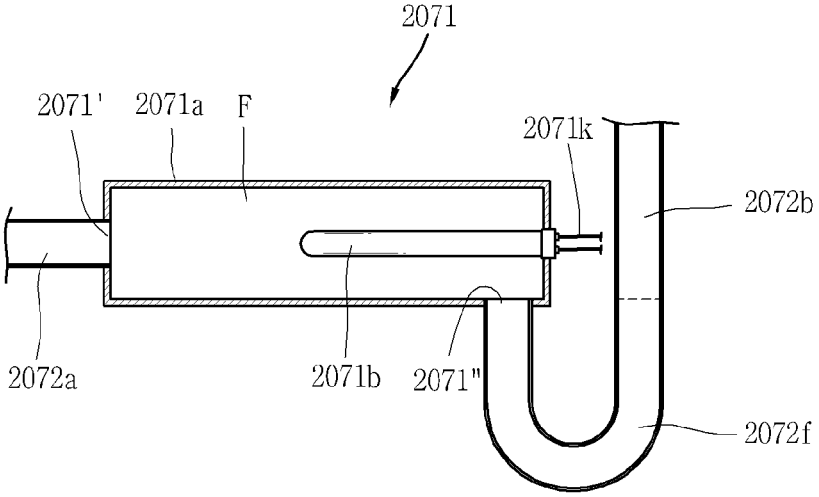
[Fig. 39]
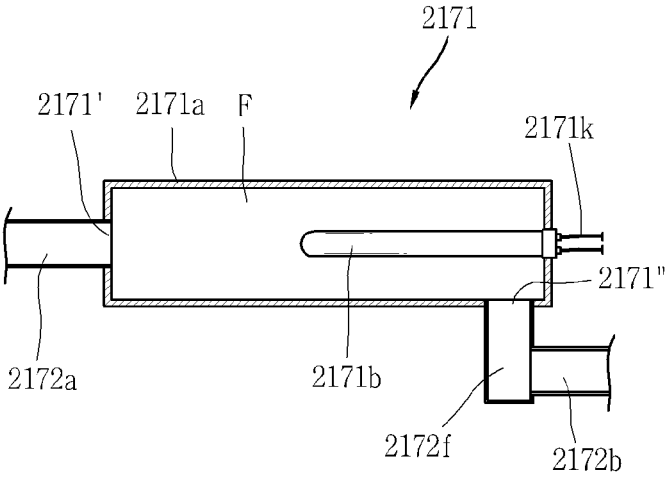

[Fig. 40]
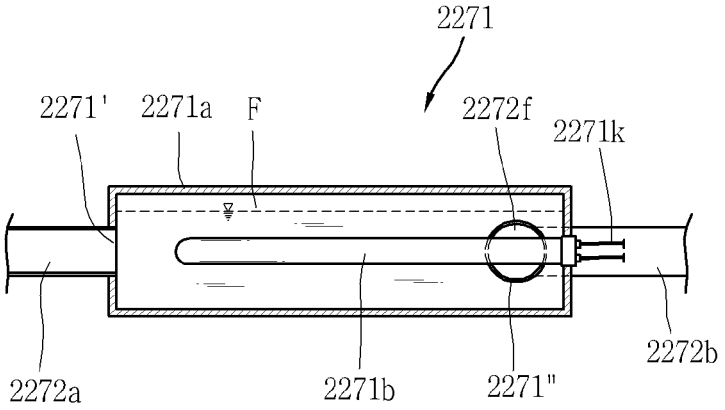
[Fig. 41]
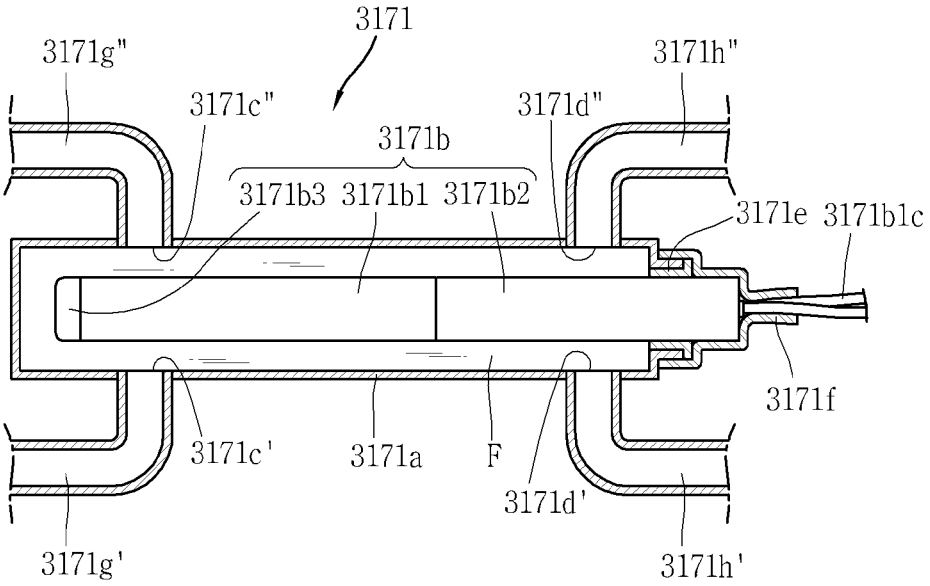
[Fig. 42]
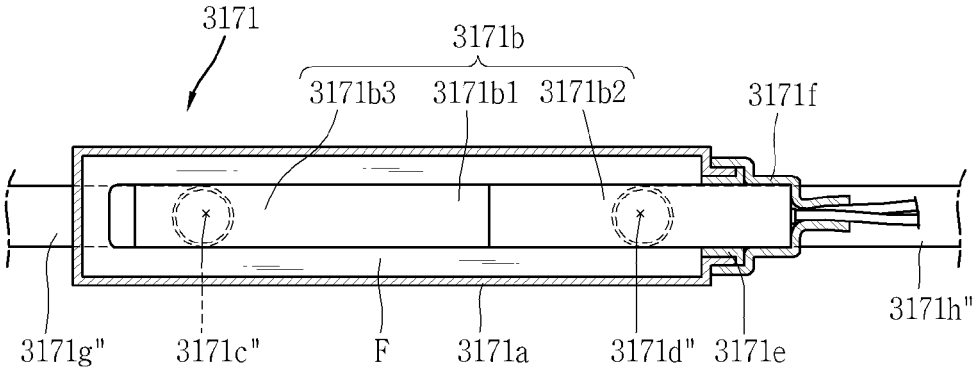

[Fig. 43]
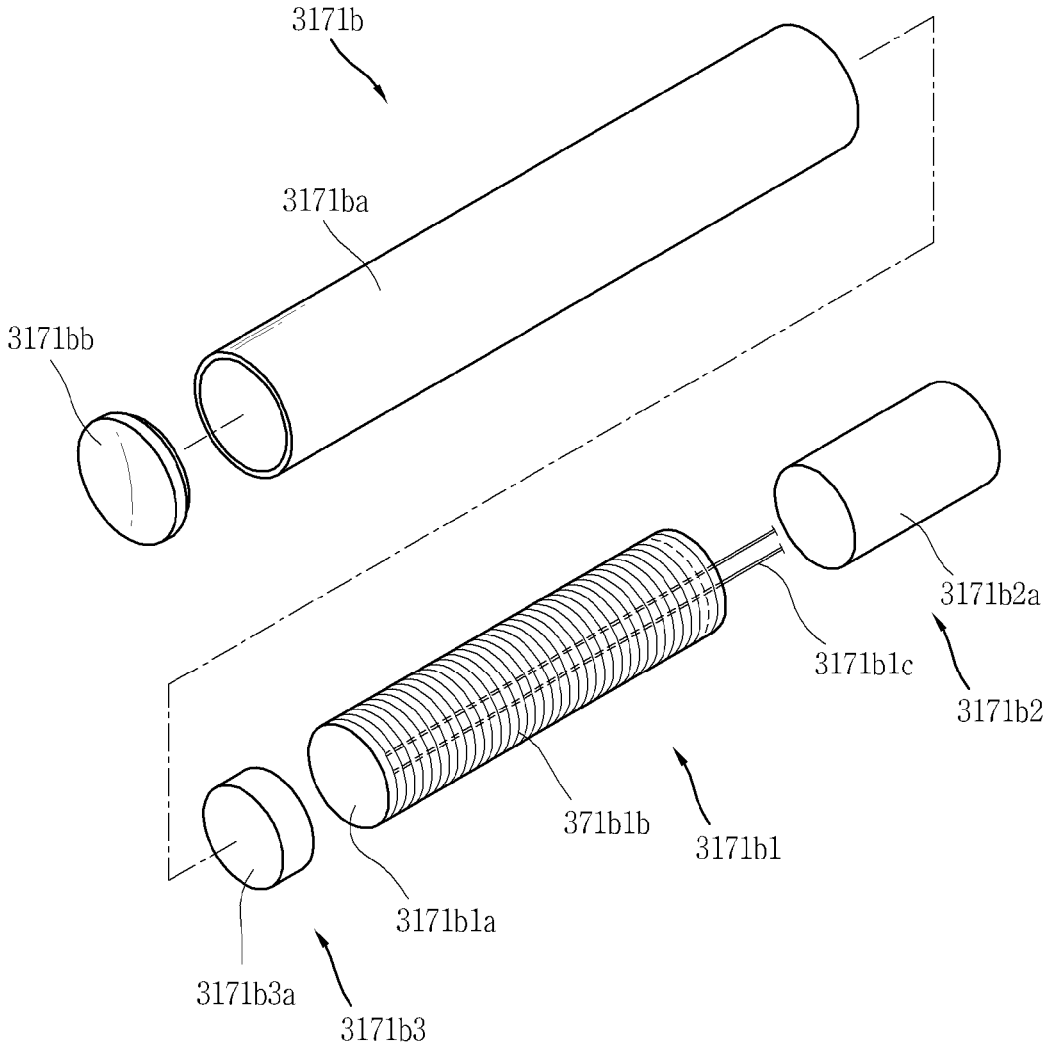

DEFROSTING DEVICE AND REFRIGERATOR HAVING THE SAME

CROSS REFERENCE TO RELATED APPLICATIONS

This application is a U.S. National Phase Application under 35 U.S.C. § 371 of International Application PCT/KR2015/011164, filed on Oct. 21, 2015, which claims the benefit of Korean Application No. 10-2014-0142753, filed on Oct. 21, 2014, Korean Application No. 10-2015-0115650, filed on Aug. 17, 2015, Korean Application No. 10-2015-0130506, filed on Sep. 15,2015, Korean Application No. 10-2015-0130510, filed on Sep. 15,2015, the entire contents of which are hereby incorporated by reference in their entireties.

TECHNICAL FIELD

The present disclosure relates to a defrosting device for removing frost formed on an evaporator provided in a refrigeration unit, and a refrigerator having the same.

BACKGROUND ART

An evaporator provided in a refrigeration unit can decrease ambient temperature using cool air generated by the circulation of coolant flowing through a cooling tube. During the cooling process, due to temperature difference with ambient air, moisture in the air may condense and freeze on a surface of the cooling tube. In some cases, an electric heater may be used to remove such frost formed on the evaporator.

In recent years, a defrosting device using a heat pipe has been developed and contrived, and the related technologies include Korean Patent Registration No. 10-0469322, entitled "Evaporator," Korean Patent Registration No. 10-1036685, entitled "Loop-shaped heat pipe using bubble jet," and Korean Patent Registration No. 10-1125827, entitled "Defrosting module to which loop-shaped heat pipe using bubble jet is applied."

However, the foregoing heat pipe type defrosting device has the following drawbacks.

According to a heat pipe type defrosting device in the related art, working fluid within an evaporating unit is filled only in a lower portion of the evaporating unit while the evaporating unit (or heating unit) is vertically or horizontally disposed, and thus the amount thereof is very small in a defrosting device applied to typical household refrigerators.

The use of small amount of working fluid can increase an evaporation rate due to rapid heating, but has a danger of overheating an electric heater provided in the evaporating unit when it is applied to a household refrigerator.

According to a heat pipe type defrosting device in the related art, both end portions of the condensing unit is configured at one side (or an upper portion) of the evaporating unit, and working fluid is filled and heated only in the other side (a lower portion) of the evaporating unit to generate high bubble propulsion. Therefore, it is possible to obtain flow such as vibration circulation within a heat pipe, but causes a problem of preventing the flow of vapor within the heat pipe from being circulated in one direction.

Though a heat pipe type defrosting device in the related art obtains high bubble propulsion, there is a problem in that efficient circulation flow is suppressed within the heat pipe.

Typically, a heat pipe type defrosting device may largely include an evaporating unit configured to heat liquid refrigerant, and a condensing unit having an entrance portion connected to one side of the evaporating unit to receive working fluid (including working fluid in the vapor phase heated at high temperatures or working fluid in the liquid phase at high temperatures) and a return portion connected to the other side of the evaporating unit to return working fluid again to the evaporating unit.

Here, in a structure in which working fluid is immediately collected to the side of an electric heater at high temperatures installed on an inner side of the evaporating unit or bubbles at temperatures generated by the heating of the electric heater returns to the location of propulsion, there may occur a case where the collected working fluid is reheated to flow back without being efficiently returned into the evaporating unit. It may cause a problem in that the circulation flow of working fluid within the heat pipe is suppressed to overheat the entire evaporating unit or heat pipe.

In such a structure in which the circulation flow of working fluid within the heat pipe is suppressed or a case where working fluid is collected again to the evaporating unit by the gravity of working fluid along an inner surface of the heat pipe constituting the condensing unit, when the condensing unit has a horizontal section, working fluid may remain without being efficiently circulated, thereby causing a problem in that the collection of working fluid is not effectively carried out.

In case where a heat pipe type defrosting device has a circulation structure using the vibration of working fluid, there is a problem in that it takes long time until the entire section of the heat pipe reaches a stable working temperature.

DISCLOSURE

Technical Problem

An object of the present disclosure is to provide a defrosting device capable of removing frost within a short period of time.

Another object of the present disclosure is to provide a defrosting device capable of enhancing heat exchange efficiency between the heat pipe and the evaporator.

Still another object of the present disclosure is to provide a new type of defrosting device capable of reducing power consumed during defrost.

Yet still another object of the present disclosure is to provide a defrosting device in which a heat pipe constituting the defrosting device can stably operate without being overheated.

Still yet another object of the present disclosure is to stably form circulation flow in which working fluid within a heat pipe constituting the defrosting device is transferred to the condensing unit from one side of the evaporating unit, and circulated again from the condensing unit to the other side of the evaporating unit.

Yet still another object of the present disclosure is to provide a heat pipe type defrosting device for not allowing working fluid transferred to the condensing unit from the evaporating unit to flow back to the condensing unit when returning again to the evaporating unit.

Still yet another object of the present disclosure is to provide a heat pipe type defrosting device capable of efficiently collecting working fluid without be remaining on hold even on a horizontal section of the heat pipe constituting the condensing unit.

Yet still another object of the present disclosure is to provide a heat pipe type defrosting device capable of stably securing continuous working fluid supply to the heat pipe.

Technical Solution

In order to accomplish the foregoing tasks of the present disclosure, a heat pipe type defrosting device according to one aspect includes a heating unit configured to be filled with a predetermined amount of working fluid, the heating unit including an active heating part configured to be heated to a first temperature that can evaporate the working fluid, and a passive heating part positioned at a rear side of the active heating part and configured to be heated to a second temperature that is lower than the first temperature and at which the evaporation of the working fluid does not occur. The defrosting device also includes a heat pipe configured to be disposed adjacent to an evaporator to transfer heat to the evaporator while circulating working fluid heated by the active heating part, the heat pipe including an entrance portion configured to receive working fluid evaporated by the active heating part, and a return portion connected adjacent to the passive heating part and configured to receive working fluid that has condensed after circulating through the heat pipe. The condensed working fluid received at the heating unit through the return portion first passes through the passive heating part before being reheated at the active heating part.

Implementations according to this aspect may include one or more of the following features. For example, the heating unit may include a heater case connected to the entrance portion and the return portion of the heat pipe, respectively, and a heater installed within the heater case, at least a portion of the heater being configured to generate heat. A first side of the heater may be disposed adjacent to the entrance portion of the heat pipe is part of the active heating part, and a second side of the heater opposite the first side that is disposed adjacent to the return portion of the heat pipe may be part of the passive heating part. The active heating part and the passive heating part may extend along a length direction of the heater case. The passive heating part may include a first passive heating part and a second heating part between which the active heating part is interposed. At least a portion of the passive heating part may extend to an outside of the heater case.

In some implementations, the heater may include a body portion extended along one direction, and a coil portion disposed on a portion of the body portion and connected to a power unit to generate heat based on power application, wherein a portion of the heater corresponding to the coil portion may be a part of the active heating part and a portion of the heater in which the coil portion is not formed may be part of the passive heating part. An insulation material may be filled into a portion of the heater in which the coil portion is not formed on the body portion. The heater case may define an insertion portion through which a rear end portion of the passive heating part of the heater is inserted to thereby expose the power unit to an outside of the heating unit through the rear end portion of the heater, and a sealing portion configured to restrict the leakage of working fluid may be provided between the rear end portion of the heater and the insertion portion. The active heating part may include the heater, and the passive heating part may include a vacant space that is defined between the heater and the return portion. The heater case may include a main case portion connected to the entrance portion of the heat pipe, and provided with the active heating part and the passive heating part, and a buffer portion extended from an outer circumference of the main case portion and configured to provide fluidic communication between the return portion of the heat pipe and the main case portion to thereby receive condensed working fluid at the passive heating part.

In some cases, the entrance portion of the heat pipe may be disposed at a location vertically the same as or lower than the lowest row of a cooling tube of the evaporator. The lowest row of the cooling tube may be extended along a horizontal direction of the evaporator, and the entrance portion of the heat pipe may be extended along a horizontal direction corresponding to an extension direction of the lowest row of the cooling tube. The heating unit may be disposed at a lower end portion of the evaporator and configured to increase heat transfer to the lowest column of the cooling tube. The heat pipe may pass through a plurality of cooling fins that are mounted to the cooling tube. The heat pipe may be accommodated between a plurality of cooling fins mounted at each row of the cooling tube. Approximately 30 to 50% of working fluid compared to the total volume of the heat pipe and the heater case may be filled into the heat pipe. The heating unit may be disposed at an angle of −90° to 2° with respect to a central axis of the entrance portion to thereby facilitate the flow of the working fluid.

According to another aspect, a refrigerator includes a refrigerator body, an evaporator installed on the refrigerator body and configured to absorb ambient evaporation heat to cool a fluid within the evaporator, and a defrosting device configured to remove frost formed on the evaporator according to implementations described with respect to the previous aspect of the disclosure.

Implementations according to this aspect may include one or more of the following features. For example, the evaporator may include a cooling tube repeatedly bent in a zigzag shape to form a plurality of vertically spaced apart rows, a plurality of cooling fins fixed to the cooling tube and disposed to be separated at predetermined intervals along an extension direction of the cooling tube, and a plurality of support fixtures configured to support both end portions of each horizontal row of the cooling tube. The cooling tube may include a first cooling tube and a second cooling tube formed at a front portion and a rear portion thereof, respectively, to form two rows, and the heat pipe may be disposed between the first cooling tube and the second cooling tube. The heat pipe may be extended and branched from the heating unit, and the heat pipe may include a first heat pipe and a second heat pipe that are disposed next to each other to interpose the cooling tube therebetween. The heat pipe may be repeatedly bent in a zigzag shape to form a plurality of horizontal rows, and a distance between each row disposed at a lower portion of the heat pipe may be less than that between each row disposed at an upper portion of the heat pipe.

According to another aspect, a defrosting device includes an evaporation unit configured to heat working fluid therein, and a condensing unit connected to both sides of the evaporating unit to transfer evaporated working fluid and collect condensed working fluid. The evaporating unit includes a heater disposed in a length direction of the evaporating unit within the evaporating unit, an outlet connected to one side of the condensing unit to transfer working fluid heated on the evaporating unit to the condensing unit, and an inlet connected to the other side of the condensing unit to return working fluid that has circulated the condensing unit. Based on the working fluid being in the liquid phase, the working fluid fills the evaporating unit such that the heater is submerged in the working fluid.

Implementations according to this aspect may include one or more of the following features. For example, the condensing unit may include an entrance portion connected to an outlet of the evaporating unit to receive working fluid at the condensing unit from the evaporating unit, and a return portion connected to an inlet of the evaporating unit to collect the working fluid of the condensing unit to the evaporating unit. Based on the working fluid being in the liquid phase, the working fluid may fill a part of the entrance portion and a part of the return portion. The evaporating unit may be disposed in a horizontal direction, and at least one of the entrance portion and the return portion may be in a horizontal direction at a location adjacent to the evaporating unit. Based on the working fluid being in the liquid phase, the working fluid may fill a part of the evaporating unit that is extended in a horizontal direction from at least one of the entrance portion and the return portion. The return portion may further include a buffer portion vertically connecting the return portion and the inlet of the evaporator. The diameter of the buffer portion may be larger than that of the return portion.

According to another aspect, a defrosting device includes an evaporating unit configured to heat working fluid therein, and a condensing unit, both ends of which are connected to the evaporating unit to form a passage such that working fluid heated in the evaporating unit is circulated and returned again to the evaporating unit. The evaporating unit includes a higher temperature portion and a lower temperature portion. One side of the condensing unit is connected to the higher temperature portion of the evaporating unit, and the other side of the condensing unit is connected to the lower temperature portion of the evaporating unit. The higher temperature portion of the evaporating unit includes an active heating part configured to generate heat, and the lower temperature portion of the evaporating unit is configured stay below a temperature that evaporates the working fluid.

Implementations according to this aspect may include one or more of the following features. For example, the active heating part may include a heater that is installed adjacent to the outlet within the evaporating unit to thereby form the higher temperature portion adjacent to the outlet, and the heater may not be disposed adjacent to the inlet to thereby form the lower temperature portion adjacent to the inlet. An inlet configured to collect cooled working fluid from the condensing unit, a lower temperature portion heated at low temperatures at which the evaporation of working fluid does not occur, a higher temperature portion heated at high temperatures to evaporate working fluid, and an outlet configured to discharge working fluid heated for the transfer to the condensing unit may be sequentially located on the evaporating unit.

According to another aspect, a defrosting device includes an evaporating unit configured to heat working fluid therein, and a condensing unit connected to both sides of the evaporating unit to transfer evaporated working fluid and collect condensed working fluid. The evaporating unit includes a heater disposed in a length direction of the evaporating unit within the evaporating unit, an outlet connected to one side of the condensing unit to transfer working fluid heated on the evaporating unit to the condensing unit, and an inlet connected to the other side of the condensing unit to return working fluid that has circulated the condensing unit. The condensing unit includes an entrance portion connected to an outlet of the evaporating unit to receive working fluid at the condensing unit from the evaporating unit, and a return portion connected to an inlet of the evaporating unit to collect the working fluid of the condensing unit to the evaporating unit. A buffer portion is provided between the inlet and the return portion to communicate the inlet and the return portion so as to switch the direction of working fluid at least once to collect working fluid to the evaporating unit.

Implementations according to this aspect may include one or more of the following features. For example, the buffer portion may include at least one bent portion. The buffer portion may be configured to vertically connect the return portion and the evaporating unit that are both disposed in a horizontal direction. The buffer portion may have a larger diameter than that of the return portion.

DESCRIPTION OF DRAWINGS

FIG. 1 is a longitudinal cross-sectional view of an example refrigerator;

FIG. 2 is a schematic view of an example defrosting device;

FIG. 3 is an enlarged partial cross-sectional view of portion "A" in FIG. 2;

FIG. 4 is a perspective view of the example defrosting device shown in FIG. 2;

FIG. 5 is an enlarged view of portion "B" in FIG. 4;

FIGS. 6-9 are schematic and partial cross-sectional views illustrating example variations of the defrosting device shown in FIG. 2;

FIGS. 10-12 are schematic views illustrating further example variations of the defrosting device shown in FIG. 2;

FIG. 13 is a partial cross-sectional view of an example heating unit portion of a defrosting device;

FIGS. 14-16 are schematic views illustrating various example filling heights of working fluid within a defrosting device;

FIG. 17 is a schematic view illustrating an example defrosting device having a vertically disposed heating unit;

FIGS. 18 and 19 are schematic views illustrating modified examples of the heating unit shown in FIG. 17;

FIG. 20(*a*)-(*f*) are graphs illustrating a temperature change of each column of the heating unit and heat pipe according to an angle at which the side of an outlet of heating unit is inclined with respect to the side of its inlet;

FIG. 21 is a schematic view illustrating an example configuration of a horizontally disposed heating unit in which the outlet side is inclined downward relative to the inlet side;

FIG. 22 is a schematic view illustrating another example configuration of a horizontally disposed heating unit in which the outlet side of the outlet is inclined upward to the inlet side;

FIG. 23 is a schematic view illustrating another example configuration of the heating unit;

FIGS. 24 and 25 are schematic views illustrating the circulation of working fluid prior to and subsequent to the operation of the heating unit;

FIGS. 26-28 are graphs explaining examples of an appropriate amount of working fluid;

FIGS. 29 and 30 are schematic views illustrating example devices having a heating unit that is horizontally and vertically arranged, respectively;

FIG. 31 is a perspective view illustrating another example of a defrosting device;

FIGS. 32(*a*) and (*b*) are front and side views, respectively, of the example defrosting device illustrated in FIG. 31;

FIGS. 33 and 34 are enlarged views of portion "C" of FIG. 32;

FIG. 35 is a conceptual view illustrating another example of a heating unit, FIGS. 36 and 37 are partial cross-sectional views of different examples of a heating unit;

FIGS. 38-40 are partial cross-sectional views illustrating different examples of a defrosting device including a buffer portion;

FIGS. 41 and 42 are partial cross-sectional views of another example heating unit; and FIG. 43 is an exploded perspective view of an example heater.

BEST MODE

FIG. 1 is a longitudinal cross-sectional view schematically illustrating the configuration of an example refrigerator 100.

The refrigerator 100 is a device for storing foods kept therein at low temperatures using cooling air generated by a refrigeration unit in which the processes of compression-condensation-expansion-evaporation are sequentially carried out.

As illustrated in the drawing, a refrigerator body 110 may include a storage space for storing foods therein. The storage space may be separated by a partition wall 111, and divided into a refrigerating chamber 112 and a freezing chamber 113 according to the set temperature.

While a top mount type refrigerator in which the freezing chamber 113 is disposed on the refrigerating chamber 112 is shown, various types of refrigerators may be used. For example, the present disclosure may be applicable to a side by side type refrigerator in which the refrigerating chamber and freezing chamber are horizontally disposed, a bottom freezer type refrigerator in which the refrigerating chamber is provided at the top and the freezing chamber is provided at the bottom, and the like.

A door is connected to the refrigerator body 110 to open or close a front opening portion of the refrigerator body 110. FIG. 1 shows that a refrigerating chamber door 114 and a freezing chamber door 115 are configured to open or close a front portion of the refrigerating chamber 112 and freezing chamber 113, respectively. The door may be configured in various ways, such as a rotation type door in which a door is rotatably connected to the refrigerator body 110, a drawer type door in which a door is slidably connected to the refrigerator body 110, and the like.

The refrigerator body 110 may include at least one of accommodation units 180 (for example, a shelf 181, a tray 182, a basket 183, etc.) for effectively using an internal storage space. For example, the shelf 181 and tray 182 may be installed within the refrigerator body 110, and the basket 183 may be installed at an inside of the door 114 connected to the refrigerator body 110.

In some cases, a cooling chamber 116 having an evaporator 130 and a blower fan 140 is provided at a rear side of the freezing chamber 113. A refrigerating chamber return duct 111*a* and a freezing chamber return duct 111*b* for inhaling and returning the air of the refrigerating chamber 112 and freezing chamber 113 to the side of the cooling chamber 116 may be formed on the partition wall 111. Furthermore, a cool air duct 150 communicating with the freezing chamber 113 and having a plurality of cool air discharge ports 150*a* on a front portion thereof may be installed at a rear side of the refrigerating chamber 112.

A machine room 117 may be provided at a lower rear side of the refrigerator body 110, and a compressor 160, a condenser and the like may be provided within the machine room 117.

The process of inhaling the air of the refrigerating chamber 112 and freezing chamber 113 to the cooling chamber 116 through the refrigerating chamber return duct 111*a* and freezing chamber return duct 111*b* of the partition wall 111 by the blower fan 140 of the cooling chamber 116 to perform heat exchange with the evaporator 130 can take place. Subsequently discharging the air to the refrigerating chamber 112 and freezing chamber 113 through the cool air discharge ports 150*a* of the cool air duct 150 again can be carried out repeatedly. At this time, frost may be formed on a surface of the evaporator 130 due to a temperature difference with circulation air that is reintroduced through the refrigerating chamber return duct 111*a* and the freezing chamber return duct 111*b*.

As such, a defrosting device 170 may be provided in the evaporator 130 to remove such frost, and water removed by the defrosting device 170, namely, defrost water, may be collected to a lower defrost water tray of the refrigerator body 110 through a defrost water discharge pipe 118.

Hereinafter, the defrosting device 170 capable of reducing power consumption and enhancing heat exchange efficiency during defrost will be described.

Referring to FIGS. 2 and 3, the evaporator 130 may include a cooling tube 131 (i.e., cooling pipe), a plurality of cooling fins 132, and a plurality of support fixtures 133.

The cooling tube 131 may repeatedly bent in a zigzag shape to form a plurality of columns, and a refrigerant can be filled therein. The cooling tube 131 may be configured in combination with horizontal pipe portions and bending pipe portions. The horizontal pipe portions are horizontally disposed relative to each other in a vertical direction, and configured to pass through the cooling fins 132, and the bending pipe portions connect an end portion of an upper horizontal pipe portion to an end portion of a lower horizontal pipe portion to communicate their inner portions with each other.

In some cases, the cooling tube 131 may include a plurality of rows that extend in a forward and backward direction.

In FIG. 2, a heat pipe 172 which will be described below, has a shape corresponding to the cooling tube 131, and thus part of the cooling tube 131 is hidden by the heat pipe 172.

For the cooling tube 131, a plurality of cooling fins 132 may be disposed to be separated at predetermined intervals along an extension direction of the cooling tube 131. The cooling fin 132 may be formed with a flat body made of an aluminum material, and the cooling tube 131 may be flared in a state of being inserted into an insertion hole of the cooling fin 132, and securely inserted into the insertion hole.

A plurality of support fixtures 133 may be provided at both sides of the evaporator 130, respectively, and each of which is extended in a forward and backward direction to support a bent end portion of the cooling tube 131.

The defrosting device 170 may be configured to remove frost generated from the evaporator 130, and installed on the evaporator 130 as illustrated in the drawing. The defrosting device 170 may include a heating unit 171 and a heat pipe 172 (i.e., heat transfer tube).

The heating unit 171 may be electrically connected to a controller and designed to generate heat upon receiving an operation signal from the controller. For example, the controller may be configured to apply an operation signal to the heating unit 171 for each predetermined time interval or apply an operation signal to the heating unit 171 when the sensed temperature of the cooling chamber 116 is less than a predetermined temperature.

Referring to FIG. 3, the heating unit 171 includes a heater case 171*a* and a heater 171*b*.

The heater case 171*a* may be extended in one direction, and configured to accommodate the heater 171*b* therein. The heater case 171*a* may be formed in a cylindrical or rectangular pillar shape, among others.

The heater case 171*a* is connected to an entrance portion 172*a* and a return portion 172*b* of the heat pipe 172, respectively. Accordingly, the heater case 171*a* fluidically connects the entrance portion 172*a* to return portion 172*b* to form a passage through which working fluid (F) coming from the return portion 172*b* is introduced into the entrance portion 172*a*.

In some cases, an outlet 171' that communicates with the entrance portion 172*a* may be formed at one side of the heater case 171*a*. For example, a first sidewall of the heater case 171*a* adjacent to the entrance portion 172*a*, or alternatively an outer circumferential surface adjacent to the first sidewall, may define the outlet 171'. In other words, the outlet 171' is an opening through which evaporated working fluid (F) can be discharged to the heat pipe 172.

An inlet 171" that communicates with the return portion 172*b* may be formed at the other side of the heater case 171*a*. For example, a second sidewall of the heater case 171*a* adjacent to the return portion 172*b* (i.e. opposite the first sidewall), or alternatively an outer circumferential surface adjacent to the other sidewall may define the inlet 171". In other words, the inlet 171" is an opening through which condensed working fluid (F) can be collected into the heating unit 171 while passing through the heat pipe 172.

The heater 171*b* can be accommodated inside the heater case 171*a* and have a shape that is extended along a length direction of the heater case 171*a*. The heater 171*b* may be inserted through the second sidewall of the heater case 171*a* adjacent to the inlet 171" and fixed to the heater case 171*a*. In this way, one side of the heater 171*b* may be fixed to the second sidewall in a sealed and supported manner, and the other side of the heater 171*b* may be extended toward the first sidewall in an outlet direction of the heater case 171*a*.

A power unit 171*k* connected to a power source may be connected to one side of the heater 171*b*. The heater 171*b* may include a coil portion that is connected to the power unit 171*k* and configured to emit heat within the heater case 171*a*. During power application, a portion of the heater 171*b* that corresponds to the location of the coil portion can be heated to high temperatures. This portion of the heater 171*b* that corresponds to and is heated by the coil portion may be referred to as an active heating portion of the heater 171*b* for evaporating working fluid. Other portions of the heater 171*b* that is not directly heated by the coil portion during the heating process but may nevertheless be indirectly heated can be referred to as a non-active, or passive, heating portion.

Referring again to FIG. 2, the heat pipe 172 is connected to the heating unit 171, and a predetermined amount of working fluid (F) is filled therein. For the working fluid (F), refrigerant that exists in the liquid phase in a freezing condition of the refrigerator 100, but is phase-changed into the gas phase to perform the role of transferring heat when heated by the heater 171*b* may be used, for example, R-134a, R-600a, and the like. The heat pipe 172 may be formed of an aluminum material.

The heat pipe 172 may include the entrance portion 172*a* and the return portion 172*b* connected to the outlet 171' and inlet 171" of the heating unit 171, respectively. The entrance portion 172*a* corresponds to a portion to which working fluid (F) heated by the heating unit 171 is supplied, and the return portion 172*b* corresponds to a portion to which working fluid (F) is circulated through the heat pipe 172 and then returned before being heated by the heating unit 171.

As working fluid (F) is heated by the heating unit 171 at high temperatures, working fluid (F) flows due to a pressure difference that causes the working fluid (F) to circulate within the heat pipe 172. The return portion 172*b* is connected to the entrance portion 172*a* through the heating unit 171 to thereby circulate working fluid (F) entering through the return portion 172*b* of the heat pipe 172.

The heat pipe 172 is disposed adjacent to the evaporator 130 to allow working fluid (F) heated by the heating unit 171 to transfer heat to the evaporator 130 so as to remove frost.

In some implementations, the heat pipe 172 may have a repeatedly bent shape (zigzag shape) like the cooling tube 131. FIG. 2 illustrates that the heat pipe 172 may be formed in the same shape corresponding to the cooling tube 131. Accordingly, the heat pipe 172 may include a horizontal part 172*c*, a vertical part 172*d*, and a heat emitting part 172*e*.

The horizontal part 172*c* is connected to the outlet 171' of the heating unit 171, and disposed in a horizontal direction with respect to the evaporator 130. One end portion connected to the outlet 171' of the heating unit 171 on the horizontal part 172*c* may be referred to as the entrance portion 172*a*. The horizontal part 172*c* may extend horizontally to reach a bent portion of the cooling tube 131.

In some cases, if the heating unit 171 is positioned at a left side of the heating unit 171 as seen in FIG. 2, then the heating unit 171 may be directly connected to the vertical part 172*d* without the horizontal part 172*c*.

The vertical part 172*d* may extend to an upper portion of the evaporator 130 along the outside thereof. The vertical part 172*d* may be extended to a location adjacent to an accumulator 134 to remove frost formed on the accumulator 134. As illustrated in FIG. 2, the vertical part 172*d* of the heat pipe 172 may be extended in an upward direction toward the accumulator 134, and then bent and extended in a downward direction toward the cooling tube 131 and connected to the heat emitting part 172*e*.

The heat emitting part 172*e* may extend in a zigzag shape along the cooling tube 131 of the evaporator 130 from the vertical part 172*d* and connected to the inlet 171" of the heating unit 171. The heat emitting part 172*e* may include a plurality of horizontal tubes 172*e'* that form vertically spaced apart rows and a connecting tube 172*e"* having a U shape that connects the horizontal tubes 172*e'* in a zigzag shape. One end portion connected to the inlet 171" of the heating unit 171 on the heat emitting part 172*e* may be referred to as the return portion 172*b*.

Due to this configuration, with reference to FIG. 20, the temperature (TH) of the heating unit 171 has been shown to be the highest in the system, and the temperature (TL) of the lowest column of the heat emitting part 172*e* of the heat pipe 172 has been shown to be the lowest. Here, the lowest column of the heat emitting part 172*e* corresponds to a horizontal tube that is directly connected to the heating unit 171 and serving as the horizontal tube through which working fluid (F) passes immediately prior to being collected into the heating unit 171.

As described above, the heater 171*b* has a shape that can be accommodated within the heater case 171*a*, and extended along an extension direction of the heater case 171*a*. A predetermined amount of working fluid (F) can be filled into the heating unit 171 and heat pipe 172.

If a part of the heater 171*b* becomes exposed beyond a surface of the working fluid (F) that is in liquid phase, the temperature of the exposed portion of the heater 171*b*, during defrost operation, can abruptly increases compared to a portion of the heater 171*b* that remains submerged in the working fluid (F).

If such abrupt temperature increase of the exposed portion of the heater 171*b* were to occur, temperature in the space exposed above the working fluid (F) in the heating unit 171 may also increase abruptly, and high pressure may be formed therein.

On the other hand, because the temperature of a portion of the heater 171*b* submerged below the working fluid (F) does not abruptly increase and thus maintains a temperature lower than that of the exposed portion above the working fluid (F), the temperature of a portion in which the evaporation of working fluid (F) is actually carried out is relatively decreased. Accordingly, the pressure of the submerged portion becomes less than that of the exposed portion, thereby preventing the evaporated vapor from being transferred to the heat pipe 172 through the exposed space.

When such a process continues, the heating unit 171 may cause critical damage, for example fire damage, to the defrosting device 170. Additionally, or alternatively, a phenomenon may take place in which heated working fluid (F) flows backward to the side of where the working fluid (F) enters into the heating unit 171.

In order to prevent such a phenomenon, working fluid (F) filled into the heating unit 171 is filled to a level that is vertically higher than the highest side of the heater 171*b* in the liquid phase, for example, during the non-operation of the defrosting device 170. In this case, the entirety of the outlet 171' and the inlet 171" of the heating unit 171 is located below a surface of the working fluid (F). In some cases, a portion of the outlet 171' and the inlet 171" may be positioned vertically above the surface of the working fluid (F) while the heater 171*b* remains completely submerged.

According to the foregoing configuration, since the heater 171*b* is heated in a state of being submerged below a surface of the working fluid (F), working fluid (F) evaporated by heating may be sequentially transferred to the heat pipe 172, thereby allowing efficient circulation flow as well as preventing the overheating of the heating unit 171.

In the description above, the defrosting device 170 has been described as including the heating unit 171 and the heat pipe 172. The same defrosting device 170 may alternatively be described as including an evaporating unit (i.e. heating unit) and a condensing unit (i.e. heat pipe).

In more detail, because the evaporating unit is a portion for heating working fluid (F), working fluid (F) is heated by the heater 171*b* within the evaporating unit to get into the gas phase. Therefore, the evaporating unit may be understood as a portion corresponding to the foregoing heating unit 171.

Because a portion connected to both sides of the evaporating unit is designed to transfer heated working fluid (F) and collect condensed working fluid (F), the condensing unit forms a closed loop along with the evaporating unit. The working fluid (F) in the gas phase that has passed through the outlet 171' of the evaporating unit is introduced into the condensing unit and gradually condensed while flowing, and finally introduced into the evaporating unit again through the inlet 171" of the evaporating unit. Therefore, the evaporating unit may be understood as a portion corresponding to the foregoing heat pipe 172.

In some implementations, as described above, the heat pipe 172 may be installed to pass through a plurality of cooling fins 132. Accordingly, the heat pipe 172 may be flared in a state of being inserted into an insertion hole of the cooling fin 132, and securely inserted into the insertion hole. Due to this configuration, heat may be transferred to the cooling tube 131 through the cooling fin 132, thereby resulting in increased heat transfer efficiency.

In such a flared structure, the heat pipe 172 may be inserted into a front portion and a rear portion of the cooling fin 132, respectively, to form two rows. Otherwise, the heat pipe 172 may be inserted into one (one of a front portion and a rear portion) cooling fin 132 of the cooling tube 131 to form a single row or inserted into the cooling fin 132 between a first cooling tube and a second cooling tube positioned on the front and rear portions, respectively, to form two rows.

Alternatively, the heat pipe 172 may be accommodated between a plurality of cooling fins 132 fixed to each column of the cooling tube 131. Accordingly, the heat pipe 172 is disposed between each column of the cooling tube 131. Here, the heat pipe 172 may be configured to make contact with the cooling fin 132.

Furthermore, the heat pipe 172 may be installed adjacent to a front portion and a rear portion of the evaporator 130, respectively, to form two rows. Otherwise, the heat pipe 172 may be installed adjacent to one (either one of a front portion and a rear portion of the evaporator 130) of the cooling tube 131 to form a single row or disposed between a first cooling tube and a second cooling tube positioned on the front and rear portions, respectively, to form two rows.

Referring now to FIGS. 4 and 5, a cooling tube 231 is repeatedly bent in a zigzag shape to form a plurality of columns. The cooling tube 231 may include a first cooling tube 231*a* and a second cooling tube 231*b* formed on a front portion and a rear portion of the evaporator 230, respectively, to form two columns. The cooling tube 231 may be formed of an aluminum material and is filled with refrigerant.

The heating unit 271 may be disposed below the lowest column of the cooling tube 231. The heating unit 271 may be disposed at one lower end portion of the evaporator 230 to increase heat transfer to the lowest column of the cooling tube 231.

The heat pipe 272 is extended and branched from the heating unit 271, and may include a first heat pipe 272' and a second heat pipe 272" disposed at both sides, respectively, by interposing the cooling tube 231 therebetween. The first heat pipe 272' may be disposed on a front surface of the first cooling tube 231*a* and the second heat pipe 272" may be disposed on a rear surface of the second cooling tube 231*b* to form two rows.

When the heat pipe 272 is configured with two rows, a temperature difference between the first heat pipe 272' and the second heat pipe 272" may occur since working fluid (F) may not be uniformly introduced into the first and the second heat pipe 272', 272". In order to minimize the temperature difference, the first and the second heat pipe 272', 272" may be formed to have the same length. In some implementations, the first and the second heat pipe 272', 272" may be formed with the same length as well as formed with the same shape.

In some implementations, both the first and the second heat pipe 272', 272" may include the entrance portion 272*a*', 272*a*" and the return portion 272*b*', 272*b*". Working fluid (F) in the gas phase heated by the heating unit 271 is introduced into the entrance portion 272*a*', 272*a*", and working fluid in the liquid phase that has circulated through the heat pipe 272 and returned is introduced into the return portion 272*b*', 272*b*".

The heating unit 271 may include a heater case 271*a* and a heater 271*b*. The heater case 271*a* may include a main case portion 271*c* and a buffer portion 271*f*. The heater case 271*a* may be formed of a copper material.

The main case portion 271*c* may extend along one direction to accommodate the heater 271*b* therein. One end portion of the main case portion 271*c* may be connected to the entrance portion 272*a*', 272*a*", and the other end portion of the case portion 271*c* may be closed.

The buffer portion 271*f* may protrude and extend away from an outer circumference of the main case portion 271*c*. The buffer portion 271*f* can be connected to the return portion 272*b*', 272*b*" to form a passage in which the direction of working fluid (F) returned through the return portion 272*b*', 272*b*" is switched at least once before being introduced into the main case portion 271*c*.

The buffer portion 271*f* may include a first buffer portion 271*f* connected to the return portion 272*b*' of the first heat pipe 272' and a second buffer portion 271*f* connected to the return portion 272*b*" of the second heat pipe 272". The first and the second buffer portion 271*f*, 271*f* may protrude from both outer circumferences of the main case portion 271*c*, respectively, and extend along an extension direction of the main case portion 271*c* along a same horizontal plane as that of the main case portion 271*c* during installation.

Further implementations of the buffer portion 271*f* will be described further below with reference to FIGS. 38 through 40.

In some cases, the heat pipe 272 may be accommodated between a plurality of cooling fins 232 that are fixed to each column of the cooling tube 231. Accordingly, the heat pipe 272 is disposed between each column of the cooling tube 231. The heat pipe 272 may be configured to make contact with the cooling fin 232.

In some cases, the entrance portion 272*a*', 272*a*" may be extended along a horizontal direction to correspond to an extension direction of the lowest column so as to correspond to configuration of the lowest column of the cooling tube 231 that extends along a horizontal direction of the evaporator 230. The heating unit 271, in particular the main case portion 271*c*, may be extended along a horizontal direction. Moreover, the heating unit 271 may be disposed at one lower end portion of the evaporator 230 to increase heat transfer to the lowest column of the cooling tube 231.

Referring now to FIG. 6, a heating unit 371 may be disposed in a horizontal direction with respect to an evaporator 330. The heating unit 371 may be positioned to overlap with the evaporator 330 at a lower portion of the evaporator 330. For example, the heating unit 371 may be disposed to overlap with the lowest column of the cooling tube 331, and may have a shape extended along an extension direction of the cooling tube 331.

An overlapping range with the cooling tube 331 disposed with the heating unit 371 may be understood as being between one side of the evaporator 330 at which the vertical part 372*d* of the heat pipe 372 and the other side at an opposite side thereof (i.e., within a horizontal length (E) of the evaporator 330).

The heat pipe 372 that extends to a horizontal part 372*c*, vertical part 372*d*, and heat emitting part 372*e* can be connected to the heating unit 371. This connection completes a closed loop in which working fluid (F) can circulate.

In some cases, as shown in FIG. 7, the heating unit 371 may be disposed closer to a side of the evaporator 330 at which the vertical part 372*d* of the heat pipe 372 is located.

The horizontal part 372*c* may be connected to one side of the heating unit 371, for example, one sidewall of the heater case or an outer circumferential surface adjacent to the same sidewall). A portion connected to the outlet 371' formed at one side of the heating unit 371 on the horizontal part 372*c* may be referred to as an entrance portion 372*a* through which the evaporated working fluid (F) is introduced.

The vertical part 372*d* may be connected to the horizontal part 372*c* and extended upward toward an upper side of the evaporator 330. The vertical part 372*d* may be connected to the heat emitting part 372*e*, and the heat emitting part 372*e* may be extended in a zigzag shape toward a lower side of the evaporator 330, and connected to the other side of the heating unit 371. A portion connected to the inlet 371" formed at the other side of the heating unit 371 in the heat emitting part 372*e* may be referred to as a return portion 372*b* through which working fluid (F) is returned.

The horizontal part 372*c* may be disposed in a horizontal direction with respect to the evaporator 330, and the length thereof may be formed to be shorter than ½ of the horizontal length (E) of the evaporator 330. The heating unit 371 may be located closer to a side of the evaporator 330 at which the vertical part 372*d* is located.

As illustrated in the above, when the heating unit 371 is installed closer to the left side (when the evaporator 330 is seen from the front side of FIG. 7), working fluid may be efficiently circulated.

This can be because as the length of the horizontal part 372*c* connected to the heating unit 371 decreases, a length on which working fluid (F) evaporated by the heating unit 371 flows to the vertical part 372*d* decreases. This translates to a decrease in flow resistance, and as a result the evaporated working fluid (F) may rapidly rise for circulation.

In some cases, the outlet 371' may be formed at one side of the heating unit 371, for example, one sidewall of the heater case or an outer circumferential surface adjacent to the one sidewall, and the vertical part 372*d* may be directly connected to the outlet 371'. In other words, the heat pipe 372 extended to the vertical part 372*d* and heat emitting part 372*e* may be connected to the heating unit 371, thereby completing a closed loop in which working fluid (F) can circulate.

Alternatively, as illustrated in FIG. 8, the heating unit 371 may be disposed closer to the other side of the evaporator 330, that is, an opposite side of the side of the evaporator 330 at which the vertical part 372*d* of the heat pipe 372 is located.

In this configuration, the horizontal part 372*c* may be connected to one side of the heating unit 371 (for example, one sidewall of the heater case or an outer circumferential surface adjacent to the one sidewall). A portion connected to the outlet 371' formed at one side of the heating unit 371 on the horizontal part 372*c* may be referred to as the entrance portion 372*a* through which the evaporated working fluid (F) is introduced.

The vertical part 372*d* may be connected to the horizontal part 372*c* and extended upward toward an upper side of the evaporator 330. The vertical part 372*d* may be connected to the heat emitting part 372*e*, and the heat emitting part 372*e* may be extended in a zigzag shape toward a lower side of the evaporator 330 and connected to the other side of the heating unit 371. A portion connected to the inlet 371" formed at the other side of the heating unit 371 in the heat emitting part 372*e* may be referred to as the return portion 372*b* through which working fluid (F) is returned.

In this configuration, the horizontal part 372*c* may be disposed in a horizontal direction with respect to the evaporator 330, and the length thereof may be shorter than ½ of the horizontal length (E) of the evaporator 330. Moreover, the heating unit 371 may be located closer to the other side of the evaporator 330.

When the heating unit 371 is installed closer to the right side (when the evaporator 330 is seen from the front side of FIG. 8), working fluid may be efficiently circulated.

This can be because when a large flow resistance is formed at a bending portion connected to the heat emitting part 372*e* in a zigzag shape, a structure in which the heating unit 371 is formed closely to the bending portion may be advantageous in suppressing working fluid (F) being returned through the return portion 372*b* from flowing back.

Referring to FIG. 9, a surface height of working fluid (F) within the heater case 371*a* may be designed to be vertically higher than the top portion of the outlet 371'. Accordingly, since the heater 371*b* is heated while fully submerged below a surface of the working fluid (F), working fluid (F) evaporated by heating may be sequentially transferred to the heat pipe 372, thereby allowing efficient circulation flow as well as preventing the overheating of the heating unit 371.

Moreover, the entrance portion 372*a* is connected between the vertical part 372*d* located at an outside of the evaporator 330 and arranged in a vertical direction and the outlet 371' of the heating unit 371 to communicate between them. As shown, the heater case 371*a* is disposed in a horizontal direction with respect to the evaporator 330 to form the horizontal part 372*c*. The horizontal part 372*c* may be completely filled with the working fluid (F) as illustrated in FIG. 9.

Referring to FIGS. 10(*a*) and 10(*b*), an example of defrosting device 470 can be seen from the front side (a) and lateral side (b). For reference, part of the cooling tube 431 is hidden due to overlapping with the heat pipe 472 in FIG. 10A, but the entire shape of the cooling tube 431, including first and second cooling tubes 431*a*, 431*b*, may be visualized indirectly by the layout of the cooling fins 432 or directly in FIG. 10B.

As illustrated, the cooling tube 431 and heat pipe 472 may be repeatedly bent in a zigzag shape to form a plurality of columns.

Specifically, the cooling tube 431 may be configured in combination with horizontal pipe portions and bending pipe portions. The horizontal pipe portions are horizontally disposed to each other in a vertical direction, and configured to pass through the cooling fins 432, and the bending pipe portions connect an end portion of an upper horizontal pipe portion to an end portion of a lower horizontal pipe portion to communicate their inner portions with each other.

Each column of the horizontal pipe portion may be disposed at predetermined intervals as illustrated in the drawing.

The heat pipe 472 may include a horizontal part 472*c*, a vertical part 472*d* and a heat emitting part 472*e*.

The heat emitting part 472*e* is extended in a zigzag shape along the cooling tube 431 of the evaporator 430 from the vertical part 472*d* and connected to the inlet 471" of the heating unit 471. The heat emitting part 472*e* is configured in combination with a plurality of horizontal tubes 472*e*' constituting columns and a connecting tube 472*e*" formed in a bent U-shaped tube to connect them in a zigzag shape.

According to the structure, the horizontal part 472*c* and heat emitting part 472*e* (strictly speaking, horizontal tube) are arranged in a horizontal direction to form a horizontal arrangement tube. In such a horizontal arrangement tube, a distance between each column of the lower portion may be formed to be less than that of each column of the upper portion. It is a design considering convection according to the temperature of working fluid (F) when the working fluid (F) circulates through the heat pipe 472.

Specifically, working fluid (F) introduced through the entrance portion 472*a* has the highest temperature during the circulation process of the heat pipe 472 in the gas phase at high temperatures. As illustrated in the drawing, the high-temperature working fluid (F) flows to the side of the cooling tube 431 located at an upper portion, and thus high-temperature heat is transferred to a large area by convention in the vicinity of the cooling tube 431 at the upper portion.

On the contrary, working fluid (F) flows in a state liquid and gas coexist while gradually dissipating heat, and as a result, is introduced into the return portion 472*b* in the liquid phase, wherein heat at this time is a sufficient temperature for removing the frost of the cooling tube 431, but the extent of transferring heat transfer to the surrounding medium is lower as compared to the foregoing case.

Accordingly, in consideration of this, each column of the heat pipe 472 adjacent to the return portion 472*b* (i.e., a horizontal tube of the heat emitting part 472*e*) is disposed at smaller intervals compared to each column of the heat pipe 472 located at the upper portion. For example, each column of the heat pipe 472 located at the upper portion may be disposed to correspond to the column of an adjoining cooling tube 431 by interposing one column of the cooling tube 431 therebetween, and each column of the heat pipe 472 located at the lower portion may be disposed to correspond to each column of the cooling tube 431.

According to the structure, a relatively large number of horizontal tubes of the heat emitting part 472*e* are arranged at a lower portion of the evaporator 430.

Furthermore, according to the arrangement, as a lower portion of the evaporator 430 is more quickly defrosted compared to an upper portion thereof, the drainage of defrost water occurring at the cooling tube 431 and cooling fin 432 may be efficiently carried out.

Referring now to FIGS. 11(*a*) and 11(*b*), another example defrosting device 570 can be seen from the front side (a) and lateral side (b). For reference, a second heat pipe 572" is not seen due to overlapping with the first heat pipe 572' in FIG. 11A, but the entire shape of the second heat pipe 572" may be visualized with reference to FIG. 11B. An evaporator 530 having a cooling tube 531, which includes first and second cooling tubes 531*a*, 531*b*, may be positioned between the first and second heat pipes 571', 572'.

As illustrated, a distance between horizontally extended tubes disposed at a lower portion of the first and the second heat pipe 572', 572" may be configured to be less than that between horizontally extended tubes disposed at an upper portion. Such a design accounts for convection factors that can vary according to the temperature of working fluid (F) as the working fluid (F) circulates through the heat pipe 572.

In some cases, the first and the second heat pipe 572', 572" may have the same length to uniformly introduce working fluid 573 into the first and the second heat pipe 572', 572". The second heat pipe 572', 572" may also have the same shape.

FIG. 12 shows another example of a defrosting device 670. For clarity, portions of first and second cooling tubes 631*a*, 631*b* are omitted.

Referring to FIG. 12, a distance between horizontal rows disposed at a lower portion of the first heat pipe 672' may be configured to be less than that of horizontal rows disposed at an upper portion of the first heat pipe 672'. Conversely, a distance between horizontal rows disposed at an upper portion of the second heat pipe 672" may be configured to be less than that of horizontal rows disposed at a lower portion of the second heat pipe 672". Here, the first and the second heat pipes 672', 672" may have the same length to help uniformly introduce working fluid 673 into the first and second heat pipes 672', 672".

Due to this configuration, a temperature decrease due to any one portion having a larger distance of the heat pipe 672', 672" may be compensated by a temperature increase due to a corresponding portion having a smaller distance of the heat pipe 672', 672". Accordingly, even though the heat pipe 672', 672" are configured to have a small distance, heat may be efficiently transferred to the cooling tube 631.

Referring now to FIG. 13, a defrosting device may include a heating unit 771. The heating unit 771 may include a heater 771*b* configured to generate thermal energy to heat working fluid (F) filled therein. A heat pipe can be connected to both sides of the heating unit 771, respectively, through an entrance portion 772*a* and a return portion 772*b* to form a passage through which working fluid (F) circulate.

As illustrated, the working fluid (F) in its liquid phase completely fills the heating unit 771, for example, during the non-operation of the defrosting device 770. According to the configuration, the outlet 771' of the heating unit 771 is located below a surface of the working fluid (F).

In some cases, the heating unit 771 may be disposed at a lower portion of a defrosting device. In this case, a considerable amount of working fluid (F) may be filled into the entrance portion 772*a* and return portion 772*b* of the heat pipe 772. For example, when the entrance portion 772*a* is extended from the heating unit 771 in a horizontal direction, working fluid (F) may completely fill the entrance portion 772*a*.

Furthermore, the continuous supply of working fluid (F) in the gas phase to the heat pipe may be stably carried out, thereby preventing an abnormal phenomenon in which the flow of working fluid (F) is intermittent (pulsatory) within the heat pipe.

Referring now to FIGS. 14 through 16, examples of defrosting devices with different filling heights of working fluid (F) are shown.

An evaporator 830 may include a cooling tube 831 (cooling pipe), a plurality of cooling fins 832, and a plurality of support fixtures 833.

The cooling tube 831 may be repeatedly bent in a zigzag shape to form a plurality of columns, and refrigerant can be filled therein. The cooling tube 831 may be configured in combination with horizontal pipe portions and bending pipe portions. The horizontal pipe portions may be horizontally disposed to each other in a vertical direction, and configured to pass through the cooling fins 832. The bending pipe portions can connect an end portion of an upper horizontal pipe portion to an end portion of a lower horizontal pipe portion to communicate their inner portions with each other.

For the cooling tube 831, a plurality of cooling fins 832 may be disposed to be separated at predetermined intervals along an extension direction of the cooling tube 831. The cooling fin 832 may be formed with a flat body made of an aluminum material, and the cooling tube 831 may be flared in a state of being inserted into an insertion hole of the cooling fin 832, and securely inserted into the insertion hole.

A plurality of support fixtures 833 may be provided at both sides of the evaporator 830, respectively, and each of which is extended in a forward and backward direction to support a bent end portion of the cooling tube 831.

The defrosting device 870 may be configured to remove frost generated from the evaporator 830, and installed on the evaporator 830 as illustrated in the drawing. The defrosting device 870 may include an evaporating unit 871 and a condensing unit 872.

The evaporating unit 871 may be electrically connected to a controller, and configured to generate heat upon receiving an operation signal from the controller. For example, the controller may be configured to apply an operation signal to the evaporating unit 871 for each predetermined time interval or apply an operation signal to the evaporating unit 871 when the sensed temperature of the cooling chamber 816 is less than a predetermined temperature.

The condensing unit 872 is connected to the evaporating unit 871, and a predetermined amount of working fluid (F) is filled therein. For the working fluid (F), refrigerant (for example, R-134a, R-600a, etc.) may be used.

The condensing unit 872 may include the entrance portion 872*a* and the return portion 872*b* connected to the outlet 871' and inlet 871" of the evaporating unit 871, respectively. The entrance portion 872*a* corresponds to a portion to which working fluid (F) heated by the evaporating unit 871 is supplied, and the return portion 872*b* corresponds to a portion to which working fluid (F) is circulated through the condensing unit 872 and then returned.

As working fluid (F) filled therein is heated by the evaporating unit 871 at high temperatures, working fluid (F) can flow due to a pressure difference to circulate the condensing unit 872. The return portion 872*b* is connected to the entrance portion 872*a* through the evaporating unit 871 to circulate working fluid (F) introduced to the return portion 872*b* of the condensing unit 872.

The condensing unit 872 is disposed adjacent to the evaporator 830 to allow working fluid (F) heated by the evaporating unit 871 to transfer heat to the evaporator 830 so as to help remove frost.

In some cases, the condensing unit 872 may have a repeatedly bent shape (zigzag shape) like the cooling tube 831. The condensing unit 872 may include a horizontal part 872*c*, a vertical part 872*d*, and a heat emitting part 872*e*.

The horizontal part 872*c* is connected to the outlet 871' of the heating unit 871, and disposed in a horizontal direction with respect to the evaporator 830. One end portion connected to the outlet 871' of the evaporating unit 871 on the horizontal part 872*c* may be understood as the entrance portion 872*a*. The horizontal part 872*c* may extend horizontally to reach a bent portion of the cooling tube 831.

The horizontal part 872*c* may be disposed below the lowest horizontal tube of the horizontal pipe portion of the evaporator 830 or, in some cases, at the same height as that of the lowest horizontal tube.

If the evaporating unit 871 is disposed to closer to the left side (as seen in FIGS. 14-16), then the evaporating unit 871 may be directly connected to the vertical part 872*d* without the horizontal part 872*c*.

The vertical part 872*d* may be extended to an upper portion of the evaporator 830 along the outside thereof. The vertical part 872*d* may be extended to a location adjacent to an accumulator 834 to remove frost formed on the accumulator 834. As illustrated in the drawing, the vertical part 872*d* of the condensing unit 872 is extended in an upward direction toward the accumulator 834, and then bent and extended in a downward direction toward the cooling tube 831 and connected to the heat emitting part 872*e*.

The heat emitting part 872*e* may be extended in a zigzag shape along the cooling tube 831 of the evaporator 830 from the vertical part 872*d* and connected to the inlet 871" of the evaporating unit 871. The heat emitting part 872*e* may include a plurality of horizontal tubes 872*e'* that form vertically spaced apart rows and a connecting tube 872*e"* having a U shape that connects the horizontal tubes 872*e'* in a zigzag shape. One end portion connected to the inlet 871" of the evaporating unit 871 on the heat emitting part 872*e* may be referred to as the return portion 872*b*.

Due to this configuration, the temperature (TH) of the evaporating unit 871 may be the highest in the system, and the temperature (TL) of the lowest column of the heat emitting part 872*e* of the condensing unit 872 may be the lowest. Here, the lowest column of the heat emitting part 872*e* corresponds to a horizontal tube that is directly connected to the evaporating unit 871 and serving as a horizontal tube through which working fluid (F) passes immediately prior to being collected into the evaporating unit 871.

In some cases, the condensing unit 872 may be accommodated between a plurality of cooling fins 832 fixed to each column of the cooling tube 831. The condensing unit 872 may be disposed between each column of the cooling tube 831. Here, the condensing unit 872 may be configured to make contact with the cooling fin 832. The horizontal part 872*c* may be disposed at the lowest end of the condensing unit 872 and disposed below the lowest horizontal tube of the horizontal pipe portion of the evaporator 830.

According to the foregoing structure, working fluid (F) may be filled to be higher than the horizontal part 872*c* of the condensing unit 872. Here, the height at which working fluid (F) is filled therein may be set to be lower than the lowest column (L) and vertical part 872*d* of the heat emitting part 872*e* disposed directly on the horizontal part 872*c* of the condensing unit 872.

The evaporating unit 871 may be completely filled with the working fluid (F) in the liquid phase while the evaporating unit 871 is located at a lower portion of the defrosting device 870, and thus it may be possible to more securely prevent a phenomenon in which an abrupt temperature difference occurs in the entire defrosting device 870.

Furthermore, when it is configured that working fluid (F) flows out of the outlet 871' of the evaporating unit 871 to fill up to part of the entrance portion 872*a* of the condensing unit 872, an internal temperature increase of the evaporating unit 871 may be uniformly carried out, and working fluid (F) may be changed into the gas phase and continuously and stably supplied to the evaporating unit 871.

In some cases, when part or all of the entrance portion 872*a* and return portion 872*b* of the evaporating unit 871 are connected in a horizontal direction, and working fluid (F) is configured to fill up to part of the entrance portion 872*a* and return portion 872*b*, it may be possible to more securely accomplish the objective of the present disclosure.

On the other hand, the evaporating unit 871 may be disposed in a horizontal direction of the evaporator 830, and disposed at a location overlapping with the evaporator 830 at a lower portion of the evaporator 830. For example, the evaporating unit 871 may be disposed to overlap with the lowest horizontal tube of the horizontal pipe portion of the cooling tube 831, and may have a shape extended along an extension direction of the cooling tube 831.

As another example, as illustrated in FIG. 15, working fluid (F) may be filled up to part of the vertical part 872*d* of the condensing unit 872. In this case, working fluid (F) may be filled up to at least the lowest column (L) of the heat emitting part 872*e*.

In another example, as illustrated in FIG. 16, working fluid (F) may be filled up to a middle height (H/2) between the highest column of the heat emitting part 872*e* and the horizontal part 872*c*. In this case, working fluid (F) may be filled up to part of the vertical part 872*d*.

For yet still another example, working fluid (F) may be filled to be higher than the horizontal part 872*c* of the condensing unit 872, but filled to be less than the middle height (H/2) between the highest column of the heat emitting part 872*e* and the horizontal part 872*c*. In this case, working fluid (F) may be filled up to part of the vertical part 872*d* of the condensing unit 872.

Other implementations between the example illustrated in FIG. 14 (a lower limit of the filling height of working fluid (F)) and the example illustrated in FIG. 16 (an upper limit of the filling height of working fluid (F)) may also be possible.

The installation location and direction of the evaporating unit 871 may not be necessarily limited to a specific configuration. For example, the installation location and direction of the evaporating unit 871 may be disposed in a vertical direction as well as in a horizontal direction.

According to the examples of FIGS. 14 through 16, a defrosting operation may continue while the supply of heated and evaporated working fluid (F) in the gas phase is continuously and stably carried out, and working fluid (F) may be uniformly positioned over the entire region of the condensing unit 872 even when all working fluid (F) in the liquid phase has changed into the gas phase, thereby obtaining an overall balance in evaporation due to the heating of working fluid and the collection of working fluid (F) due to heat exchange and phase change.

Accordingly, it may be possible to remove frost within a short period of time as well as reduce power consumption.

FIG. 17 shows another example of an evaporator 930 in which at least part of a heating unit is vertically disposed.

Referring to FIG. 17, the evaporator 930 may include a cooling tube 931 (cooling pipe), a plurality of cooling fins 932, and a plurality of support fixtures 933.

The cooling tube 931 be repeatedly bent in a zigzag shape to form a plurality of columns. The cooling tube 931 may be configured in combination with horizontal pipe portions and bending pipe portions. The horizontal pipe portions may be horizontally disposed to each other in a vertical direction, and configured to pass through the cooling fins 932. The bending pipe portions can connect an end portion of an upper horizontal pipe portion to an end portion of a lower horizontal pipe portion to communicate their inner portions with each other.

For the cooling tube 931, a plurality of cooling fins 932 may be disposed to be separated at predetermined intervals along an extension direction of the cooling tube 931. The cooling fin 932 may be formed with a flat body made of an aluminum material, and the cooling tube 931 may be flared in a state of being inserted into an insertion hole of the cooling fin 932, and securely inserted into the insertion hole.

A plurality of support fixtures 933 may be provided at both sides of the evaporator 930, respectively, and each of which is extended in a forward and backward direction to support a bent end portion of the cooling tube 931.

The defrosting device 970 may be configured to remove frost generated from the evaporator 930, and installed on the evaporator 930 as illustrated in the drawing. The defrosting device 970 may include a heating unit 971 and a heat pipe 972.

The heating unit 971 may be electrically connected to a controller, and configured to generate heat upon receiving an operation signal from the controller. For example, the controller may be configured to apply an operation signal to the heating unit 971 for each predetermined time interval or apply an operation signal to the heating unit 971 when the sensed temperature of the cooling chamber 116 is less than a predetermined temperature.

The heating unit 971 may be disposed at a lower portion of the defrosting device 970. The heating unit 971 may include a heater case 971*a* and a heater 971*b*.

The heater case 971*a* may be formed to accommodate the heater 971*b* therein. The heater case 971*a* may be formed in a cylindrical or rectangular pillar shape, among others.

The heater case 971*a* may include a portion extended in a vertical direction from a lower side to an upper side of the evaporator 930. Here, the portion extended in the vertical direction may be located at an outside of the evaporator 930 (a location out of a bent portion of the cooling tube 931).

The heater case 971*a* is connected to the heat pipes 972, respectively, to form a passage through which working fluid (F) can circulate.

In some cases, an outlet 971' connected to the heat pipe may be formed at one side of the heater case 971*a* (for example, one sidewall of the heater case 971*a* or an outer circumferential surface adjacent to the one sidewall). In other words, the outlet 971' is an opening through which evaporated working fluid (F) can be discharged to the heat pipe 972.

An inlet 971" connected to the heat pipe 972 may be formed at the other side of the heater case 971*a* (for example, the other sidewall of the heater case 971*a* or an outer circumferential surface adjacent to the other sidewall). In other words, the inlet 971" denotes an opening through which condensed working fluid (F) is collected to the heating unit 971 while passing through the heat pipe 972.

According to the present example, the heater case 971*a* may be disposed in a vertical direction from an lower side to an upper side of the evaporator 930, and an outlet 971' and an inlet 971" may be formed at an upper end and a lower end of the heater case 971*a*. The outlet 971' is connected to an end portion of the vertical part 972*d* of the heat pipe 972. Here, the inlet 971" may be connected to an end portion of the horizontal part 972*c* of the heat pipe 972.

The heater 971*b* is accommodated into the heater case 971*a* to have a shape extended along an extension direction of the heater case 971*a*. In other words, the heater 971*b* may include a portion extended along a vertical direction similar to the heater case 971*a*.

The heater 971*b* may be inserted through the other sidewall of the heater case 971*a* adjacent to the inlet 971" and fixed to the heater case 971*a*. In other words, one side of the heater 971*b* may be fixed to the other sidewall in a sealed and supported manner, and the other side may be extended in an outlet direction of the heater case 971*a*.

A power unit 971*k* connected to a power source may be connected to one side of the heater 971*b*. The heater 971*b* may include a coil portion that is connected to the power unit 971*k* to emit heat within the heater case 971*a*. During power application, a portion formed with a coil can be heated at high temperatures to constitute an active heating portion of the heater 971*b* for evaporating working fluid.

On the other hand, it is configured such that working fluid (F) is full-filled into the heater case 971*a* in the liquid phase (for example, during the non-operation of the defrosting device 970). According to the configuration, the outlet 971' of the heating unit 971 is located below a surface of the working fluid (F).

Both end portions of the heat pipe 972 are connected to both end portions of the heating unit 971, respectively, to form a closed loop, and disposed adjacent to the evaporator 930 such that working fluid (F) heated by the heating unit 971 transfers heat to the evaporator 930 to remove frost. To this end, the heat pipe 972 may include a vertical part 972*d* and a heat emitting part 972*e*.

The vertical part 972*d* is connected to the outlet 971' of the heating unit 971 disposed at an outside, and extended toward an upper side of the evaporator 930. The vertical part 972*d* may be extended to a location adjacent to an accumulator 934 to remove frost formed on the accumulator 934. As illustrated in the drawing, the vertical part 972*d* of the heat pipe 972 is extended in an upward direction toward the accumulator 934, and then bent and extended in a downward direction toward the cooling tube 931 and connected to the heat emitting part 972*e*.

The heat emitting part 972*e* is extended in a zigzag shape along the cooling tube 931 of the evaporator 930 from the vertical part 972*d* and connected to the inlet 971" of the heating unit 971. The heat emitting part 972*e* is configured in combination with a plurality of horizontal tubes 972*e*' constituting columns and a connecting tube 972*e*" formed in a bent U-shaped tube to connect them in a zigzag shape.

The lowest column of the horizontal tube of the heat emitting part 972*e* may be disposed below the lowest horizontal tube of the horizontal pipe portion of the evaporator 930 or at the same height as that of the lowest horizontal tube.

For example, the heat pipe 972 may be accommodated between a plurality of cooling fins 932 fixed to each column of the cooling tube 931. Accordingly, the heat pipe 972 may be disposed between each column of the cooling tube 931. Here, the heat pipe 972 may be configured to make contact with the cooling fin 932.

According to this configuration, the lowest column of the horizontal part 972*c* is disposed below the lowest horizontal tube of the horizontal pipe portion of the evaporator 930.

For another example, the heat pipe 972 may be installed to pass through a plurality of cooling fins 932. Accordingly, the heat pipe 972 may be flared in a state of being inserted into an insertion hole of the cooling fin 932, and securely inserted into the insertion hole. It may allow heat to be transferred to the cooling tube 931 through the cooling fin 932, thereby resulting in increased heat transfer efficiency.

According to the structure, the lowest column of the horizontal tube of the heat emitting part 972*e* may be disposed at the same height as that of the lowest horizontal tube of the horizontal pipe portion of the evaporator 930.

On the other hand, working fluid (F) may be filled to be higher than the highest end of the heater 971*b* extended in a vertical direction within the heater case 971*a*. According to the structure, a defrosting operation may be safely carried out in a state that the heating unit 971 is not overheated, and the continuous supply of working fluid (F) in the gas phase to the heat pipe may be stably carried out, thereby preventing an abnormal phenomenon in which the flow of working fluid (F) is intermittent (pulsatory) within the heat pipe.

For another example, working fluid (F) may be filled higher than the highest end of the heater 971*b* extended in a vertical direction within the heater case 971*a*, but filled lower than a middle height between the highest horizontal tube and the lowest horizontal tube of the heat emitting part 972*e* of the heat pipe 972.

For still another example, the heater case 971*a* may be vertically extended such that the outlet 971' is formed at a higher position than a middle position between the highest horizontal tube and the lowest vertical tube of the heat emitting part 972*e* of the heat pipe 972. In this case, it may be configured such that working fluid (F) is filled lower than a middle height between the highest horizontal tube and the lowest horizontal tube of the heat emitting part 972*e* of the heat pipe 972, and the highest height of the heater 971*b* does not exceed the level of working fluid (F).

Referring now to FIGS. 18 and 19, a heater case 1071*a* of a heater unit 1071 may include portions extended in vertical and horizontal directions. In this case, the outlet 1071' is formed at a portion vertically extended from the heater case 1071*a*, and the inlet 1071" is formed at a portion horizontally extended from the heater case 1071*a*.

The portion vertically extended from the heater case 1071*a* may be disposed at an outside of an evaporator 1030 (a location out of a bent portion of the cooling tube), and the portion horizontally extended from the heater case 1071*a* may be disposed at a lower portion of the evaporator 1030. Here, the lower portion of the evaporator 1030 may include a location below the lowest column or overlapping with the lowest column.

As further illustrated in FIG. 19, a heater 1071*b* of a heater unit 1071 may be horizontally disposed within a portion extended in a horizontal direction of the heater case 1071*a*. Here, working fluid (F) is filled higher than the highest end of the portion horizontally extended from the heater case 1071*a*.

In some implementations, an installation angle of the heating unit with respect to the heat pipe have affect the circulation of the working fluid (F).

Referring to FIGS. 20(*a*)-(*f*), a series of graphs illustrate an example temperature change of each column of the heating unit 871 and heat pipe 872 according to an angle at which the side of an outlet 871' of heating unit 871 is inclined with respect to the side of an inlet 871" thereof in the structure of FIG. 14.

For reference, "TH" is a temperature of the heating unit 871, and "TL" is a temperature of the lowest column (L) of the heat emitting part 872*e* of the heat pipe 872. Since working fluid (F) is heated by the heating unit 871 and circulated through the heat pipe 872, and then returned to the heating unit 871, the temperature (TH) of the heating unit 871 is the highest, and the temperature (TL) of the lowest column (L) of the heat emitting part 872*e* is the lowest. Accordingly, it should be understood that the temperature of the remaining columns of the heat pipe 872 is between TH and TL. In FIG. 20, for the sake of convenience of explanation, only temperature curves corresponding to TH and TL are shown as indicator lines.

Whether or not the working fluid (F) will circulate varies according to an angle formed by the heating unit 871 with respect to the central axis of the entrance portion 872*a*. When the heating unit 871 is extended in one direction, and the outlet 871' and inlet 871" are formed at both end portion thereof, it is associated with an inclination formed by the side of the outlet 871' with respect to the inlet 871".

0° denotes that the heating unit 871 is placed on the central axis of the entrance portion 872*a*, and a positive (+) angle denotes that the heating unit 871 is disposed upward with respect to the central axis of the entrance portion 872*a*, and a negative (−) angle denotes that the heating unit 871 is disposed downward with respect to the central axis of the entrance portion 872*a*.

As illustrated in FIGS. 20(*a*) through 20(*c*), when the heating unit 871 is placed on the central axis of the entrance portion 872*a* or disposed downward with respect to the central axis thereof (when the side of the outlet 871' is formed at the same height as that of the inlet 871" or the side of the outlet 871' is formed at a higher location than that of the inlet 871"), the temperature of each column of the heating unit 871 and heat pipe 872 increases in a similar manner as the passage of time, and reaches a stable operation temperature after a predetermined period of time has passed. It denotes that the circulation of working fluid (F) is efficiently carried out.

As a result of experiment, when the heating unit 871 is disposed in a range between 0° to −90° with respect to the central axis of the entrance portion 872*a*, a temperature curve according to the passage of time indicates that working fluid (F) is able to circulate the heat pipe 872.

On the contrary, referring to FIGS. 20(*d*) through 20(*f*), when the heating unit 871 is disposed upward with respect to the central axis of the entrance portion 872*a* (the outlet 871' is formed at a lower location than that of the inlet 871"), the temperature of each column of the heating unit 871 and heat pipe 872 shows an appreciable difference for each angle.

When the heating unit 871 is rotated 2° upward with respect to the central axis of the entrance portion 872*a* (the side of the inlet 871" is rotated 2° upward with respect to the side of the inlet 871"), the graph does not show a big difference from the foregoing graphs.

However, it is seen that the temperature of the heating unit 871 is abruptly increased and decreased at an initial stage when the heating unit 871 is rotated 3° upward with respect to the central axis of the entrance portion 872*a* (the side of the inlet 871" is rotated 3° upward with respect to the side of the inlet 871"), and it is confirmed that the temperature of the heating unit 871 is continuously increased and the heat pipe 872 does not get out of an initial temperature when the heating unit 871 is rotated 4° upward with respect to the central axis of the entrance portion 872*a* (the side of the inlet 871" is rotated 4° upward with respect to the side of the inlet 871").

Accordingly, when the heating unit 871 is rotated more than 3° upward with respect to the central axis of the entrance portion 872*a* (the side of the inlet 871" is rotated more than 3° upward with respect to the side of the inlet 871"), it may become difficult for working fluid (F) to flow down toward the central axis portion of the entrance portion 872*a* located relatively therebelow even though working fluid (F) is heated by the heating unit 871.

In particular, when the heating unit 871 is rotated more than 4° upward with respect to the central axis of the entrance portion 872*a* (the side of the inlet 871" is rotated more than 4° upward with respect to the side of the inlet 871"), working fluid (F) may not flow down toward the central axis portion of the entrance portion 872*a* but rather flow back through the return portion 872*b*. Therefore, the temperature of the heating unit 871 may continuously increase and potentially overheat due to lack of circulation.

Based on these sample experimental results, the heating unit 871 may be rotated more than −90° but less than 2° with respect to the central axis of the entrance portion 872*a*. In other words, the side of the inlet 871" of the heating unit 871 may be rotated more than −90° but less than 2° with respect to the outlet 871' to efficiently circulate working fluid (F).

FIG. 21 illustrates an example structure in which the side of an outlet 1271' is inclined downward to the side of an inlet 1271" in a horizontal arrangement structure of a heating unit 1271.

A heater case 1271*a* is disposed at a lower portion of the evaporator. Here, the lower portion of the evaporator may include a location below the lowest column of a cooling tube 1231 or overlapping with the lowest column thereof.

As illustrated, the heating unit 1271 is parallel to or rotated 2° upward with respect to the central axis of the entrance portion 1272*a* (the side of the inlet 1271" is parallel to or rotated 2° upward with respect to the side of the inlet 1271") to efficiently circulate working fluid (F).

Here, the heater case 1271*a* may be completely filled with working fluid (F).

FIG. 22 illustrates another example structure in which the side of the outlet 1271' is inclined upward to the side of the inlet 1271" in a horizontal arrangement structure of the heating unit 1271.

The heater case 1271*a* is disposed at a lower portion of the evaporator. Here, the lower portion of the evaporator may include a location below the lowest column of the cooling tube 1231 or, in some cases, overlapping with the lowest column thereof.

According to the present example, the heating unit 1271 is disposed downward with respect to the central axis of the entrance portion 1272*a* (when the side of the inlet 1271" is formed at a higher location than that of the side of the inlet 1271", namely, when the side of the inlet 1271" has an inclination of −90° to 0° that of the side of the inlet 1271") to efficiently circulate working fluid (F). For reference, a case where the heating unit 1271 is disposed in a vertical direction with respect to the central axis of the entrance portion 1272*a* is the same as the structure described above in FIG. 17.

In some cases, the heating unit 1271 may be filled with the working fluid (F) such that the surface level of the working fluid (F) is vertically higher than the highest point of the heater within the heating unit 1271.

Referring now to FIG. 23, the heater case 1271*a* is shown positioned at a lower edge of the evaporator. Here, the lower portion may include a location below the lowest column of the cooling tube 1231 or, in some cases, overlapping with the lowest column thereof.

As illustrated in the drawing, a lower end portion of the vertical part of the heat pipe 1272 (entrance portion 1272*a* as shown in FIG. 23) may be connected to the outlet 1271' of the heater case 1271*a*. In this case, the outlet 1271' of the heater case 1271*a* may be located at an outside of the evaporator (a location out of a bent portion of the cooling tube 1231).

According to the present example, when the heating unit 1271 is disposed downward with respect to the central axis of the entrance portion 1272*a* (when the side of the inlet 1271" is formed at a higher location than that of the side of the inlet 1271", namely, when the side of the inlet 1271" has an inclination of −90° to 0° that of the side of the inlet 1271") to efficiently circulate working fluid (F).

The heating unit 1271 may be filled with the working fluid (F) such that the surface level of the working fluid (F) is vertically higher than the highest point of the heater within the heating unit 1271.

Hereinafter, a working fluid (F) circulation mechanism of an example defrosting device 1370 will be described.

FIGS. 24 and 25 illustrate an example circulation of working fluid (F) prior to and subsequent to the operation of the heating unit 1371, and FIGS. 26 through 28 are graphs illustrating an appropriate amount of working fluid (F).

First, referring to FIG. 24, working fluid (F) is placed in the liquid phase prior to the operation of the heating unit 1371, and filled up to a predetermined upper column based on the lowest column of the heat pipe 1372. For example, in this state, working fluid (F) may be filled up to lower two columns of the heat pipe 1372.

In some cases, the condensing unit may include an entrance portion 1372*a* connected to the outlet of the evaporating unit disposed at the defrosting device 1370 to receive working fluid (F) in the gas phase, and a return portion 1372*b* connected to the inlet of the evaporating unit to collect condensed working fluid (F), and working fluid (F) fills up to part of the entrance portion 1372*a* and part of the return portion 1372*b* when working fluid (F) is in the liquid phase.

As illustrated in FIG. 25, during the operation of the heating unit 1371, working fluid (F) in the gas phase (F1) is introduced into the entrance portion 1372*a* to flow through the heat pipe 1372, and then flows in a phase (F2) that liquid and gas coexist while dissipating heat, and finally introduced into the return portion 1372*b* in the liquid phase (F3). The working fluid (F) introduced into the return portion 1372*b* is introduced again into the entrance portion 1372*a* in the gas phase by the heating unit 1371 to repeat (circulate) the foregoing flowing, and during the process, heat is transferred to the evaporator 1330 to remove frost formed on the evaporator 1330.

As described above, working fluid (F) flows due to a pressure difference generated by the heating unit 1371 to rapidly circulate the heat pipe 1372, and thus the entire section of the heat pipe 1372 may reach a stable operating temperature within a short period of time, thereby rapidly achieving the defrosting function.

Working fluid (F) in the gas phase introduced through the entrance portion 1372*a* may have the highest temperature during the circulation process of the heat pipe 1372. Accordingly, when the convection of heat due to working fluid (F) placed in the gas phase (F1) is used, it may be possible to efficiently remove frost formed on the evaporator 1330.

In some cases, the entrance portion 1372*a* may be disposed at a location relatively lower than the lowest column of the cooling tube 1331 provided in the evaporator 1330 or at the same location as the lowest column. Accordingly, working fluid (F) at high temperatures introduced through the entrance portion 1372*a* may transfer heat in the vicinity of the lowest column of the cooling tube 1331 as well as allow such heat to flow upward to be transferred to the cooling tube 1331 adjacent to the lowest column.

Furthermore, the entrance portion 1372*a* may be extended along a horizontal direction to correspond to an extension direction of the lowest column in response to the lowest column of the cooling tube 1331 being extended along a horizontal direction of the evaporator 1330. To this end, the heating unit 1371, in particular, main case portion 1371*c*, may be extended along a horizontal direction. Moreover, the heating unit 1371 may be disposed at one lower end portion of the evaporator 1330 to increase heat transfer to the lowest column of the cooling tube 1331.

Accordingly, the entrance portion 172*a* may be disposed adjacent to the lowest column of the cooling tube 131 with the longest length, and the remaining cooling tube 131 may be located at an upper portion of the lowest column of the cooling tube 131, thereby being able to maximize the amount of heat transferred to the cooling tube 131.

In order to allow working fluid (F) to circulate the heat pipe 1372 with such a phase change, an appropriate amount of working fluid (F) may be filled into the heat pipe 1372.

FIGS. 26 through 28 illustrate an example dependence of temperature at each column of the heating unit 1371 and heat pipe 1372 to the passage of time when working fluid (F) is filled up to 20%, 35%, and 70%, respectively, compared to the total volume of the heat pipe 1372 and heater case 1371*a* (excluding the volume of the heater 1371*b* accommodated therein). For reference, the power of the heater used for this sample experiment is 120 W.

For reference, "TH" is a temperature of the heating unit 1371, and "TL" is a temperature of the lowest column (L) of the heat emitting part 1372*e* of the heat pipe 1372. Since working fluid (F) is heated by the heating unit 1371 and circulated through the heat pipe 1372, and then returned to the heating unit 1371, the temperature (TH) of the heating unit 1371 is the highest, and the temperature (TL) of the lowest column (L) of the heat emitting part 1372*e* is the lowest. Accordingly, it should be understood that the temperature of the remaining columns of the heat pipe 1372 is between TH and TL. In FIGS. 26 through 28, for the sake of convenience of explanation, only temperature curves corresponding to TH and TL are shown as indicator lines.

As illustrated in FIG. 26, when working fluid (F) is filled up to 20% compared to the total volume of the heat pipe 1372 and heater case 1371*a*, it is seen that the temperature (TH) of the heating unit 1371 is rapidly increased according to the passage of time. It indicates that working fluid (F) compared to the total volume of the heat pipe 1372 and heater case 1371*a* is insufficient, and the most of working fluid (F) is unable to circulate the heat pipe 1372.

Furthermore, as illustrated in FIG. 27, when working fluid (F) is filled up to 70% compared to the total volume of the heat pipe 1372 and heater case 1371*a*, it is seen that the temperature of heat on part of the heat pipe 1372 is unable to reach a stable operating temperature (less than 50°). The temperature reduction is clearly shown as the heat pipe 1372 is located closer to the return portion 1372*b*. The result may indicate that working fluid (F) compared to the total volume of the heat pipe 1372 and heater case 1371*a* is excessive to increase a section through which working fluid (F) flows in the liquid phase.

Referring to FIG. 28, when working fluid (F) is filled up to 35% compared to the total volume of the heat pipe 1372 and heater case 1371*a*, the temperature (TH) of the heating unit 1371 and the temperature of each column of the heat pipe 1372 may reach a stable operating temperature as time passes. Here, it is seen that the temperature of each column of the heat pipe 1372 shows a higher temperature as being closer to the entrance portion 1372*a*, and shown a lower temperature as being closer to the return portion 1372*b*. For reference, even if it is a portion close to the return portion 1372*b*, the minimum arrival temperature (TL) is higher than a predetermined temperature capable of removing frost.

As a result of these sample experiments, it is seen that when working fluid (F) is filled up to 30% to 50% compared to the total volume of the heat pipe 1372 and heater case 1371*a*, a stable operation of the defrosting device 170 may be carried out as illustrated in FIG. 28. Meanwhile, when working fluid (F) is decreased, a difference between a temperature (TH) at a portion closer to the entrance portion 172*a* and a temperature (TL) closer to the return portion 172*b* may be decreased. However, it may be possible to choose an optimal amount of working fluid (F) for each of the defrosting devices 170 according to the heat transfer structure, stability, and the like of the defrosting device 170. For example, according to the present example, working fluid (F) may be filled up to 35% to 40% compared to the total volume of the heat pipe 1372 and heater case 1371*a*.

FIGS. 29 and 30 show heating units 1471, 1571 that are configured with a higher temperature portion (H1) and a lower temperature portion (H2). The drawings illustrate a structure, in which the heating unit 1471, 1571 is horizontally and vertically arranged, respectively, but the following description may be applicable regardless of a direction in which the heating unit 1471, 1571 is arranged, and a level of working fluid (F). Here, it should be noted that the temperature associated with the lower temperature portion (H2) is lower in relation to the temperature associated with the higher temperature portion (H1). In other words, the temperature at the lower temperature portion (H2) may still be elevated in relation to other portions of the defrosting device.

Defrosting devices 1470, 1570 may be configured to remove frost generated from the evaporator, and can be installed on the evaporator. The defrosting device 1470, 1570 may include a heating unit 1471, 1571 and a heat pipe 1472, 1572.

The heating unit 1471, 1571 is electrically connected to the controller, and configured to generate heat upon receiving an operation signal from the controller. For example, the controller may be configured to apply an operation signal to the heating unit 1471, 1571 for each predetermined time interval or apply an operation signal to the heating unit 1471, 1571 when the sensed temperature of the cooling chamber 116 is less than a predetermined temperature.

The heating unit 1471, 1571 includes a heater case 1471*a*, 1571*a* and a heater 1471*b*, 1571*b*.

The heater case 1471*a*, 1571*a* may be extended in one direction, and configured to accommodate the heater 1471*b*, 1571*b* therein. The heater case 1471*a*, 1571*a* may be formed in a cylindrical or rectangular pillar shape.

The heater case 1471*a*, 1571*a* is connected to an entrance portion 1472*a*, 1572*a* and a return portion 1472*a*, 1572*b* of the heat pipe 1472, 1572, respectively. In other words, the heater case 1471*a*, 1571*a* is communicated with the entrance portion 1472*a*, 1572*a* and return portion 1472*b*, 1572*b*, respectively, to form a passage through which working fluid (F) is introduced into the entrance portion 1472*a*, 1572*a* from the return portion 1472*b*, 1572*b*, which will be described later.

An outlet 1471', 1571' that is in fluidic communication with the entrance portion 1472*a*, 1572*a* may be formed at one side of the heater case 1471*a*, 1571*a*, for example, one sidewall of the heater case 1471*a*, 1571*a* or an outer circumferential surface adjacent to the one sidewall. In other words, the outlet 1471', 1571' is an opening through which evaporated working fluid (F) is discharged to the heat pipe 1472, 1572.

An inlet 1471", 1571" that is in fluidic communication with the return portion 1472*b*, 1572*b* may be formed at the other side of the heater case 1471*a*, 1571*a*, for example, the other sidewall of the heater case 1471*a*, 1571*a* or an outer circumferential surface adjacent to the other sidewall. In other words, the inlet 1471", 1571" is an opening through which condensed working fluid (F) is collected to the heating unit 1471, 1571 while passing through the heat pipe 1472, 1572.

The heater 1471*b*, 1571*b* may be accommodated into the heater case 1471*a*, 1571*a* and may have a shape extended along a length direction of the heater case 1471*a*, 1571*a*.

According to a temperature distribution within the heater case 1471*a*, 1571*a* during the operation of the heater 1471*b*, 1571*b*, an inner portion of the heater case 1471*a*, 1571*a* may include a higher temperature portion (H1) and a lower temperature portion (H2). One side of heat pipe 1472, 1572 is connected to the higher temperature portion (H1) and the other side of the heat pipe 1472, 1572 is connected to the lower temperature portion (H2).

In some cases, a heating part capable of generating heat may be disposed at the higher temperature portion (H1), and such a heating part may not be disposed at the lower temperature portion (H2).

The heating part may include a coil that is heated during power application to generate heat. As illustrated, the lower temperature portion (H2) is formed from one sidewall of the heater case 1471*a*, 1571*a* to an end portion at which the heating part, such as the coil, begins. Here, the inlet 1471", 1571" of the heater case 1471*a*, 1571*a* may be formed within the lower temperature portion (H2).

The higher temperature portion (H1) is formed from one end portion of the coil to the other sidewall of the heater case 1471*a*, 1571*a*. Here, the outlet 1471', 1571' of the heater case 1471*a*, 1571*a* is formed within the higher temperature portion, and more specifically, between the other end portion of the coil to the other sidewall of the heater case 1471*a*, 1571*a*.

A portion of the heater that includes the heating part, which is heated during power application, may be referred to as an active heating part (AHP) for evaporating working fluid. On the other hand, a portion of the heater on which the heating part is not disposed may be heated to a predetermined temperature level by receiving heat coming from the active heating part. However, such indirect heating may merely causes a predetermined temperature increase on the working fluid (F) that is not high enough to cause a phase-change of the working fluid (F) from the liquid into the gas phase. In this regard, the portion on which the heating part is not formed may be referred to as a non-active, or passive, heating part (PHP). In some cases, portions of the heater case that correspond to the active and passive parts of the heater may also be referred to actively-heated and passively-heated portions, respectively, of the heater case.

Relative to a boundary between a portion on which the heating part is disposed and a portion on which the heating part is not disposed, it may be understood that a side of the heater at which the heating part is formed can form a higher temperature portion. An opposing side at which the heating part is not formed can form a lower temperature portion having a relatively low temperature compared to the higher temperature portion.

In some cases, a first heater that can be heated at a relatively higher temperature than that of the lower temperature portion may be installed on the higher temperature portion (H1) of the heat pipe 1472, 1572, and a second heater having a relatively lower heating value may be installed on the lower temperature portion (H2).

The heat pipe 1472, 1572 is connected to the heating unit 1471, 1571, and a predetermined amount of working fluid (F) is filled therein. For the working fluid (F), typical refrigerant (for example, R-134a, R-600a, etc.) may be used.

The heat pipe 1472, 1572 may include the entrance portion 1472*a*, 1572*a* and the return portion 1472*b*, 1572*b* connected to the outlet 1471', 1571' and inlet 1471", 1571" of the heating unit 1471, 1571, respectively. The entrance portion 1472*a*, 1572*a* corresponds to a portion to which working fluid (F) heated by the heating unit 1471, 1571 is supplied, and the return portion 1472*b*, 1572*b* corresponds to a portion to which working fluid (F) is circulated through the heat pipe 1472, 1572 and then returned.

As working fluid (F) filled therein is heated by the heating unit 1471, 1571 at high temperatures, working fluid (F) flows due to a pressure difference to circulate the heat pipe 1472, 1572. At this time, the return portion 1472*b*, 1572*b* is connected to the entrance portion 1472*a*, 1572*a* through the heating unit 1471, 1571 to circulate working fluid (F) introduced to the return portion 1472*b*, 1572*b* of the heat pipe 1472, 1572.

The heat pipe 1472, 1572 may be disposed adjacent to the evaporator to allow working fluid (F) heated by the heating unit 1471, 1571 to transfer heat to the evaporator so as to remove frost.

In some cases, the heat pipe 1472, 1572 may have a repeatedly bent shape (zigzag shape) like the cooling tube. For example, the heat pipe 1472, 1572 may have the same shape corresponding to the cooling tube.

The heat pipe 1472, 1572 may include a vertical part 1472*d*, 1572*d* and a heat emitting part 1472*e*, 1572*e*, respectively. In some cases, as shown in FIG. 29, the heat pipe 1472, 1572 may further include the horizontal part 1472*c*.

The horizontal part 1472*c* is connected to the outlet 1471' of the heating unit 1471, and disposed in a horizontal direction with respect to the evaporator 130. One end portion connected to the outlet 1471' of the heating unit 1471 on the horizontal part 1472*c* may be understood as the entrance portion 1472*a*. The horizontal part 1472*c* may be extended to a bent portion of the cooling tube 131.

If the heating unit 1571 is disposed to be slanted to the left side on the drawing (see FIG. 30), then the heating unit 1571 may be directly connected to the vertical part 1572*d* without the horizontal part.

The vertical part 1472*d*, 1572*d* connected to the entrance portion 1472*a* may be extended to an upper portion of the evaporator along the outside thereof. The vertical part 1472*d*, 1572*d* may be extended to a location adjacent to an accumulator to remove frost formed on the accumulator of the evaporator. The vertical part 1472*d*, 1572*d* of the heat pipe 1472, 1572 may be extended in an upward direction toward the accumulator, and then bent and extended in a downward direction toward the cooling tube and connected to the heat emitting part 1472*e*, 1572*e*.

The heat emitting part 1472*e*, 1572*e* may be extended in a zigzag shape along the cooling tube of the evaporator from the vertical part 1472*d*, 1572*d* and connected to the inlet 1471", 1571" of the heating unit 1471, 1571. The heat emitting part 1472*e*, 1572*e* may include a plurality of horizontal tubes 172*e*' that form vertically spaced apart rows and a connecting tube 172*e*" formed in a bent U-shaped tube that connects them in a zigzag shape. One end portion connected to the inlet 1471", 1571" of the heating unit 1471, 1571 on the heat emitting part 1472*e*, 1572*e* may be referred to as the return portion 1472*b*, 1572*b*.

During the operation of the defrosting device 1470, 1570, the temperature (TH) of the heating unit 1471, 1571 may be the highest within the system, and the temperature (TL) of the lowest column of the heat emitting part 1472*e*, 1572*e* of the heat pipe 1472, 1572 may be the lowest. Here, the lowest column of the heat emitting part 1472*e*, 1572*e* corresponds to a horizontal tube directly on the heating unit 1471, 1571 as a horizontal tube through which working fluid (F) passes immediately prior to being collected to the heating unit 1471, 1571.

As described above, the heater 1472*b*, 1572*b* has a shape accommodated into the heater case 1471*a*, 1571*a*, and extended along one direction, which is an extension direction of the heater case 1471*a*, 1571*a*. Furthermore, a predetermined amount of working fluid (F) may be filled into the heating unit 1471, 1571 and heat pipe 1472, 1572.

In the description above, the defrosting device 1470, 1570 has been described as including the heating unit 1471, 1571 and heat pipe 1472, 1572. The same defrosting device 1470, 1570 may alternatively be described as including a evaporating unit (i.e. heating unit) and a condensing unit (i.e. heat pipe).

In more detail, because the evaporating unit is a portion for heating working fluid (F), working fluid (F) is heated by the heater 1472*b*, 1572*b* within the evaporating unit to get into the gas phase. Therefore, the evaporating unit may be understood as a portion corresponding to the foregoing heating unit 1471, 1571.

Because a portion connected to both sides of the evaporating unit is designed to transfer heated working fluid (F) and collect condensed working fluid (F), the condensing unit forms a closed loop along with the evaporating unit. The working fluid (F) in the gas phase that has passed through the outlet 1471', 1571' of the evaporating unit is introduced into the condensing unit and gradually condensed while flowing, and finally introduced into the evaporating unit again through the inlet 1471", 1571" of the evaporating unit. Therefore, the evaporating unit may be understood as a portion corresponding to the foregoing heat pipe 1472, 1572.

FIG. 31 shows an example defrosting device 1670, and FIGS. 32(*a*) and 32(*b*) show the defrosting device 1670 illustrated in FIG. 31 as seen from the front side (a) and lateral side (b).

Referring to FIGS. 31-32, the evaporator 1630 may include a cooling tube 1631, a plurality of cooling fins 1632, and a plurality of support fixtures 1633. The cooling tube 1631 may include a first cooling tube 1631*a* and a second cooling tube 1631*b* formed at a front portion and a rear portion of the evaporator 1630, respectively, to constitute two rows.

The defrosting device 1670 may be configured to remove frost generated from the evaporator 1630, and installed on the evaporator 1630 as illustrated in the drawing. The defrosting device 1670 may include the heating unit 1671 and heat pipe 1672 (heat transfer tube).

In some cases, the heat pipe 1672 may be disposed between a first cooling tube 1631*a* and a second cooling tube 1631*b*, and formed in a zigzag shape corresponding to the first and the second cooling tube 1631*a*, 1631*b*.

FIGS. 33 and 34 are views in which portion "C" of FIG. 32 is enlarged with different scale factors.

Referring to FIG. 33, the heating unit 1671 may include a heater case 1671*a* and a heater 1671*b*.

The heater case 1671*a* is connected to an entrance portion 1672*a* and a return portion 1672*b* of the heat pipe 1672. In other words, the heater case 1671*a* allows fluidic communication between the entrance portion 1672*a* and return portion 1672*b* to form a passage through which working fluid (F) is introduced into the entrance portion 1672*a* from the return portion 1672*b*.

The heater case 1671*a* may include a main case portion 1671*c* and a buffer portion 1671*f*.

The main case portion 1671*c* is extended along one direction to accommodate the heater 1671*b* therein. One end portion of the main case portion 1671*c* is connected to the entrance portion 1672*a*, and the other end portion thereof has a closed shape.

The buffer portion 1671*f* is extended in a shape protruded from an outer circumference of the main case portion 1671*c*, and connected to the return portion 1672*b* to form a passage in which the direction of working fluid (F) returned through the return portion 1672*b* is switched at least once and introduced into the main case portion 1671*c*. As illustrated, the buffer portion 1671*f* may be formed to be located below the main case portion 1671*c*.

In some cases, the diameter of the buffer portion 1671*f* is formed to be larger than that of the return portion to thereby help stabilize the flow of working fluid (F) returned through the return portion 1672*b*.

If working fluid (F) is directly heated by the heater 1671*b* when introduced into the heating unit 1671 through the return portion 1672*b*, it may cause a phenomenon in which working fluid (F) is evaporated to flow backward. To prevent or mitigate this, the heater 1671*b* includes an active heating part (AHP) and a passive heating part (PHP). Working fluid (F) being circulated through the heat pipe 1672 and then returned and introduced into the heating unit 1671 is first introduced to the passive heating part (PHP) before reaching the active heating part (AHP).

The active heating part (AHP) is designed to generate thermal energy required to heat working fluid (F), and is disposed adjacent to the side of the entrance portion 1672*a*. The passive heating part (PHP) is connected to a rear end of the active heating part (AHP) and is heated, at best, to a lower temperatures at which the evaporation of working fluid does not occur. The passive heating part (PHP) may be disposed adjacent to the other end portion of the main case portion 1671*c* that is closed. Accordingly, the buffer portion 1671*f* may be in fluidic communication with the main case portion 1671*c* such that it faces an outer circumstance of the passive heating part (PHP).

The active heating part (AHP) and passive heating part (PHP) may be formed in an extended manner along one direction. However, the present disclosure may not be necessarily limited to this. In some cases, the passive heating part (PHP) may be extended in a slanted or bent manner with respect to the active heating part (AHP).

Working fluid (F) introduced into the buffer portion 1671*f* through the return portion 1672*b* is introduced into a space (S2) between the passive heating part (PHP) and the main case portion 1671*c* without being directly introduced into the active heating part (AHP). Therefore, reheating of the working fluid (F) is prevented or mitigated, and thus backflow in which working fluid (F) is introduced into the return portion 1672*b* may not occur. As working fluid (F) subsequently reaches a space (S1) between the active heating part (AHP) and the main case portion 1671*c* through the space (S2) between the passive heating part (PHP) and the main case portion 1671*c*, it is reheated by the active heating part (AHP) to carry out circulation through the heat pipe 1672 as described above.

Accordingly, efficiency of the circulation flow of working fluid (F) within the heat pipe 1672 as well as continuous supply of heated working fluid (F) may be improved, and the backflow of cooled and returned working fluid (F) may be restricted.

Referring now to FIG. 34, the heater 1671*b* may be submerged into working fluid (F) when the working fluid (F) is all in the liquid phase (for example, during non-operation). In other words, the entire portion of heater 1671*b* from one side to the other side thereof may be submerged into working fluid (F) in its liquid phase. The working fluid (F) in the liquid phase may completely fill the evaporating unit.

Accordingly, a defrosting operation may be safely carried out without overheating the heating unit 1671, and the continuous supply of working fluid (F) in the gas phase to the heat pipe 1672 may be stably carried out, thereby preventing an abnormal phenomenon in which the flow of working fluid (F) is intermittent (pulsatory) within the heat pipe.

The heater 1671*b* may include a body portion 1671*g* and a coil 1671*h*.

The body portion 1671*g* is formed in a hollow shape constituting an appearance of the heater 1671*b*. The body portion 1671*g* may be extended along one direction as illustrated in the drawing. The body portion 1671*g* may be formed of a metallic material having a high thermal conductivity.

A coil 1671*h* is formed on part of the body portion 1671*g*. The coil 1671*h* is connected to the power unit 1671*k*, and configured to generate heat during power application. Meanwhile, an insulation material 1671*j* may be filled into a portion on which the coil 1671*h* is not formed on the body portion 1671*g*. According to the present drawing, it is illustrated that the coil 1671*h* is provided at a front side of the body portion 1671*g*, and the insulating material 1671*j* is filled at a rear side thereof.

According to the structure, a portion on which the coil 1671*h* is formed during power application may form an active heating part (AHP) heated at high temperatures to evaporate working fluid, and a portion on which the coil 1671*h* is not formed does not generate heat to form a passive heating part (PHP). Relative to a boundary between a portion on which the coil 1671*h* is disposed and a portion on which the coil 1671*h* is not disposed, it may be understood that a side at which the coil 1671*h* is formed forms a higher temperature portion (H1) and an opposing side at which the heating part is not formed forms a lower temperature portion (H2) having a relatively low temperature.

The heating unit 1671 may include a higher temperature portion (H1) and a lower temperature portion (H2), and one side of the heat pipe 1672 is connected to the higher temperature portion (H1) of the heating unit 1671, and the other side of the heat pipe 1672 is connected to the lower temperature portion (H2) of the heating unit 1671. An active heating part (AHP) heated at high temperatures to evaporate working fluid is formed within the higher temperature portion (H1) of the heating unit 1671, and a lower temperature portion (H2) of the heating unit 1671 is configured not to generate the evaporation of working fluid.

A rear end portion of the heater 1671*b* on which the coil 1671*h* is not formed to form the passive heating part (PHP) may be inserted into the insertion portion 1671*c*' of the heater case 1671*c* and fixed to the heater case 1671*c*. Here, a sealing portion 1673 for preventing the leakage of working fluid (F) is provided between the rear end portion of the heater 1671*b* and the insertion portion 1671*c*'. The sealing portion 1673 may be formed by coating a gel-type sealing member such as silicon on a rear end portion or insertion portion of the heater 1671*b* or formed by inserting a packing member such as rubber to a rear end portion of the heater 1671*b*.

In some cases, the power unit 1671*k* that is configured to supply power to the coil 1671*h* may be extended to an outside of the heating unit 1671 through a portion on which the coil 1671*h* is not formed. Due to the foregoing structure, the power unit 1671*k* may stably supply power to the coil 1671*h* without coming in contact with working fluid (F).

In some cases, the heater 1671*b* may form the active heating part (AHP), and a vacant space between the active heating part (AHP) and the return portion 1671*b* may form the passive heating part (PHP).

Accordingly, condensed working fluid (F) that flows to the heat pipe 1672 and is then introduced to the heating unit 1671 through the return portion 1672*b* is introduced to the heater 1671*b* forming the active heating part (AHP) through the vacant space forming the passive heating part (PHP) for reheating. Accordingly, a phenomenon in which working fluid (F) is evaporated to flow backward may be reduced.

In some cases, the heater 1671*b* that makes up the active heating part (AHP) may be installed at a portion adjacent to the outlet portion within the heating unit 1671 to form a higher temperature portion (H1), and the heater 1671*b* may not be disposed at a portion adjacent to the inlet to form a lower temperature portion (H2).

In this case, the inlet through which cooled working fluid (F) is collected from the heat pipe 1672, the lower temperature portion (H2) in which working fluid (F) is heated at low temperatures at which the evaporation of working fluid does not occur, the higher temperature portion (H1) in which working fluid (F) is heated at high temperatures to evaporate the working fluid (F), and the outlet portion through which working fluid (F) is discharged for the transfer to the evaporating unit are sequentially formed from a rear side of the evaporating unit to a front side thereof.

Furthermore, working fluid (F) at the high-temperature gas phase heated on the higher temperature portion (H1) is configured to form a circulation loop in which the working fluid (F) is transferred to the heat pipe 1672 through the outlet, and phase-changed through heat exchange while flowing along the heat pipe 1672 and cooled in the liquid phase, and collected to the side of the lower temperature portion (H2) through the inlet, and then reheated and supplied by the higher temperature portion (H1) again.

Referring to FIG. 35, a heating unit 1771 may include a heater case 1771*a* and a heater 1771*b*.

The heater case 1771*a* is extended along one direction to form an internal space limited by an outer circumferential surface and a first wall and a second wall at both sides of the outer circumferential surface. An outlet, which acts as a path connected to one end portion of the heat pipe to discharge working fluid (F), may be formed at one side of the heater case 1771*a*, and an inlet 1771", which acts as a path connected to the other end portion (return portion 1772*b*) of the heat pipe to collect working fluid (F), may be formed at the other side thereof.

If working fluid (F) is directly heated by the heater 1771*b* when first introduced into the heating unit 1771 through the return portion 1772*b*, it may cause a phenomenon in which working fluid (F) is evaporated to flow backward. To prevent this, it is configured such that the heater 1771*b* includes an active heating part (AHP) and a passive heating part (PHP), and working fluid (F) being circulated through the heat pipe 1772 and then returned and introduced into the heating unit 1771 is introduced into the active heating part (AHP) through the passive heating part (PHP).

The heater 1771*b* may include a coil 1771*h* and a support fixture 1771*m*.

The coil 1771*h* is disposed within the heater case 1771*a*, and connected to a power unit to generate heat during power application. Accordingly, a portion on which the coil 1771*h* is formed forms an active heating part (AHP) heated at high temperatures during power application to evaporate working fluid.

A portion formed with the coil 1771*h* and a front side thereof may form a higher temperature portion (H1) and a rear side on which the coil 1771*h* is not formed may form a lower temperature portion (H2) at relatively low temperature.

The support fixtures 1771*m* are connected to both ends of the coil 1771*h*, respectively, and installed and fixed to the heater case 1771*a*. As illustrated in the drawing, the support fixture 1771*m* may be inserted into the insertion portion 1771*a*' provided at a lateral surface of the heater case 1771*a* and fixed to the heater case 1771*a*. Here, a sealing portion for preventing the leakage of working fluid (F) is provided between the support fixture 1771*m* and the insertion portion 1771*a'*.

The power unit is connected to the coil 1771*h*, and exposed to an outside of the heater case 1771*a* through the support fixture 1771*m*.

The coil 1771*h* may be disposed between the inlet 1771" and the outlet of the heater case 1771*a*. In other words, the coil 1771*h* is disposed at a location away from the inlet 1771" of the heater case 1771*a*.

Accordingly, the heater 1771*b* can form an active heating part (AHP), a passive heating part (PHP), a higher temperature portion (H1) and a lower temperature portion (H2) through a structure in which the heater 1771*b* is disposed at the middle of the heater case 1771*a* as well as configured with only the coil 1771*h*.

Hereinafter, the detailed feature of a heating unit 1871, 1971 will be described with reference to FIGS. 36 and 37, respectively.

First, referring to FIG. 36, a lower temperature portion (H2) is formed from one sidewall of the heater case 1871*a* to one end portion from which the coil 1871*h* is started. Here, the inlet 1871" of the heater case 1871*a* may be formed within the lower temperature portion (H2).

A higher temperature portion (H1) is formed from one end portion of the coil 1871*h* to the other sidewall of the heater case 1871*a*. Here, the outlet of the heater case 1871*a* may be formed within the higher temperature portion (H1) (strictly speaking, between the other end portion of the coil 1871*h* and the other sidewall of the heater case 1871*a*).

The length of the higher temperature portion (H1) may be configured to be larger than that of the lower temperature portion (H2). For an example, the higher temperature portion (H1) and the lower temperature portion (H2) may be configured with the maximum 70% and 30% compared to the entire volume of the heating unit 1871, respectively. To this end, the coil 1871*h* may be configured to have the maximum 70% length compared to the entire length of the heater case 1871*a*.

As described above, when the return portion 1872*b* through which working fluid (F) is returned is formed at the side of the lower temperature portion (H2) of the heating unit 1871, and an outlet through which working fluid (F) at high temperatures is transferred is formed at the side of the higher temperature portion (H1) of the coil heating unit 1871, a circulation passage from a high pressure to a low pressure may be configured within a heat pipe type defrosting device according to the present example to efficiently circulate working fluid (F).

Referring to FIG. 37, the heater may be disposed in a space within the heater case 1971*a* corresponding to the inlet 1971". However, in order to prevent backflow due to the evaporation of working fluid (F) returned through the return portion 1972*b* of the heat pipe, the passive heating part (PHP) is located at a portion facing the inlet 1971" of the heater to receive partial heat from the active heating part so as to heat working fluid (F) at low temperatures to avoid causing unwanted evaporation.

The coil 1971*h* may be installed at a location deviated from an outlet side direction with respect to the inlet 1971" within the heater. An insulating portion may be located at a portion facing the inlet 1971" of the heater or configured with a hollow shape. In other words, the coil 1971*h* is not disposed at the portion to thereby form the passive heating part (PHP).

A power unit configured to supply power to the coil 1971*h* in the foregoing configuration may be extended to an outside of the heater case 1971*a* through an inside or vacant space of the insulating portion.

As shown in FIGS. 38-40, the defrosting device, as discussed above, may include a heating unit 2071, 2171, 2271 and a heat pipe.

Referring to FIG. 38, the heating unit 2071 may include a heater case 2071*a* and a heater 2071*b*.

The heater 2071*b* may include a coil connected to the power unit to dissipate heat within the heater case 2071*a*. A portion formed with the coil 2071*h* is heated at high temperatures during power application to constitute an active heating part for evaporating working fluid. The coil 2071*h* may be located at a location corresponding to the inlet 2071".

A buffer portion 2072*f* may be formed between the inlet 2071" of the heater case 2071*a* and the return portion 2072*b* of the heat pipe. The buffer portion 2072*f* may protrude from an outer circumference of the heater case 2071*a*, and connected to the return portion 2072*b* to form a passage in which the direction of working fluid (F) returned through the return portion 2072*b* is switched at least once and introduced into the heater case 2071*a*. The buffer portion 2072*f* may be formed as a U-shaped tube.

Based on this configuration, the heating unit 2071 may form a higher temperature portion, and the buffer portion 2072*f* may form a lower temperature portion. Since working fluid (F) that has passed through the return portion 2072*b* is introduced into the heating unit 2071, which is a higher temperature portion, through the buffer portion 2072*f*, the working fluid (F) is not reheated, and thus backflow in which the working fluid (F) is introduced into the return portion 2072*b* may be prevented or mitigated.

Referring to FIG. 39, the inlet 2171" of the heating unit 2171 may be formed on a lower outer circumference of the heater case 2171*a*. The buffer portion 2172*f* may be connected to the inlet 2171". The buffer portion 2172*f* may be extended in a downward direction, and connected to the return portion 2172*b* of the heat pipe. The buffer portion 2172*f* may have at least one bent portion.

The return portion 2172*b* connected to the buffer portion 2172*f* may include a portion extended in a horizontal direction in parallel to the heating unit 2171.

Referring to FIG. 40, the inlet 2271" of the heating unit 2271 may be formed on an outer circumference of the heater case 2271*a*. The buffer portion 2272*f* may be connected to the inlet 2271". The buffer portion 2272*f* may be extended in a crossing direction to a length direction of the heater case 2271*a*. For example, the buffer portion 2272*f* may be extended in a shape protruded in a vertical direction with respect to the heater case 2271*a* while maintaining the same height as that of the heater case 2271*a*.

The return portion 2272*b* of the heat pipe may be connected in a crossing direction to the buffer portion 2272*f*. In this case, the return portion 2272*b* of the heat pipe may also be disposed in parallel to the heater case 2271*a*.

In some cases, the diameter of the buffer portion 2072*f*, 2172*f*, 2272*f* may be formed to be larger than that of the return portion 2072*b*, 2172*b*, 2272*b*. Furthermore, the diameter of the heater case 171*a* may be formed to be larger than that of the buffer portion 2072*f*, 2172*f*, 2272*f*.

Referring now to FIGS. 41 and 42, another example of a heating unit 3171 includes a heater case 3171*a* and a heater 3171*b*. Here, a pair of outlets 3171*c'* and 3171*c"* defined by the heater case 3171*a*, which provide fluidic communication, respectively, to outlet pipes 3171*g'*, 3171*g"*, may be positioned to be spaced rearward from a forward most (i.e. left side as seen in FIG. 41) part of the heater case 3171*a*. In other words, the heater case 3171*a* includes a portion that extends past beyond the outlets 3171*c*', 3171*c*" along a length direction of the heater case 3171*a*.

To help reduce overheating of the heater 3171*b* and improve circulation flow of the working fluid (F), the center points of outlets 3171*c*' and 3171*c*" may be positioned, in the case of the heater case 3171*a* having an example length of 100 mm, between 10 mm and 20 mm from the forward most part of the heater case 3171*a*. In other words, the outlets 3171' and 3171*c*" may be placed more than 1/10 but less than 1/5 of the way rearward from the forward most portion of the heater case 3171*a*.

The heater 3171*b* can be divided into an active heating part 3171*b*1, a first passive heating part 3171*b*2, and a second passive heating part 3171*b*3. The first passive heating part 3171*b*2 may extend rearward (i.e. leftward as seen in FIG. 41) from the active heating part 3171*b*1. While the first passive heating part 3171*bn*2 may be heated to a predetermined temperature level by receiving heat coming from the active heating part 3171*b*1, such indirect heating may merely causes a predetermined temperature increase on the working fluid (F) that is not high enough to cause a phase-change of the working fluid (F) from the liquid into the gas phase.

Referring also to FIG. 43, the active heating part 3171*b*1 may include a heating coil 3171*b*1*b*. The first passive heating part 3171*b*2 can allow a lead wire 3171*b*1*c* for the coil 3171*b*1*b* to pass therethrough and may be made from an insulating material, such as magnesium oxide.

As described above with respect to other example heating units, in order to prevent unwanted heating of the working fluid (F) as well as backward flow thereof, inlets 3171*d*' and 3171*d*" into the heating unit 3171 may be positioned away from the active heating part 3171*b*1.

As shown in FIGS. 41 and 42, a portion of the first passive heating part 3171*b*2 may extend rearward beyond the heater case 3171*a*. This way, some of the heat coming from the heater 3171*b* may be removed externally, thereby lowering the surface load of the heater 3171*b*.

For the heater case 3171*a* having an example length of 100 mm, the active heating part 3171*b*1 may have a length of approximately 50 mm, in other words, about half the length of the heater case 3171*a*. Under the same scenario, the first passive heating part 3171*b*2 may have a length of approximately 30 mm, such that the ratio of the length of the active heating part 3171*b* to that of the first passive heating part 3171*b*2 is around 5:3.

Referring further to FIG. 43, the heater 3171*b* can include a cover member 3171*bb* and a heater frame 3171*ba*, a portion of which may extend outside of the heater case 3171*a*. The heater frame 3171*ba* may be made from stainless steel, among other materials.

The heating coil 3171*b*1*b* may be wound around a bobbin 3171*b*1*a*. Insulating material 3171*b*3*a*, which corresponds to the second passive heating part 3171*b*1*a*, may be positioned forward of the bobbin 3171*b*1*a*.

The present disclosure may include other specific forms without departing from the concept and essential characteristics thereof. The detailed description is, therefore, not to be construed as illustrative in all respects but considered as restrictive. The scope of the disclosure should be determined by reasonable interpretation of the appended claims and all changes that come within the equivalent scope of the disclosure are included in the scope of the disclosure.

The invention claimed is:

1. A defrosting device, comprising:

a heating unit configured to be filled with a predetermined amount of working fluid, the heating unit including an active heating part configured to be heated to a first temperature that can evaporate the working fluid, and a passive heating part positioned at a rear side of the active heating part and configured to be heated to a second temperature that is lower than the first temperature and at which the evaporation of the working fluid does not occur; and a heat pipe configured to be disposed adjacent to an evaporator to transfer heat to the evaporator while circulating working fluid heated by the active heating part, the heat pipe including an entrance portion configured to receive working fluid evaporated by the active heating part, and a return portion connected adjacent to the passive heating part and configured to receive working fluid that has condensed after circulating through the heat pipe, wherein the condensed working fluid received at the heating unit through the return portion first passes through the passive heating part before being reheated at the active heating part, wherein the evaporator comprises:

a cooling tube bent in a zigzag shape and defining a plurality of vertically spaced apart rows;

a plurality of cooling fins fixed to the cooling tube and spaced at predetermined intervals along an extension direction of the cooling tube; and a plurality of support fixtures configured to support both end portions of each horizontal row of the cooling tube, wherein the entrance portion of the heat pipe is disposed at a location vertically the same as or lower than the lowest row of the cooling tube of the evaporator, wherein the lowest row of the cooling tube is configured to extend along a horizontal direction of the evaporator, and wherein the entrance portion of the heat pipe is configured to extend along a horizontal direction that corresponds to an extension direction of the lowest row of the cooling tube.

2. The defrosting device of claim 1, wherein the heating unit comprises:

a heater case connected to the entrance portion and the return portion of the heat pipe, respectively; and a heater installed within the heater case, at least a portion of the heater being configured to generate heat.

3. The defrosting device of claim 2, wherein a first side of the heater disposed adjacent to the entrance portion of the heat pipe is part of the active heating part, and a second side of the heater opposite the first side that is disposed adjacent to the return portion of the heat pipe is part of the passive heating part.

4. The defrosting device of claim 3, wherein the active heating part and the passive heating part extend along a length direction of the heater case.

5. The defrosting device of claim 3, wherein the heater comprises:

a body portion that is configured to extend along one direction; and a coil portion disposed on a portion of the body portion and that is configured to connect to a power unit to generate heat based on power application, wherein a portion of the heater corresponding to the coil portion is a part of the active heating part and a portion of the heater in which the coil portion is not formed is part of the passive heating part.

6. The defrosting device of claim 5, wherein an insulation material is filled into a portion of the heater in which the coil portion is not formed on the body portion.

7. The defrosting device of claim 5, wherein the heater case is configured to define an insertion portion through which a rear end portion of the passive heating part of the heater is inserted to expose the power unit to an outside of the heating unit through the rear end portion of the heater, and a sealing portion that is configured to restrict the leakage of working fluid, is provided between the rear end portion of the heater and the insertion portion.

8. The defrosting device of claim 2, wherein the active heating part includes the heater, and the passive heating part includes a vacant space that is defined between the heater and the return portion.

9. The defrosting device of claim 2, wherein the heater case comprises:

a main case portion connected to the entrance portion of the heat pipe, and provided with the active heating part and the passive heating part; and a buffer portion extended from an outer circumference of the main case portion and configured to provide fluidic communication between the return portion of the heat pipe and the main case portion to thereby receive condensed working fluid at the passive heating part.

10. The defrosting device of claim 1, wherein the heating unit is disposed at a lower end portion of the evaporator and configured to increase heat transfer to the lowest column of the cooling tube.

11. The defrosting device of claim 1, wherein the heat pipe passes through a plurality of cooling fins that are mounted to the cooling tube.

12. The defrosting device of claim 1, wherein the heat pipe is accommodated between a plurality of cooling fins mounted at each row of the cooling tube.

13. The defrosting device of claim 2, wherein 30 to 50% of working fluid compared to the total volume of the heat pipe and the heater case is filled into the heat pipe.

14. The defrosting device of claim 1, wherein the heating unit is disposed at an angle of −90° to 2° with respect to a central axis of the entrance portion to facilitate the flow of the working fluid.

15. A refrigerator, comprising:

a refrigerator body;

an evaporator installed on the refrigerator body and configured to absorb ambient evaporation heat to cool a fluid within the evaporator; and a defrosting device configured to remove frost formed on the evaporator according to claim 1.

16. The refrigerator of claim 15, wherein the heat pipe is repeatedly bent in a zigzag shape to form a plurality of horizontal rows, and a distance between each row disposed at a lower portion of the heat pipe is less than that between each row disposed at an upper portion of the heat pipe.

17. The defrosting device of claim 4, wherein the passive heating part includes a first passive heating part and a second passive heating part between which the active heating part is interposed.

18. The defrosting device of claim 4, wherein at least a portion of the passive heating part extends to an outside of the heater case.

19. The defrosting device of claim 1, wherein the heat pipe is configured to extend and branch from the heating unit, and the heat pipe comprises:

a first heat pipe disposed in front of the cooling tube, and a second heat pipe disposed behind the cooling tube.

* * * * *